US008359769B2

(12) United States Patent
Vattes et al.

(10) Patent No.: US 8,359,769 B2
(45) **Date of Patent: *Jan. 29, 2013**

(54) CHIMNEY STRUCTURES FOR FOOTWEAR

(75) Inventors: David Vattes, Londonderry, NH (US); Christopher J. Pawlus, Andover, MA (US)

(73) Assignee: The Timberland Company, Stratham, NH (US)

( * ) Notice: Subject to any disclaimer, the term of this patent is extended or adjusted under 35 U.S.C. 154(b) by 1094 days.

This patent is subject to a terminal disclaimer.

(21) Appl. No.: 11/143,538

(22) Filed: Jun. 2, 2005

(65) Prior Publication Data

US 2006/0277787 A1 Dec. 14, 2006

(51) Int. Cl.
*A43B 7/06* (2006.01)

(52) U.S. Cl. ..... 36/3 A; 36/55; 36/54

(58) Field of Classification Search ..... 36/3 B, 36/3 A, 3 R, 54, 29, 35 B
See application file for complete search history.

(56) References Cited

U.S. PATENT DOCUMENTS

| | | | | | |
|---|---|---|---|---|---|
| 27,918 | A | * | 4/1860 | McErren | 36/3 A |
| 682,182 | A | * | 9/1901 | Ellings | 36/3 A |
| 757,424 | A | | 4/1904 | Vohl | |
| 1,125,134 | A | | 1/1915 | Lee | |
| 1,211,542 | A | | 1/1917 | Carolin | |
| 1,213,941 | A | * | 1/1917 | Patrick | 36/3 A |
| 1,335,273 | A | | 3/1920 | Bruce | |
| 1,476,127 | A | * | 12/1923 | Williams | 36/2 R |
| 1,902,780 | A | | 4/1930 | Holden et al. | |
| 1,885,327 | A | | 11/1932 | Burnham | |
| 2,300,681 | A | | 11/1942 | Margolin | |
| 2,437,065 | A | | 3/1948 | Austin | |
| 2,703,937 | A | | 3/1955 | McGinn | |
| 2,887,793 | A | | 5/1959 | Starr | |
| 2,966,684 | A | * | 1/1961 | Bonin | 2/81 |
| 3,044,188 | A | | 7/1962 | Evangelista | |
| 3,331,146 | A | | 7/1967 | Karras | |
| 4,137,653 | A | | 2/1979 | Famolare, Jr. | |
| 4,364,186 | A | | 12/1982 | Fukuoka | |
| 4,476,600 | A | | 10/1984 | Seidel et al. | |

(Continued)

FOREIGN PATENT DOCUMENTS

| | | |
|---|---|---|
| DE | 9016134 | 2/1991 |
| EP | 0350611 | 1/1990 |

(Continued)

OTHER PUBLICATIONS

Photograph of the stitched interior of a boot believed to be publicly available at least as early as Jul. 30, 2005.

*Primary Examiner* — Jila Mohandesi
(74) *Attorney, Agent, or Firm* — Lerner, David, Littenberg, Krumholz & Mentlik, LLP

(57) ABSTRACT

The present invention employs chimneys and chimneys structures to move or vent heat and moisture away from the foot and out of the microclimate of the shoe. The chimneys define pathways that utilize convection and other principles to cool and dry the foot. The chimneys and chimney structures can have many different configurations, and can be positioned anywhere desired in the upper. For example, chimneys can be positioned on the sidewalls of the upper, in the tongue, or both. Chimneys and chimney structures can also be used with form-fitting foot coverings such as socks or leggings, or used with other apparel. Specialized footbeds can also be employed with footwear chimneys to evacuate hot, moist air away from the underside of the foot and towards the chimneys.

15 Claims, 38 Drawing Sheets

U.S. PATENT DOCUMENTS

| | | | | |
|---|---|---|---|---|
| 4,485,568 | A | 12/1984 | Landi et al. | |
| 4,742,625 | A | 5/1988 | Sydor et al. | |
| 5,014,363 | A | 5/1991 | Hubner | |
| 5,044,096 | A | 9/1991 | Polegato | |
| 5,086,572 | A * | 2/1992 | Lee | 36/3 R |
| 5,295,312 | A * | 3/1994 | Blumberg et al. | 36/3 B |
| 5,339,545 | A * | 8/1994 | Paris | 36/117.6 |
| 5,357,689 | A | 10/1994 | Awai | |
| 5,365,677 | A | 11/1994 | Dalhgren | |
| 5,511,323 | A | 4/1996 | Dahlgren | |
| 5,526,584 | A | 6/1996 | Bleimhofer et al. | |
| 5,551,172 | A | 9/1996 | Yu | |
| 5,606,806 | A | 3/1997 | O'Dwyer | |
| D389,996 | S | 2/1998 | Sessa | |
| 5,799,413 | A * | 9/1998 | Argyris | 36/43 |
| 5,809,665 | A | 9/1998 | Suenaga | |
| 5,860,225 | A | 1/1999 | O'Dwyer | |
| 6,012,236 | A * | 1/2000 | Pozzobon | 36/55 |
| 6,014,823 | A | 1/2000 | Lakic | |
| 6,018,819 | A | 2/2000 | King et al. | |
| 6,228,477 | B1 | 5/2001 | Klare et al. | |
| 6,381,876 | B2 | 5/2002 | Krajcir | |
| 6,410,084 | B1 | 6/2002 | Klare et al. | |
| 6,547,751 | B1 * | 4/2003 | Barberio | 602/14 |
| 6,676,993 | B2 | 1/2004 | Klare | |
| 6,817,112 | B2 | 11/2004 | Berger et al. | |
| 6,854,603 | B2 | 2/2005 | Klare | |
| 2002/0120977 | A1 | 9/2002 | Smith | |
| 2004/0111918 | A1 | 6/2004 | Van noy et al. | |
| 2004/0221482 | A1 | 11/2004 | Berger et al. | |
| 2005/0028405 | A1 | 2/2005 | Wilson et al. | |

FOREIGN PATENT DOCUMENTS

| | | |
|---|---|---|
| EP | 0 353 430 | 2/1990 |
| EP | 0 427 556 | 5/1991 |
| EP | 0 458 174 | 11/1991 |
| EP | 0 732 067 | 9/1996 |
| EP | 0800777 | 10/1997 |
| EP | 0 910 964 | 12/2000 |
| EP | 1 118 280 | 1/2002 |
| FR | 1310482 | 11/1962 |
| GB | 191514398 | 2/1916 |
| WO | WO-0051457 | 9/2000 |

* cited by examiner 3A-3A 3B-3B 3C-3C 4A-4A 4B-4B

60'
76
78
54
56
62
64
34
34a
34b
4A
4B 7A-7A 7C-7C 8A-8A 8B-8B 9A-9A 9B-9B 9C-9C

FIG. 9G1
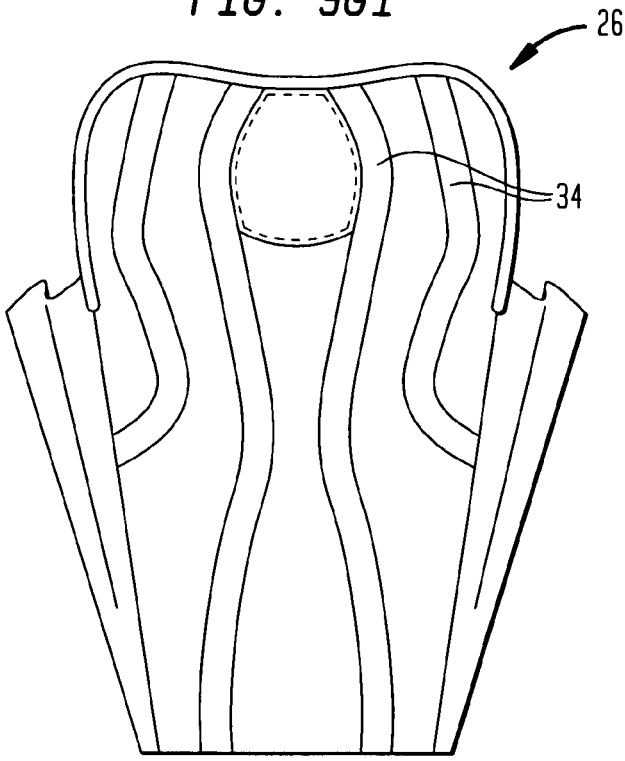
FIG. 9G2
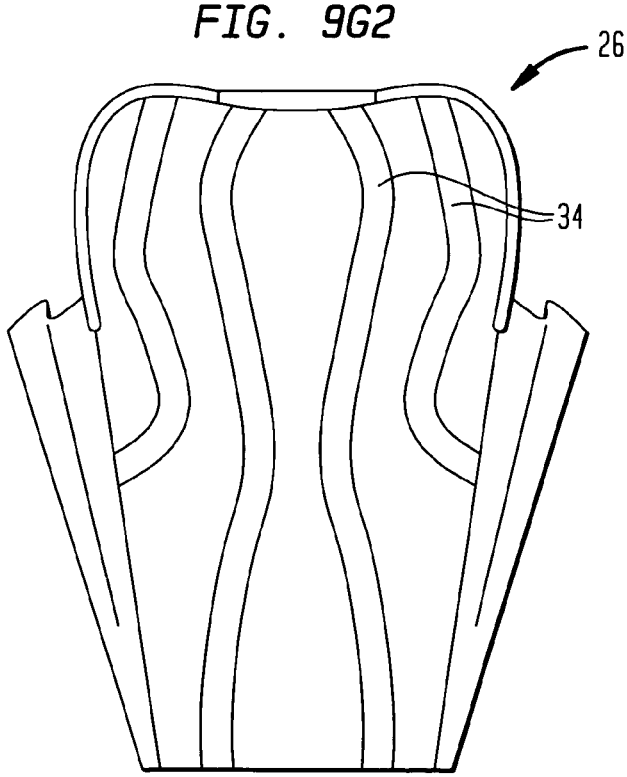

620

15A-15A

CHIMNEY STRUCTURES FOR FOOTWEAR

CROSS-REFERENCE TO RELATED APPLICATION

This application is related to U.S. patent application Ser. No. 11/143,232, filed concurrently herewith and entitled "CHIMNEY STRUCTURES FOR FOOTWEAR AND FOOT COVERINGS," and U.S. patent application Ser. No. 11/143,326, filed concurrently herewith and entitled "CHIMNEY STRUCTURES FOR APPAREL," the entire disclosures of which are hereby expressly incorporated by reference herein.

BACKGROUND OF THE INVENTION

The present invention relates generally to footwear. More particularly, the present invention relates to methods and structures for removing heat, odors, and/or moisture from an article of footwear such as a shoe or a boot.

As is well known, feet generate heat like other body parts. When feet are enclosed in shoes, for example, the shoes tend to retain the heat, which causes the feet to sweat. Sweat or perspiration is a mechanism for the body to flush wastes, regulate body temperature, and help keep the skin clean and pliant. Sweating can be a response to hard working muscles, a hot environment, or over stimulated nerves. It is the evaporation of perspiration from the skin that is the means of heat transfer. Because evaporative heat loss is the major mechanism of cooling, the body is constantly sweating as heat is transferred away from the core to the skin's surface. This is also referred to as insensible water loss, and is so named because it usually goes unnoticed. Insensible water loss, occurring via respiration and the skin (trans-epithelial) cannot be prevented, is a major source of heat loss for the body, and is not controlled by the body's regulatory system.

Eccrine sweat glands are the most numerous type of sweat glands and are found all over the body. They are particularly concentrated in the palms of the hands, soles of the feet and the forehead. There are approximately 250,000 sweat glands in a pair of feet. This represents more sweat glands per square inch of skin than any other part of the body. On average, sweat glands in the feet excrete as much as a half-pint of moisture a day. Moisture (also referred to herein as moisture vapor) includes a liquid that is diffused or condensed in relatively small quantity and dispersed through a gas as invisible vapor. Although sweat's main function is to control body temperature by evaporation, it also serves to keep the skin moist. As such, the skin covering the foot can withstand the constant flexing and friction that happens with locomotion, preventing the skin from rapidly becoming dry, irritated, and uncomfortable.

In the footwear industry the 'in shoe' experience of the foot is often referred to as the microclimate of the foot-so called due to the environment that is created when a foot is covered, even partially, by footwear. This zone includes the air trapped by footwear underneath and around the foot. When the footwear substantially covers the foot or just covers the forefoot, and especially if the entire foot is covered in a traditional shoe, boot or like type of footwear, the foot microclimate is a factor in both foot comfort and foot health. The feet experience the highs and lows of temperature and humidity with greater variation than elsewhere on the surface of the body. In part, this is because the feet are further from the heart than any other part of the body. Consequently, by the time the blood arrives to the feet, there has already been considerable cooling.

The core temperature of the body varies only slightly with large changes in environmental temperature, but there is a much greater effect on the feet. For example, with an air temperature of sixty-eight degrees, the surface temp of the foot at rest, without covering (protection) is approximately seventy-two degrees while the core body temperature remains constant at approximately ninety-eight degrees. In this instance, it is necessary to provide thermal insulation to the foot in order to maintain a comfortable foot temperature. Providing a waterproof barrier can also be extremely important feature of footwear in a wet environment as cold water temperatures and the resulting evaporative heat loss can leave the feet very cold and uncomfortable. In extreme situations, this can lead to frostbite and other deleterious conditions.

In the opposite environment, requirements for protective and other footwear are quite different. During activity in hot environments, foot temperature becomes elevated and the humidity within the shoe increases sharply. Of course, materials used in the upper and in the sock will affect both the in-shoe temperature and humidity. Materials that form a barrier to air permeability and water vapor transmission quickly create moist, hot, uncomfortable environments as evaporation of sweat is severely limited, as is air movement within the shoe microclimate. This can also result in an undesirable, malodorous condition.

In warm environments, most protective footwear creates an uncomfortable micro environment, and only the most breathable footwear can provide reasonable comfort for the wearer. A major factor that influences the rate of evaporation is the relative humidity of the air around the foot. If the air is humid, then it already has water vapor in it, probably near saturation, and cannot take any more. Therefore, sweat does not evaporate and cool the body as efficiently as when the air is dry.

Moist, hot air commonly creates a very uncomfortable experience for the foot. This is generally regarded as a compromise in footwear between protection and comfort. An ideal shoe would provide all the needed protection without reducing air flow around the foot. More ideally, air flow should be limited when the foot is cool and increased as foot temperature increases.

Two dynamic factors heavily influence footwear comfort, namely the external environment and the internal environment or microclimate. Protection from the external environment is important for several reasons, including protection from ground level objects or surfaces, moving objects and external climate (temperature and weather conditions). Protection may be provided through design and/or use of materials having characteristics such as insulation, durability, waterproofing and breathability.

Typically, the type of footwear (sandal, work boot, hiker, casual, golf shoe, running shoe, sneaker, etc.) is chosen based on intended use and climate considerations. For example, a runner would likely choose an insulated, waterproof running shoe during cold, wet weather and a light, breathable shoe for use in warm weather. A hiking shoe is commonly chosen for protection from objects in the hiking environment and external climate. Regulation of the footwear's internal environment is extremely important in order to provide a consistently comfortable micro environment as external and internal conditions change during activity. The internal environment is heavily influenced by heat and sweat produced by the body, which, as discussed above, is a method of controlling body temperature.

It is well known that a critical problem with protective and/or enclosed footwear is that moisture vapor from perspiration is trapped and cannot escape the footwear. In order to provide increased comfort, wicking characteristics have been applied to sock and liner materials. At least some of the moisture is absorbed within the footwear, the sock and/or the liner materials. Once such materials become saturated they can loose their effectiveness and create an unpleasant environment for the foot.

Such materials can quickly reach a saturation point as the moisture within the shoe typically does not have an efficient method of evaporation. Skin also absorbs moisture when in a saturated environment. Skin is softened by the absorbed moisture, becomes more sensitive to pressure, and also becomes prone to abrasion and fungal infection. Thus, the reduction in airflow around the foot and within an article of footwear presents a significant number of challenges to creating a comfortable environment for the foot.

Another consideration is that although there have been advances in materials that claim a level of breathability or airflow through (stand alone) material, testing has proven that when such materials are combined with traditional constructions of protective footwear, the breathability is greatly reduced due to construction types and the necessity of the materials to be used in combination with additional 'non-breathable' materials and adhesives during the construction process. Therefore, a need exists for advanced footwear and foot covering materials and methods of manufacture that enhance air flow and convective cooling of the foot while providing comfort, support and other common features of footwear.

SUMMARY OF THE INVENTION

In accordance with one embodiment of the present invention, an article of footwear is provided. The article of footwear comprises an outsole, an upper, and a chimney structure. The upper is attached to the outsole and defines a cavity for receiving a wearer's foot. The chimney structure comprises a plurality of chimneys defining pathways for moving heat or moisture from within the cavity to outside the article of footwear.

In one alternative, the chimney structure is disposed along a side panel of the upper. In another alternative, the chimney structure comprises a plurality of channels arranged in a row along the upper.

In a further alternative, the chimney structure comprises two rows of chimneys adjacent to one another. Here, the pathways of a first one of the rows face the cavity and the pathways of a second one of the rows face away from the cavity. In this case, the first row is preferably adjacent to a wearer's foot and the second row is preferably adjacent to the outside of the article of footwear. Optionally, each of the chimneys of the first row shares a common wall with a corresponding one of the chimneys of the second row. In this case, the common wall preferably includes at least one opening therein to enable the heat or moisture to pass from one of the pathways in the first row to one of the pathways in the second row.

In yet another alternative, the upper includes a collar and a body connected to the collar. The body defines the cavity and the collar providing an opening to the cavity. Selected pathways of at least some of the chimneys each have a first end disposed along the upper below the collar and a second end disposed along the collar. In this case, the first end of each selected pathway is preferably positioned at or below ankle height. Here, the first end of each selected pathway is desirably located to be adjacent to the bottom of foot. In yet another alternative, the movement of heat or moisture occurs by convection.

In accordance with another embodiment of the present invention, a chimney structure for convection of heat or moisture out of the microclimate of an article of footwear is provided. The chimney structure comprises a plurality of chimneys. Each of the chimneys includes a first end open to receive the heat or moisture from an interior of the article of footwear and a second end open to move the heat or moisture from within the interior to outside the article of footwear.

In one example, the chimneys are removably insertable into the article of footwear. In another example, the chimneys are integrally formed in the article of footwear.

In one alternative, each of the chimneys includes first and second sidewalls and an endwall connecting the first and second sidewalls. The sidewalls and the endwall define a pathway between the first and second ends of the chimney. In another alternative, each of the chimneys has a cross-sectional area of at least 16 $mm^2$. In a further alternative, the chimney structure comprises molded fabric with poured polyurethane. In yet another alternative, the chimneys have a hardness of at least 15 Asker C.

In accordance with a further embodiment of the present invention, an article of footwear is provided. The article of footwear comprises an outsole and an upper attached to the outsole. The upper includes an outer material defining a cavity for receiving a wearer's foot and a collar region for insertion of the wearer's foot into the cavity. The article of footwear also comprises a plurality of chimneys arranged in a row along an interior side of the outer material for moving heat or moisture from within the cavity to outside the article of footwear.

In one alternative, the article of footwear further comprises a plurality of elongated vents formed by overlapping sections of the outer material. The plurality of elongated vents intersect with the plurality of chimneys to promote movement of the heat or moisture from within the cavity to outside the article of footwear. In this case, at least one of plurality of the elongated vents preferably intersects the row of chimneys at an angle between 15° and 75°, whereby venting of the heat and moisture is enhanced. In another example, the article of footwear further includes a footbed having a porous chassis operable to permit airflow from underneath the wearer's foot into the row of chimneys.

In accordance with yet another embodiment of the present invention, an article of footwear is provided. The article of footwear comprises an outsole and an upper attached to the outsole. The upper defines a cavity for receiving a wearer's foot and includes a tongue. The article of footwear also includes a chimney structure comprising means for moving heat or moisture from within the cavity to outside the article of footwear. Desirably, moving the heat or moisture occurs by convection. Preferably the chimney structure is disposed along the tongue.

The tongue chimney structure desirably comprises a chimney having a pair of sidewalls and an endwall connecting the sidewalls. Here, the chimney may have a first opening at a toe region of the upper and a second opening along an upper portion of the tongue, whereby heat and moisture are vented out from the toe region. Alternatively, the chimney mayhave a first opening at an instep region of the upper and a second opening along an upper portion of the tongue, whereby heat and moisture are vented out from the instep region.

The tongue chimney structure preferably comprises a row of chimneys. Alternatively, the chimney structure comprises two rows of chimneys adjacent to one another. In this case, a first one of the rows faces the cavity and a second one of the rows faces away from the cavity. Here, at least some of the chimneys of the first row preferably share a common wall with corresponding chimneys of the second row. Preferably, the common wall includes at least one opening therein to enable the heat and/or moisture to pass from one of the chimneys in the first row to one of the chimneys in the second row. In another alternative, the chimney structure is removably insertable in the tongue.

In accordance with yet another embodiment of the present invention, an article of footwear is provided. The article of footwear comprises an outsole, an upper and a chimney. The upper is attached to the outsole and defines a cavity for receiving a wearer's foot and including a tongue. The chimney is disposed in the tongue to enable movement of heat and moisture from within the cavity to outside the article of footwear.

In one example, the chimney has a substantially semicircular cross-sectional shape. In another example, the chimney has a substantially rectangular cross-sectional shape. In a further example, the chimney comprises a flexible material, whereby the chimney flexes in response to movement by a wearer. In yet another example, the movement of the heat or moisture occurs by convection.

In accordance with another embodiment of the present invention, a chimney structure for ventilating the microclimate of article of footwear is provided. The article of footwear includes a tongue. The chimney structure comprises a chimney disposed in the tongue to move heat or moisture from within an interior region of the article of footwear to outside the article of footwear. The chimney includes a pair of sidewalls and an endwall disposed between the pair of sidewalls. The sidewalls and the endwall define a pathway therealong. The heat or moisture is moved through the pathway from the interior region to outside the article of footwear.

In one alternative, the chimney structure further comprises a wicking material covering at least a portion of the chimney. The wicking material draws the moisture away from the wearer's skin. In this alternative, the chimney structure desirably further comprises a waterproof membrane. The wicking material covers an interior surface of the chimney facing the interior region of the article of footwear and the waterproof membrane covers an exterior surface of the chimney. Here, the waterproof member may include one or more openings to promote venting of the heat or moisture out of the pathway.

In another alternative, the chimney structure further comprises a covering substantially enclosing the chimney. The covering includes a pocket for storing laces of the article of footwear. In yet another alternative, the chimney structure further comprises a cushioning material disposed at a top region of the chimney structure facing the interior region of the article of footwear.

In accordance with another embodiment of the present invention, a form fitting foot covering is provided. The foot covering includes a heel region, a toe region, and a sole region disposed between the heel region and the toe region. It also includes a collar region providing an opening for insertion of a wearer's foot into the heel, toe and sole regions of the foot covering, as well as a chimney structure comprising a chimney for moving heat or moisture from within the foot covering out of the collar.

In an alternative, the chimney structure comprises a plurality of chimneys. Each of the chimneys includes a pair of elongated supports and braces connecting the pair of elongated supports. In this case, the foot covering preferably further comprises a covering disposed on a first side of the pair of elongated supports. Here, the covering desirably includes a pair of coverings. The first covering is disposed on the first side of the pair of elongated supports and the second covering is disposed on a second side of the pair of elongated supports opposite the first side. optionally, the first covering is positioned for direct contact with the wearer's foot and comprises a wicking material.

In another alternative, each of the chimneys is flexible and the braces are movable from an at-rest position to a stretched position or a compressed position as the foot moves. In this case, the braces are preferably positioned in the at-rest position at a predetermined angle relative to the elongated supports. Desirably the predetermined angle is at least 15 degrees. In a further alternative, moving the heat or moisture occurs by convection.

In accordance with yet another embodiment of the present invention, a foot covering adapted for covering a wearer's foot comprises a body, a collar, a plurality of chimneys and a skirt section. The body has a heel region, a toe region, and a sole region disposed between the heel region and the toe region. The collar region is connected to the body for insertion of a wearer's foot into body. The plurality of chimneys provide movement of heat or moisture from within the body out of the collar. The skirt section is formed at the connection of the body and the collar. The skirt section is adapted to prevent debris from entering a shoe when the foot covering is positioned therein.

In an example, the skirt section is positioned at ankle height. In another example, the skirt section includes a pocket to receive the laces of the shoe. In this case, the pocket may comprise a stretchable material.

In an alternative, the chimneys each include a first opening in the body and a second opening in the collar region, whereby heat or moisture enter the chimneys at the first opening and exit at the second opening. In one example, at least some of the first openings are disposed in the toe region. In another example, at least some of the first openings are disposed in the heel region. In a further example, at least some of the first openings are disposed in the sole region. Optionally, the plurality of chimneys comprises a chimney structure that at least partly surrounds the toes of the foot during wear.

In accordance with another embodiment of the present invention, a ventilated article of clothing is provided. The ventilated article of clothing comprises a covering for enclosing a portion of a wearer's body, and a chimney structure. The chimney structure includes a plurality of chimneys that vent heat or moisture by convection from a first region within the covering to a second region outside of the covering. In one example, the article of clothing comprises a sock. In another example, the article of clothing comprises a glove.

DETAILED DESCRIPTION

Figure 1A:
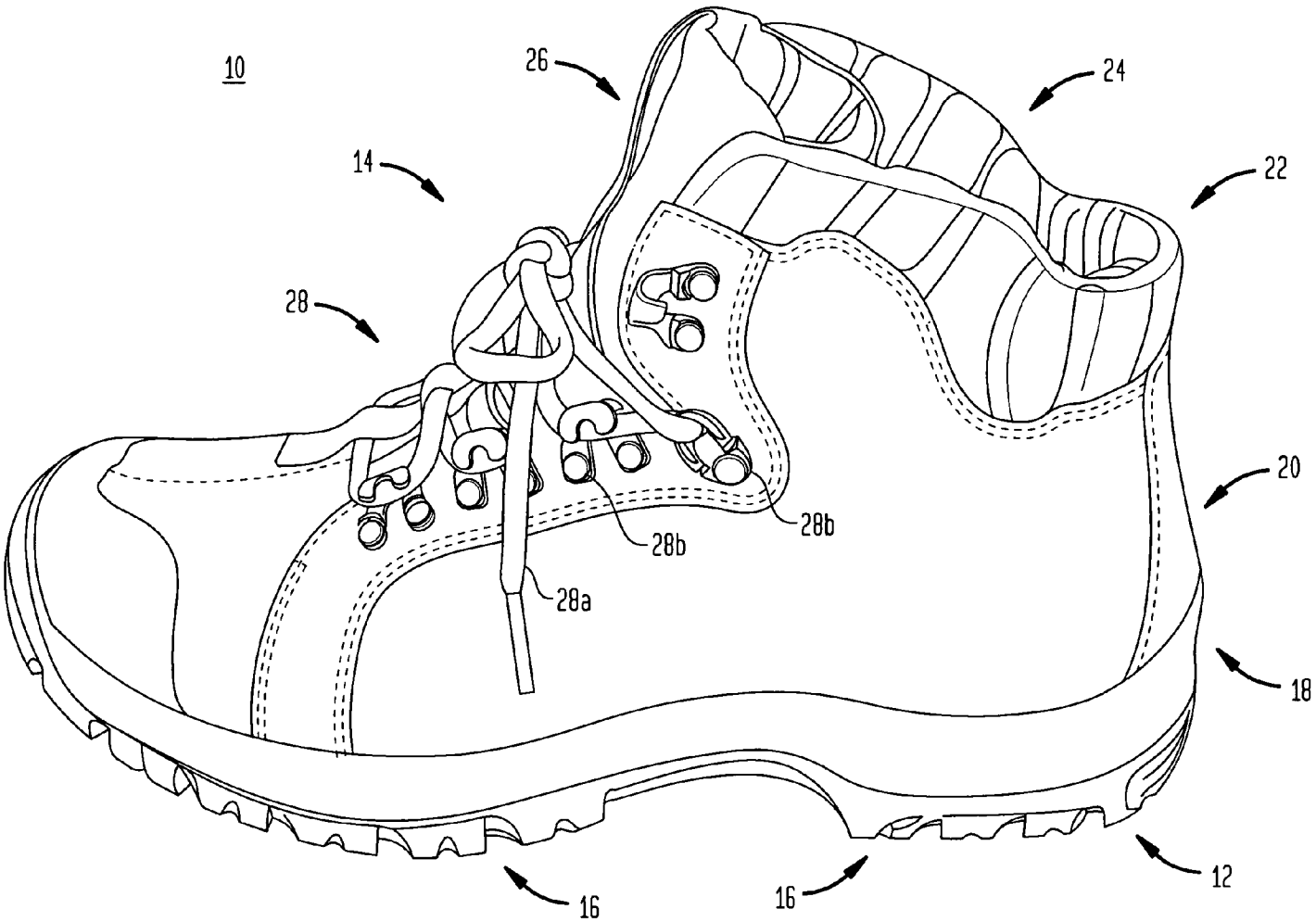
FIGS. 1(*a*)-(*b*) illustrate an exemplary shoe in accordance with aspects of the present invention.

In describing the preferred embodiments of the invention illustrated in the appended drawings, specific terminology will be used for the sake of clarity. However, the invention is not intended to be limited to the specific terms used, and it is to be understood that each specific term includes equivalents that operate in a similar manner to accomplish a similar purpose. By way of example only, the term "footwear" is used herein to include, without limitation, all manner of foot coverings such as boots, shoes, sandals, athletic sneakers, loafers etc.

Both experience and research illustrate the need to preferentially handle heat and moisture removal from footwear. The inventors of the present invention conducted live trials using volunteer subjects to evaluate how airflow in the shoe microclimate affects heat and moisture retention, and, ultimately, shoe comfort. A first testing phase focused on climate control and moisture management within a hiking shoe structure. Human subjects were asked to evaluate four different hiking shoes having different upper constructions.

The first hiking shoe included an all mesh upper designed for maximum breathability. The second hiking shoe included a mesh upper with a waterproof membrane capable of venting moisture designed for average breathability. The third hiking shoe was a conventional off-the-shelf hiking shoe including an integral waterproof membrane capable of venting moisture designed for average breathability. The fourth hiking shoe included a mesh upper having a polyurethane ("PU") lining designed for minimum breathability. Table 1 provided below compares the four shoe structures.

TABLE 1

| Shoe Number | Shoe Type | Designed Breathability |
|---|---|---|
| 1 | All mesh upper | Maximum breathability |
| 2 | Mesh upper with waterproof/ venting lining | Average breathability |
| 3 | Conventional hiking shoe with waterproof/venting lining | Average breathability |
| 4 | Mesh upper with PU lining | Minimum breathability |

Ten subjects tested each of the four shoes. For each test, the subject wore a pair of thin socks having the composition 42% cotton, 14.5% spandex, 21.5% nylon, and 22% polyester. Each test included a warm-up period, a test period, and a cool down period. During the warm-up period the subject wore his or her own shoes. After warm-up, the subject walked on a treadmill for a period of 15 minutes at a speed of 4 mph. Shoe weight and sock weight were recorded before and after the 15 minute walking period. At the conclusion of the test the subject stepped off of the treadmill and was allowed a five minute cool down period. Each subject wore a fresh pair of socks for each shoe tested.

During the 15 minute walking period the temperature of the foot was monitored with a thermocouple mounted in the location of the in-step. While walking, the subjects were asked a series of questions pertaining to the microclimate of the shoes being worn. Subjects answered the questions by evaluating aspects of the microclimate on a scale of one through three, including temperature and humidity. A description of this rating scale can be found in Table 2.

TABLE 2

| Rating | Temperature Definition | Humidity Definition |
|---|---|---|
| 1 | Colder than Body Temperature | Dry |
| 2 | Same as Body Temperature | Clammy |
| 3 | Hotter than Body Temperature | Soaked |

Immediately after stepping off the treadmill, the left shoe was removed and internal shoe temperature and humidity measurements were taken. Shoe and sock weights were also measured (in grams) and recorded. The test results are in Table 3.

TABLE 3

| | Human Trial Testing | | | | | |
|---|---|---|---|---|---|---|
| Shoe | Subjective Rating (Scale: 1-3) | | Mean Foot Temp @ 15 min. | ΔT | Sock Weight | Shoe Weight Gain Including |
| Number | Temp | Humidity | (° C.) | (° C.) | Gain (g) | Footbed (g) |
| 1 | 1.45 | 1.29 | 35.3 | 1.4 | 0.64 | 0.43 |
| 2 | 2.29 | 1.73 | 36 | 2.1 | 1.32 | 0.43 |
| 3 | 2.56 | 2.07 | 36.6 | 3.1 | 2.11 | 1.11 |
| 4 | 2.35 | 1.90 | 36.6 | 2.6 | 1.86 | 0.96 |

The test results presented in Table 3 demonstrate the wearers' perception of comfort as it relates to moisture retention around the foot. Wearers perceived the all mesh upper of shoe one as being the coolest and driest after the test. The production shoe was perceived as being the hottest and most damp shoe after the test. The column entitled "ΔT" pertains to the increase in temperature during the trial and supports the wearers' assessments as to heat retention by the shoes. The time in the ΔT column runs from when the wearer initially placed his or her foot in the shoe to the end of the test after the cool down period. Here, the smallest temperature increase occurred in the all mesh upper, and the largest temperature increase occurred in the production shoe. The columns entitled "Sock Weight Gain" and "Shoe Weight Gain Including Footbed" provide statistical data confirming the wearers' assessments as to how much moisture was retained within the sock and the shoe. The all mesh upper caused the least amount of moisture to be retained in the sock and in the shoe itself. The production shoe caused the most moisture to be retained in the sock and in the shoe.

Table 4 illustrates a ranking of the four shoe structures based upon the subjective ratings by the test subjects. The rankings ranged from 1 to 4, with 1 being the best performance among all of the shoes and 4 being the poorest performance among all of the shoes.

TABLE 4

| Shoe # | Subjective Rankings: Human Trial Testing | | | | | |
|---|---|---|---|---|---|---|
| | Temp Cool to Hot | Humidity Dry to Wet | Mean Foot Temp @ 15 min. Cool to Hot | ΔT Low to High | Sock Gain Low to High | Shoe Gain w/ Footbed Low to High |
| 1 | 1 | 1 | 1 | 1 | 1 | 1 |
| 2 | 2 | 2 | 2 | 2 | 2 | 1 |
| 3 | 4 | 4 | 3 | 4 | 4 | 4 |
| 4 | 3 | 3 | 3 | 3 | 3 | 3 |

As seen by the results of Table 4, the all mesh upper of the first shoe had the highest performance ranking among all of the shoes in all of the categories, whereas the conventional production shoe had the worst, or a tie for the worst, ranking in each category. As seen in the mean foot temperature column, the mesh upper with the PU lining was ranked the same as the production shoe.

The inventors of the present invention also conducted laboratory tests separate from the human trials to evaluate how airflow in the shoe microclimate affects heat and moisture retention. The same four shoe structures used in the human trials were tested in the laboratory. Testing was conducted using standards developed by the SATRA Technology Centre.

Specifically, advanced moisture management testing using the SATRA Advanced Moisture Management ("AMM") test was conducted using the four hiking shoe structures discussed above. Testing simulated the generation of heat and sweat by the foot in a shoe, quantifying the distribution of sweat output by absorption, evaporation loss, and energy usage, as will be explained below.

Testing was conducted under laboratory conditions of 20° C. and 65% relative humidity. A simulated foot was used to conduct the test. The simulated foot was covered in a simulated skin membrane. A sock was then placed on foot and inserted into one of the four test shoe structures. The sock had the same composition as in the human trials. The simulated foot was maintained at a temperature of 34° C. with a nominal sweat rate of 5 mL/hr.

The sweat rate was controlled in a closed loop such that the only means of egress was into the footwear being tested. A constant airspeed of 2 m/s was maintained across the shoe during the test. The mass of water input to the system in each test was approximately 13.5 g±0.3 g. Once the system was brought to equilibrium, the test lasted for a period of 180 minutes. The results of the test indicated the amount of moisture retained in the simulated skin, the sock, the footbed, and the shoe itself, as well as the evaporated mass of water and the amount of energy required to maintain the foot at 34° C. A low thermal energy input value would indicate a high degree of thermal insulation within the shoe. The laboratory test results are shown in Table 5.

TABLE 5

| Shoe # | Laboratory Testing With AMM Test | | | | | |
|---|---|---|---|---|---|---|
| | Skin Gain (g) | Sock Gain (g) | Shoe Weight Gain w/ Footbed (g) | Footbed Gain Only (g) | Evaporated Loss (g) | Thermal Energy Input (kJ) |
| 1 | 0.39 | 1.75 | 1.95 | 1.28 | 10.91 | 83.8 |
| 2 | 0.46 | 2.82 | 3.33 | 1.79 | 8.39 | 67.4 |
| 3 | 0.64 | 4.75 | 6.46 | 1.74 | 3.15 | 48.4 |
| 4 | 0.51 | 5.00 | 5.43 | 1.80 | 4.06 | 61.9 |

As seen by the results in Table 5, the all mesh upper of the first shoe had the least amount of moisture gain in the simulated skin membrane of the foot, in the sock, in the footbed by itself, and in the shoe including the footbed. The shoe with the all mesh upper also had a much greater amount of evaporative moisture loss than any of the other shoes tested. The evaporation results correlate with the data for thermal energy input as shown in the rightmost column. Here, the all mesh upper required the most amount of input energy to maintain the simulated foot at a temperature of 34° C.

Table 6 illustrates a ranking of the four shoe structures based upon the objective test results from the laboratory experiments. As with the rankings of Table 4, the rankings in Table 6 range from 1 to 4, with 1 being the best performance among all of the shoes and 4 being the poorest performance among all of the shoes.

TABLE 6

| Shoe # | Objective Rankings: Laboratory Testing With AMM Test | | | | | |
|---|---|---|---|---|---|---|
| | Skin Gain Low to High | Sock Gain Low to High | Shoe Weight Gain w/ Footbed Low to High | Footbed Gain Only Low to High | Evaporated Loss High to Low | Thermal Energy Input High to Low |
| 1 | 1 | 1 | 1 | 1 | 1 | 1 |
| 2 | 2 | 2 | 2 | 3 | 2 | 2 |
| 3 | 4 | 3 | 4 | 2 | 4 | 4 |
| 4 | 3 | 4 | 3 | 4 | 3 | 3 |

As seen by the results of Table 6, the all mesh upper of the first shoe had the highest performance ranking among all of the shoes in all of the categories, whereas the conventional production shoe had the worst ranking in most of the categories. While the production shoe had the second best ranking in the column labeled "Footbed Gain Only," it ranked the lowest in four of the six total categories.

At the conclusion of the laboratory AMM testing, the laboratory results were compared with those obtained from the human trials to look for correlation. The assumption is that a high degree of correlation between the human and laboratory tests allows for the assessment of the moisture management properties of subsequent footwear designs using laboratory tests only, without the need for conducting many expensive and time consuming human trials.

The laboratory tests and human trials were compared for two criteria, moisture and heat. In a first comparison with regard to moisture, the average subjective humidity ratings in the human trials were compared to the average evaporated loss in the laboratory tests. In a second comparison with regard to heat, the average subjective temperature ratings in the human trials were compared to the average energy used in the laboratory tests.

The data were compared using a regression analysis technique involving the coefficient of determination ("$R^2$"), which is a well known and often used statistical analysis tool. The coefficient of determination is a measure of the correlation between the two variables in the regression analysis. Here, the variables were either the average subjective humidity as compared to the averaged evaporated loss, or the average subjective temperature as compared to the average energy used. The $R^2$ value ranges between 0 and 1. A 0 value indicates no correlation, and a 1 value indicates strong correlation. The $R^2$ value in the moisture comparison was 0.9077. The $R^2$ value in the heat comparison was 0.8899. Thus, it can be seen that the human and laboratory test results are highly correlated.

The analysis also involved a statistical examination as to the interdependence of the variables from the human and laboratory tests. This involved calculating a correlation coefficient ("r"), which is expresses as $r=\sqrt{R^2}$. The correlation coefficient may range from −1 to 1. As with the coefficient of determination, it is desirable for the correlation coefficient to be as close to 1 as possible. The r value in the moisture comparison was 0.95. The r value in the heat comparison was 0.94. Thus, the correlation coefficients in both analyses confirm that the human and laboratory tests are highly correlated. Therefore, footwear that performs well in laboratory testing should be more than acceptable to actual wearers. In particular, footwear configurations that lower moisture absorption in the sock, in the shoe, and/or in the footbed or sockliner should have a perceptibly drier fee. Footwear configurations that have a higher thermal energy input should have a perceptibly cooler feel.

In addition to the human and laboratory testing discussed above, research demonstrates that the movement of air (airflow), as exemplified by convection, enhances the evaporation transfer of heat by the movement of air from a hot region to a cool region. By creating an environment around the foot that allows for airflow, such as by convective transport, of heat or moisture away from the skin and out of the shoe, the foot will be kept drier and more comfortable. Convection, or convective transport, is a passive process that does not require an active mechanical action. While the terms heat and moisture are referred to in the alternative, it should be understood that this also includes airflow of both heat and moisture together. Evaporation of moisture facilitates cooling, improves functional performance, and reduces the likelihood of a foot-related injury—especially those related directly to the skin such as abrasion, swelling, and blisters. Proper evaporation also reduces the chance of fungal and skin infections, and reduces malodorous conditions.

In accordance with aspects of the present invention, channel or chimney devices, hereinafter referred to as "chimneys," can be employed with articles of footwear including shoes, foot coverings such as socks, etc., to provide cooling and to remove moisture away from the foot.

Figure 1B:
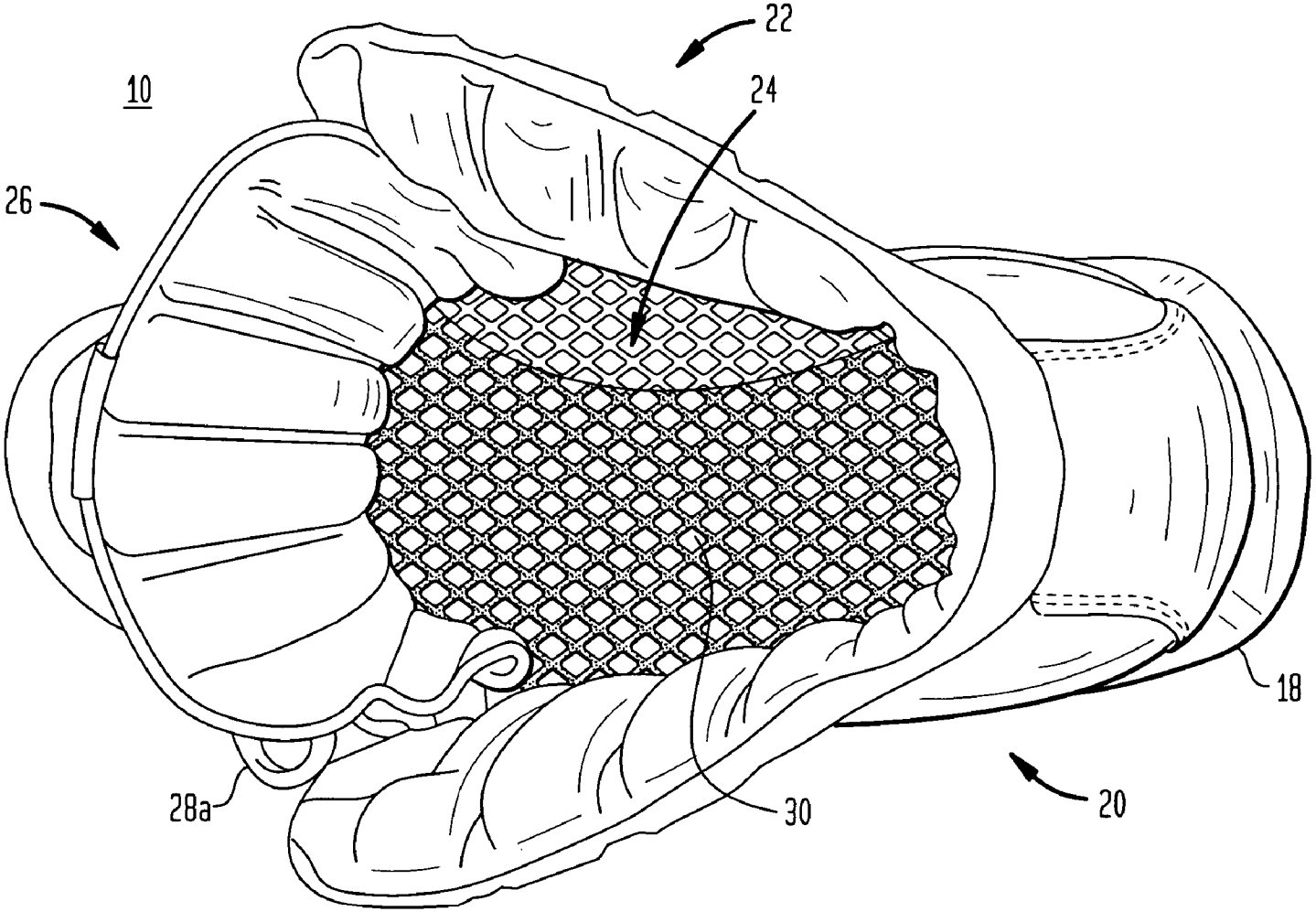
Figure 2A:
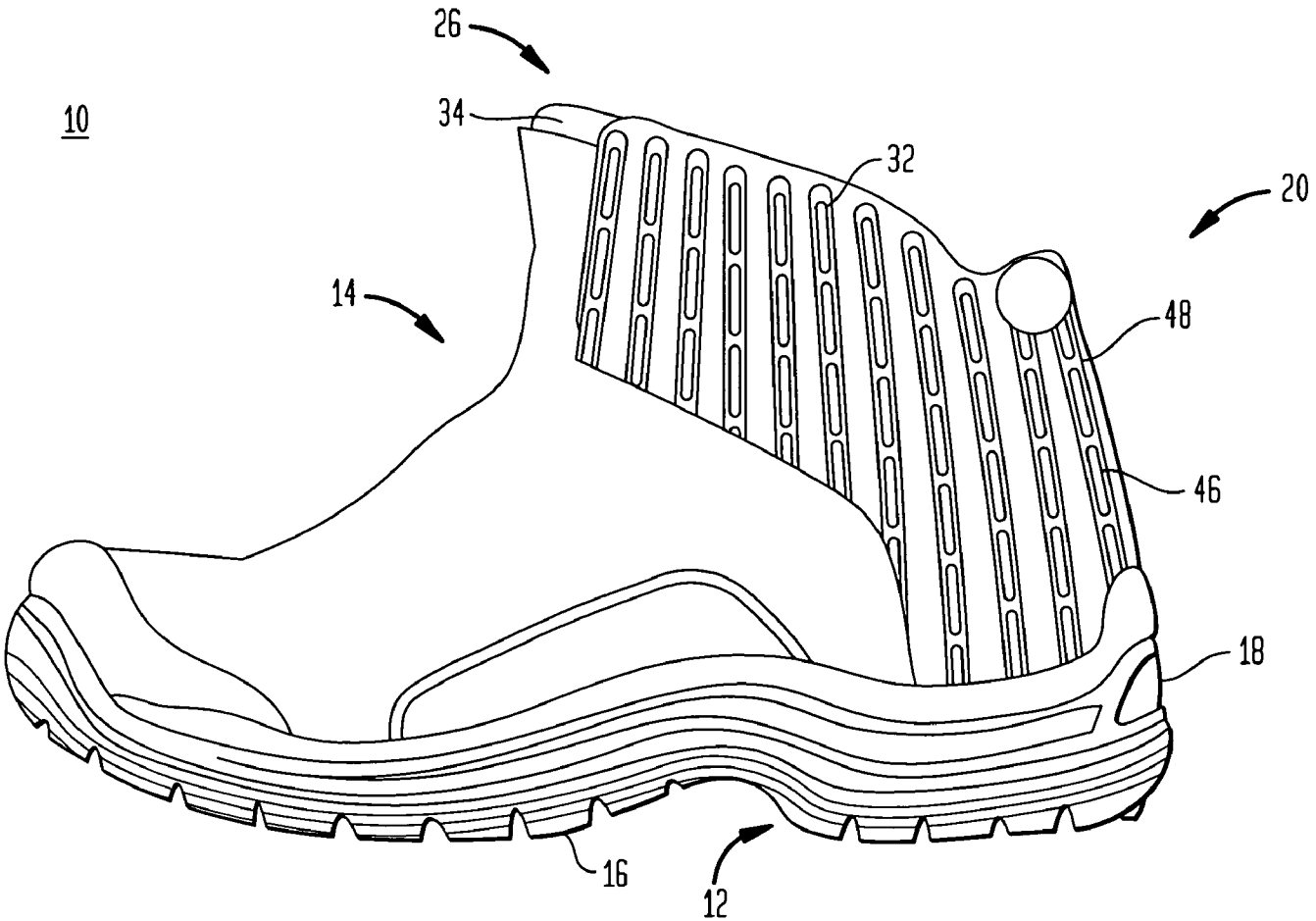
FIGS. 2(*a*)-(*h*) illustrate chimney structures in accordance with aspects of the present invention.
Figure 2B:
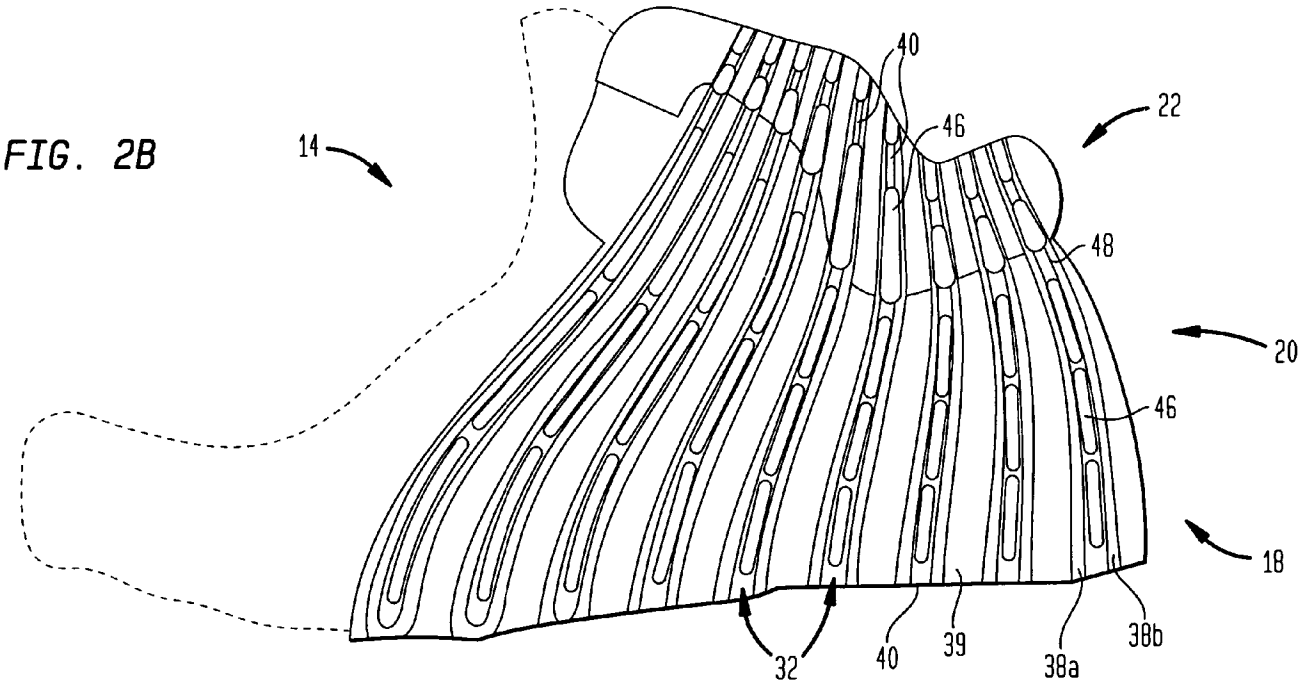
Figure 2C:
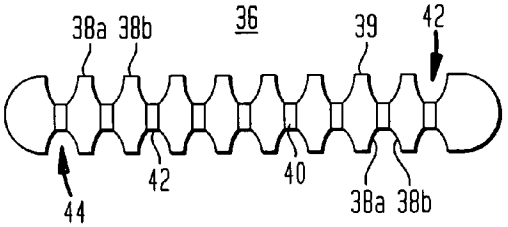
Figures 2D, 2E:
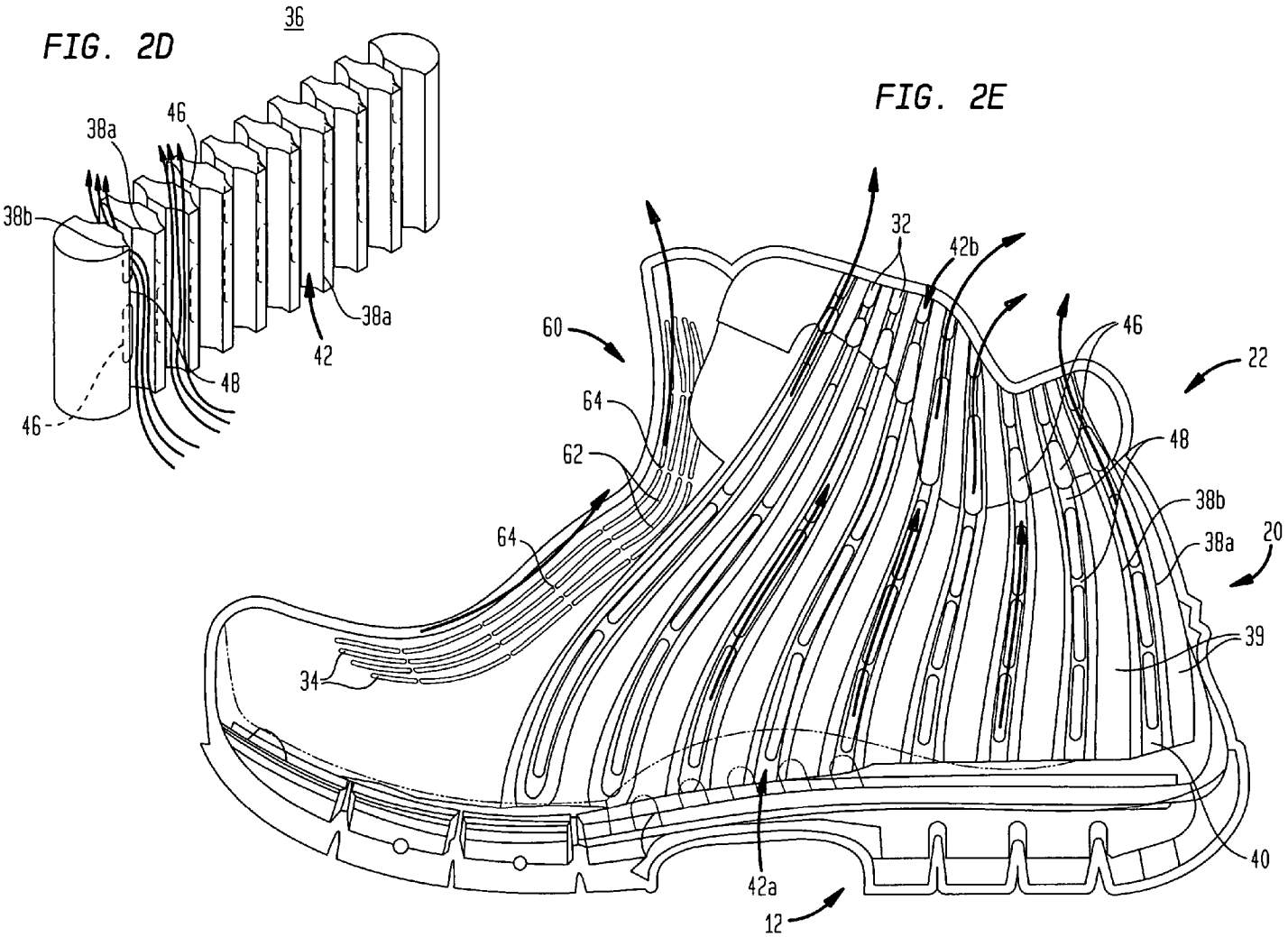
Figure 2F:
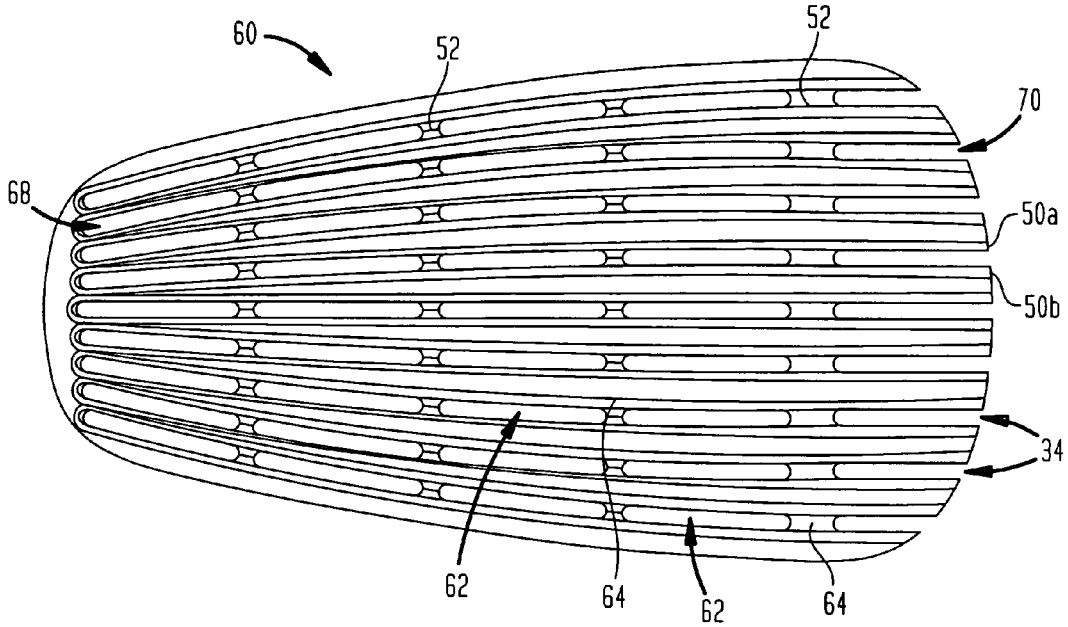
Figure 2H:
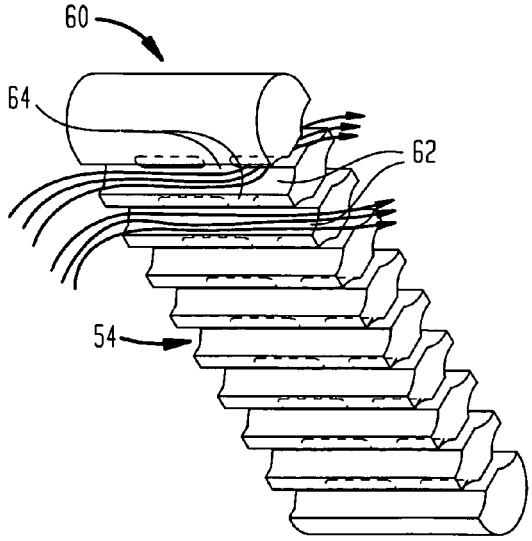
Figure 2G:
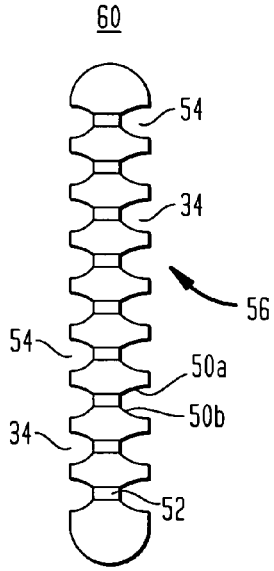
Figure 3A:
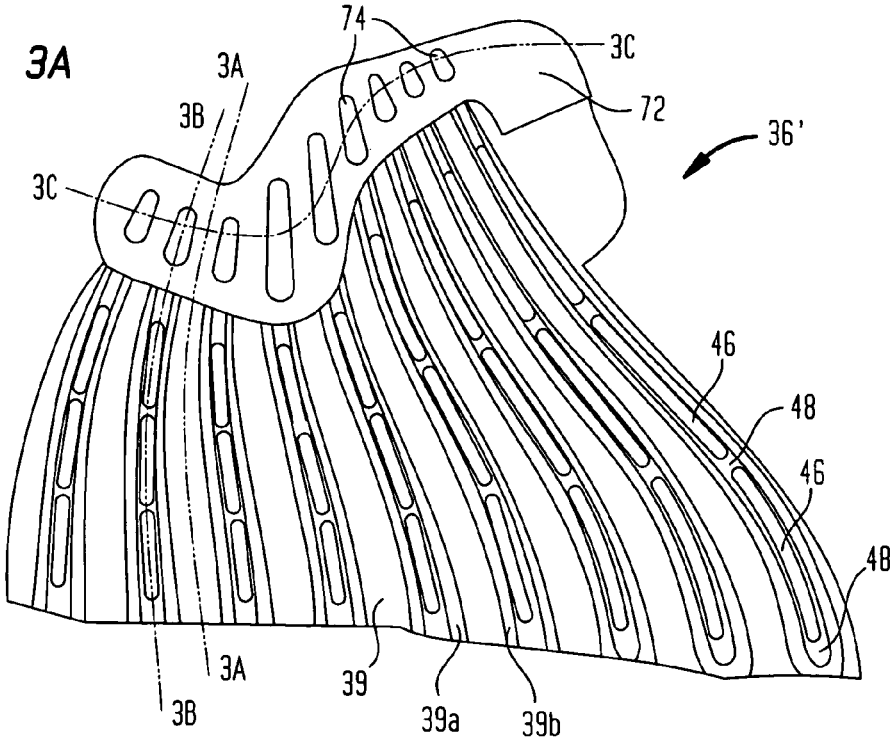
FIGS. 3(*a*)-(*d*) illustrate alternative chimney structures in accordance with aspects of the present invention.
Figure 3B:
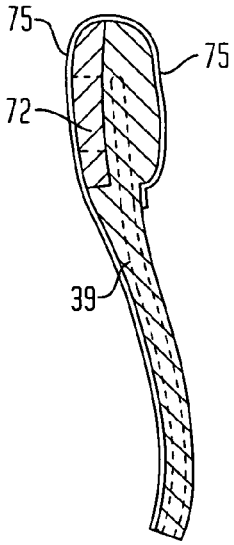
Figure 3C:
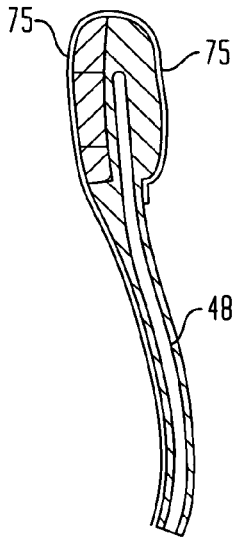
Figure 3D:
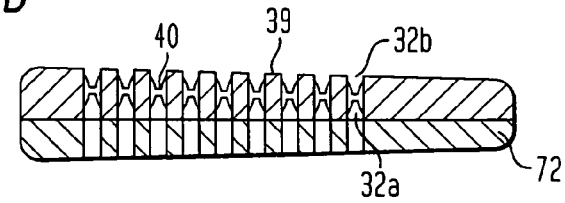
Figures 4A, 4B, 4C, 4D:
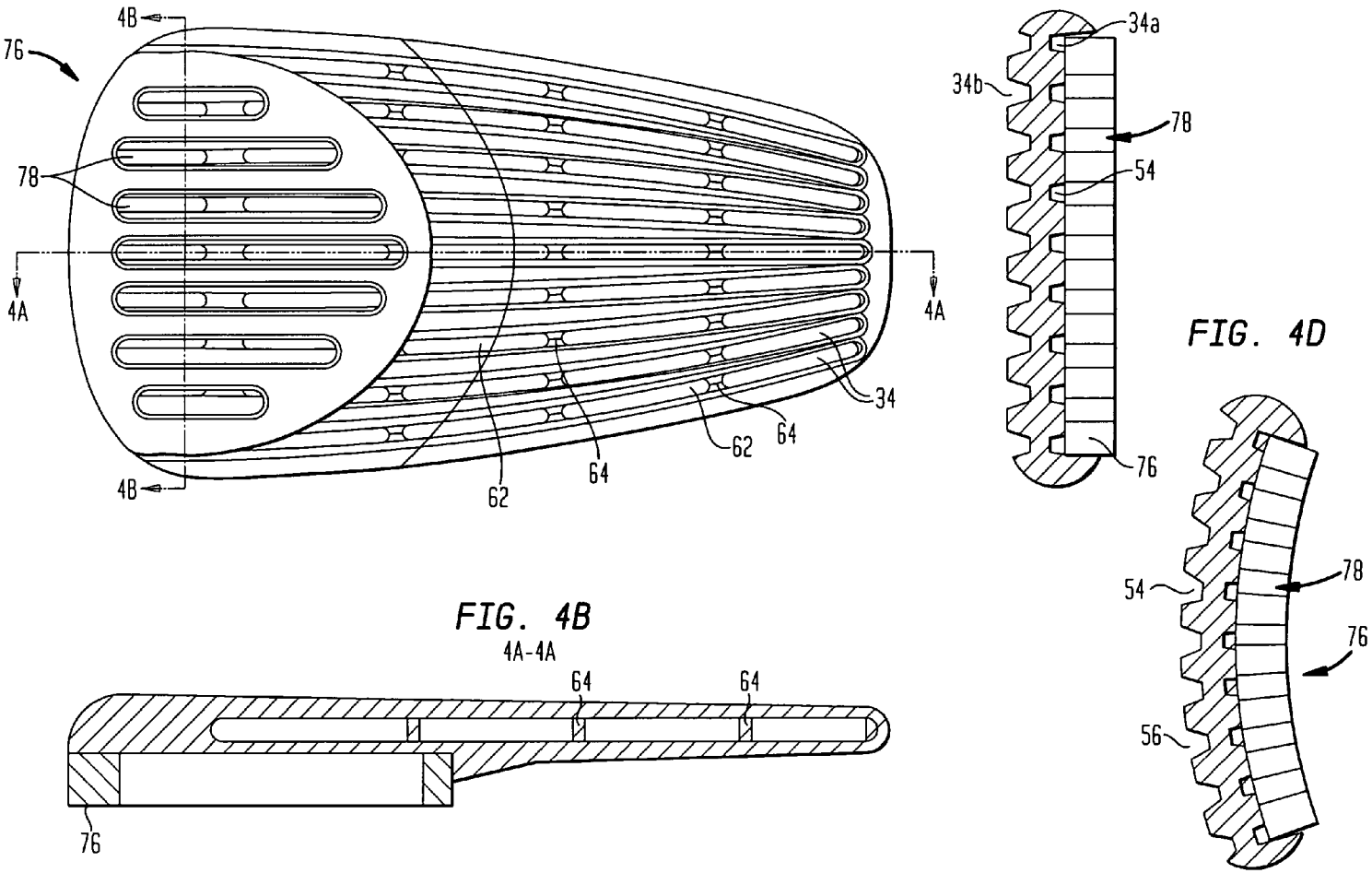
FIGS. 4(*a*)-(*g*) illustrate additional chimney structures in accordance with aspects of the present invention.
Figure 4E:
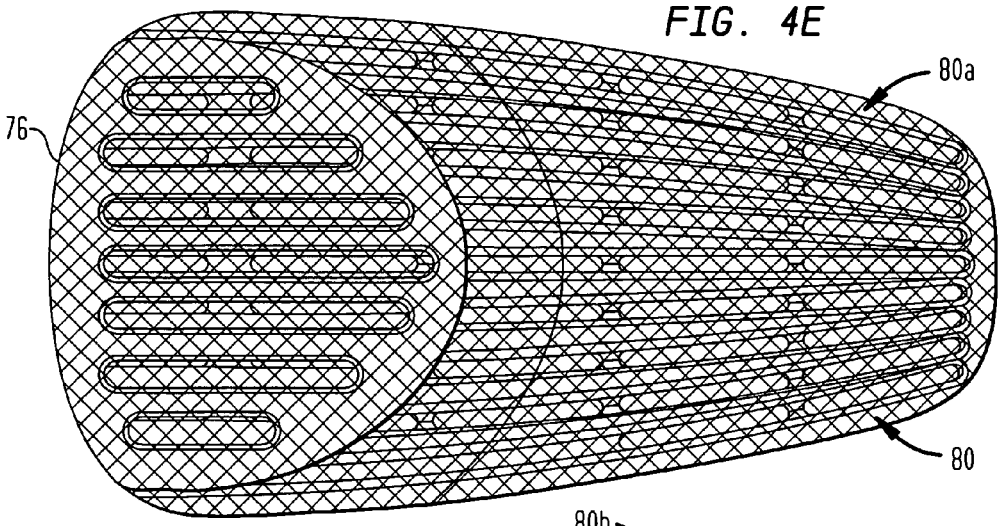
Figure 4F:
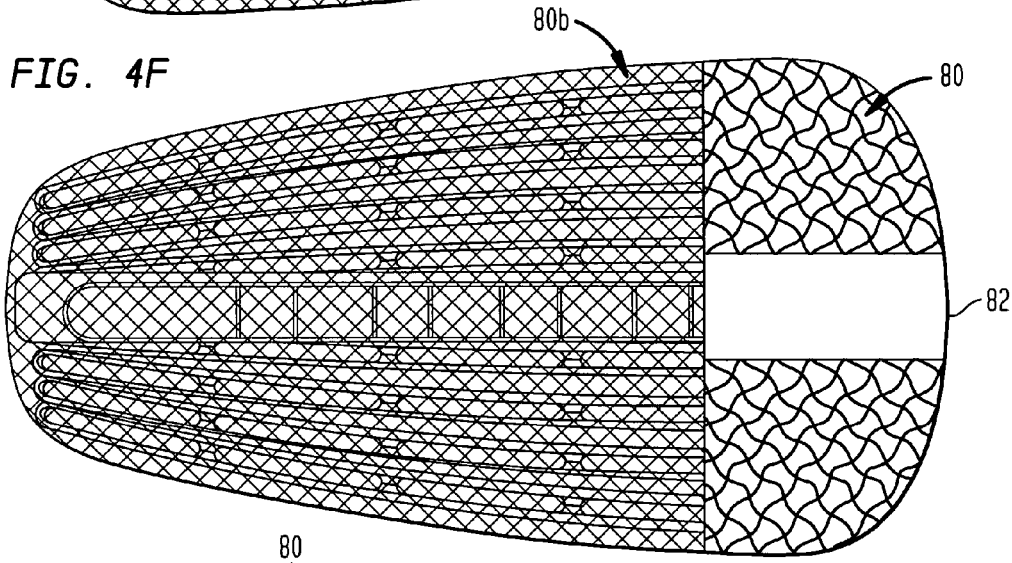
Figure 4G:
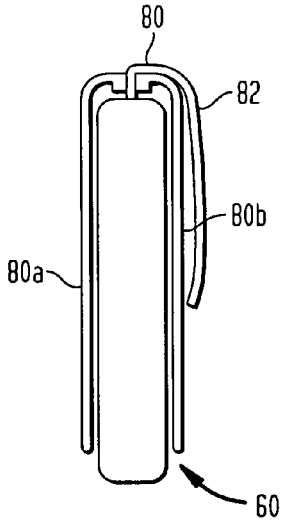
Figure 5A:
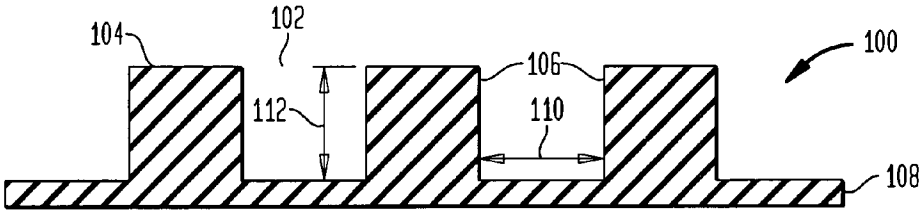
FIGS. 5(*a*)-(*e*) illustrate further chimney structures in accordance with aspects of the present invention.
Figure 5B:
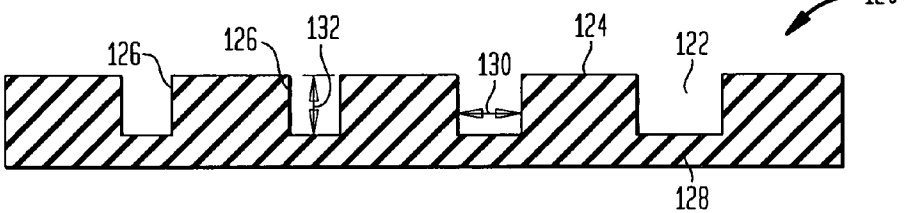
Figure 5C:
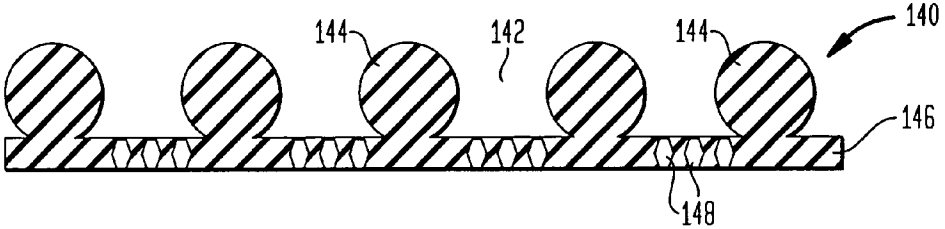
Figure 5D:
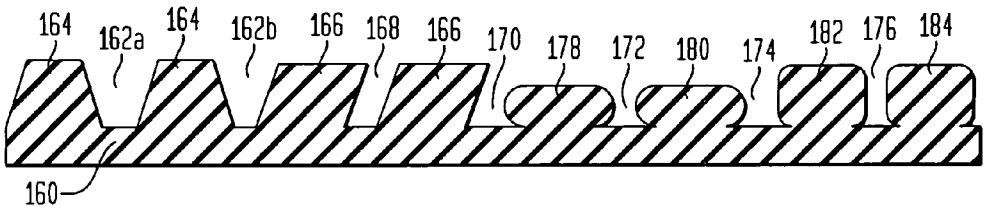
Figure 5E:
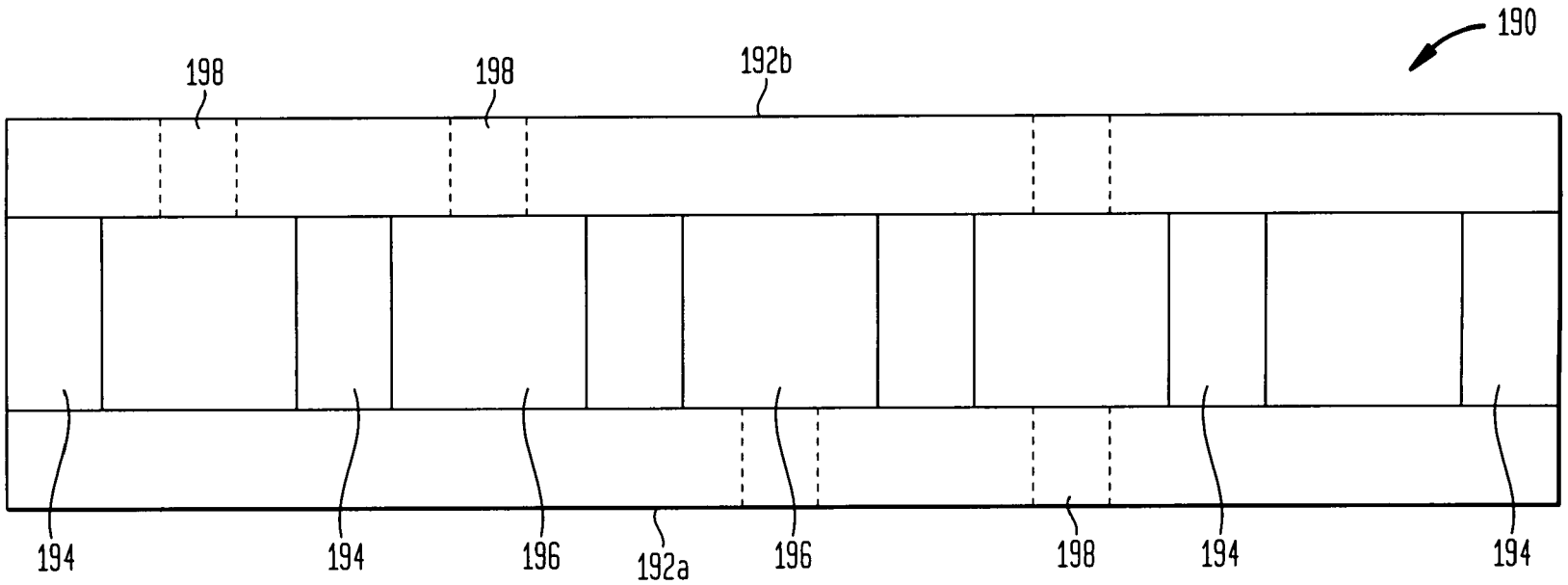

FIGS. 1(*a*)-(*b*) illustrate an exemplary shoe 10 suitable for use with chimneys and other ventilation structures in accordance with the present invention. The shoe 10 may be any type of conventional or specialty footwear, including, but not limited to dress shoes, loafers, athletic shoes such as sneakers, work boots, hiking boots, etc. Here, the exemplary shoe is shown having an outsole 12 and an upper 14. The outsole 12 may include a tread 16 on the bottom thereof. As shown, a region 18 connects the outsole 12 to the upper 14. The region 18 may be integral with the outsole 12, or may comprise a separate midsole, a lasting board, etc. Alternatively, the outsole 12 and the upper 14 may be integrally formed as a single piece. Additional features such as a shank piece, arch support, etc. (not shown), may be fixed as part of the shoe 10 or may be removable therefrom.

The upper 14 may include a body 20 as well as a collar or collar region 22, which defines an opening that enables a wearer to insert his or her foot into an interior cavity 24 of the body 20. The body includes sidewalls or side panels of the upper, which may be formed from multiple pieces or as an integral unit. The sidewalls/side panels may also include a heel region. The upper 14 may have a tongue 26, which may be part of the body 20 and which may be attached, at least in part, to the collar or collar region 22. The body 20 may also include fasteners 28, such as laces 28*a*, eyelets 28*b*, and/or other structures such as hook and loop fastening straps, snaps, clips, etc. to adjustably and comfortably secure the foot within the shoe 10.

As seen in the top view of FIG. 1(*b*), the shoe 10 may also include a footbed 30 that is configured to receive the wearer's foot within the interior cavity 24. Any type of footbed 30 may be used in accordance with the present invention, including custom orthotics, sockliners, etc.; although specially constructed footbeds as discussed herein may also be employed. The footbed 30 may be formed from resilient materials such as ethyl vinyl acetate ("EVA") and polyurethane PU foams or other such materials commonly used in shoe midsoles, insoles or sockliners. The footbed 30 may be fabricated using multiple material layers, regions and/or segments, which may each have a different thickness and/or a different rigidity. For example, the footbed 30 may comprise multiple layers of different rigidity. Alternatively, the footbed 30 may have different levels of rigidity in the forefoot, instep and heel regions, respectively. The footbed 30 could also have a first segment about the first metatarsal of a first rigidity and a second segment about the fifth metatarsal of a second rigidity. In all cases, footbed rigidity can be adapted to footwear function.

FIG. 2(*a*) illustrates a partial cutaway view of the shoe 10, revealing chimneys 32 disposed along the sides of the body 20 and chimneys 34 disposed in the tongue 26. As will be discussed below, FIGS. 2(*b*)-2(*g*) illustrate the chimneys 32 and 34 in more detail. FIG. 2(*b*) illustrates an example of a body chimney structure 36 including multiple body chimneys 32 with portions of the upper 14 shown in outline form for the sake of clarity. As shown here, nine body chimneys 32 may be arranged in the chimney structure 36 along a side of the body 20. However, any number of body chimneys 32 may be used, including a single chimney. The specific number utilized, such as 2, 5, 10, 20, etc., may vary depending upon the type of footwear, the sizing of the footwear, and the chimney dimensions, which will be discussed in more detail below.

FIG. 2(*c*) illustrates a top view of a preferred body chimney structure 36, which includes a number of the body chimneys 32 in a set. As seen in this figure, each individual body chimney 32 preferably includes first and second sidewalls 38*a,b* connected by a central portion 40 in a substantially semicircular arrangement. The sidewalls 38*a,b* may be curved or arced to achieve the semicircular configuration, although any other geometrical configuration is possible. Adjacent body chimneys 32 are connected by a wall 39. The sidewalls 38*a,b* and the wall 39 may comprise a single integral structure or multiple components fastened together. The substantially semicircular arrangement defines a pathway 42 having an opening 44 opposite the central portion 40. As shown in FIG. 2(*c*), the chimney structure 36 may include two rows of body chimneys 32 that share a common central portion 40, although a single row of body chimneys 32 can also be used.

FIG. 2(*d*) illustrates a perspective view of a segment of the chimney structure 36. As shown in this figure, the central portion 40 preferably includes one or more openings 46 and one or more braces 48 therebetween. While not required, the openings 46, if used, act as passageways between the opposing rows of body chimneys 32. As seen by the arrows in FIGS. 2(*d*) and 2(*e*), the pathways 42 promote convective venting of heat and/or moisture upward away from the bottom of the shoe near the outsole 12, midsole 18, and/or the footbed 30 and toward the collar 22. The openings 46 permit heat and/or moisture to move between pairs of the body chimneys 32. Specifically, hot and/or moist air may migrate from the interior row of body chimneys 32 out to the exterior row of body chimneys 32 via the openings 46.

As best seen in FIGS. 2(*b*) and 2(*e*), the body chimneys 32 in this example are preferably positioned generally vertically along the body 20 and the collar 22 of the upper 14. Such a configuration promotes efficient migration of heat and/or moisture up from lower regions of the shoe 10. However, the pathways 42 may be arched, angled, curved, s-shaped, etc (see FIGS. 14(*a*)-(*e*)). Regardless of specific pathway alignment, the body chimneys 32 are desirably positioned so that some or all of the pathways 42 have a first end 42*a* disposed along the upper 14 below the collar 22 and a second end 42*b* at or near the top of the collar 22 to evacuate heat and/or moisture out of the microclimate of the shoe 10. The first end 42*a* is preferably positioned at or near the foot, more preferably at or below the ankle. While the ankle height differs for different people, the typical ankle height for an adult male is, for instance, less than about seven inches when measured relative the bottom or sole of the foot. Desirably, the first end 42*a* is placed as close to the footbed or the bottom/sole of the foot as possible. By way of example only, the first end 42*a* may be placed 1-2 inches or less from the bottom of the foot. More preferably, the opening at the first end 42*a* is less than one inch from the bottom of the foot. The opening 42*a* of the first end should be positioned above the insole, if any. However, if a ventilating insole is used, the opening 42*a* may be placed at the height of the ventilating insole. It is important that the second end 42*b* or other portion(s) of the pathway 42 higher than the first end 42*a* be exposed to the external climate to promote effective heat/moisture evacuation.

FIGS. 2(*e*)-(*h*) illustrate a set of tongue chimneys 34 in more detail. The tongue chimneys 34 may include structures that are substantially equivalent to the body chimneys 32. For example, as seen on FIG. 2(*f*), the tongue chimneys 34 may include includes first and second sidewalls 50*a,b* connected by a central portion 52 in a substantially semicircular arrangement, although any other geometrical configuration is possible. The substantially semicircular arrangement defines a pathway 54 having an opening 56 opposite the central portion 52. The tongue chimneys 34 may be arranged as a connected set in a chimney structure 60. As shown, the chimney structure 60 may include two rows of tongue chimneys 34 that share a common central portion 52, although a single row can be used.

The central portion 52 of the tongue chimney 34 preferably includes one or more openings 62 and one or more braces 64 therebetween. While not required, the openings 62, if used, act as passageways between the opposing rows of tongue chimneys 34. As seen in FIGS. 2(*e*) and 2(*h*), the pathways 54 promote conduction of heat and/or moisture away from the bottom of the upper 14 near the toe and instep regions and toward the upper part of the tongue 26. The openings 62 permit the heat and/or moisture to move between pairs of the tongue chimneys 34. For instance, hot and/or moist air may migrate from the inner row of tongue chimneys 34 out to the exterior row of tongue chimneys 34 via the openings 62.

The tongue chimneys or tongue vents 34 are preferably positioned to promote efficient migration of heat and/or moisture upward away from the front/toe region of the shoe 10. The tongue chimneys 34 are desirably positioned so that each pathway 54 has a first end 68 disposed along the upper 14 in the front/toe region and a second end 70 at or near the top of the tongue 26 to evacuate heat and/or moisture out of the microclimate of the shoe 10. The first end 68 is preferably positioned at or near the toes or the front portion of the foot. It is important that the second end 70 or other portion(s) higher than the first end 68 of the pathway 54 be exposed to the external climate, for instance at or near the top of the tongue 14, to promote effective heat/moisture evacuation.

When a single row of one or more body chimneys or body vents 32 is employed, the opening 44 of each pathway 42 preferably faces inward towards the foot. Similarly, when a single row of one or more tongue chimneys 34 is employed, the opening 56 of each pathway 54 preferably faces inward towards the foot. When a second row of body and/or tongue chimneys 32, 34 is employed, the pathway openings 44, 56 help promote air exchange between the shoe microclimate and the external climate, as seen in FIGS. 2(*d*) and 2(*h*).

FIG. 3(*a*) illustrates an alternative body chimney structure 36'. Here, a material 72 is added to a top region of the body chimney structure 36'. The material 72 is preferably adhered or otherwise affixed to the body chimneys 32 as shown or integrally formed therewith. The material 72 desirably includes one or more openings 74, which align with the pathways 42 of the body chimneys 32. FIG. 3(*b*) is a cross-sectional view of the body chimney structure 36' along line 3A-3A, which is taken through the wall 39 between adjacent chimneys 32. FIG. 3(*c*) is a cross-sectional view of the body chimney structure 36' along line 3B-3B, which is taken through the pathway 42. As seen in these cross-sectional views, a liner 75 may cover at least part of the chimney structure 36'. Preferably, the liner 75 covers the side of the chimney structure 36' facing the interior of the shoe 10.

FIG. 3(*d*) is a cross-sectional view of the body chimney structure 36' along line 3C-3C. As seen in this figure, the body chimney structure 36' may include two rows of oppositely facing body chimneys 32*a* and 32*b*. The material 72 desirably faces the interior cavity 24 of the shoe 10, and can be used to provide cushioning for the wearer's leg. The material 72 may include one or more layers of foam, such as PU or EVA and can vary in hardness.

FIG. 4(*a*) illustrates an alternative tongue chimney structure 60'. Here, a material 76 can be added to a top region of the tongue chimney structure 60 discussed above. The material 76 is preferably adhered or otherwise affixed to the tongue chimneys 34. The material 76 desirably includes one or more openings 78, which preferably substantially align with the pathways 54 of the tongue chimneys 34.

FIG. 4(*b*) is a cross-sectional view of the tongue chimney structure 60' along line 4A-4A, which is taken through the pathway 54. As seen here, the material 76 may only be on one side of the tongue chimney structure 60'. FIG. 4(*c*) is a cross-sectional view of the tongue chimney structure 60' along line 4B-4B. As seen in this figure, the tongue chimney structure 60' may include two rows of oppositely facing tongue chimneys 34*a,b*. The material 76 desirably faces the interior cavity 24 of the shoe 10, and can be used to provide cushioning for the wearer's leg. The material 76, like the material 72, may include one or more layers of foam, such as PU or EVA. FIG. 4(*d*) illustrates the cross-sectional view of FIG. 4(*c*) with the tongue chimney structure 60' curved or arched as it may be during wear. Here, it can be seen that curving the tongue chimney structure 60' does not unduly obstruct the pathways 54, permitting convection of heat/moisture as discussed above.

FIGS. 4(*e*)-(*g*) illustrate an alternative wherein one or both sides of the tongue chimney structure 60' or 60 are covered by a material 80. The material 80 may be permanently or removably attached to the tongue chimney structure 60' or 60. Preferably, the material 80 comprises a first lining 80*a*, which faces the wearer's leg during use and a second lining 80*b*, which faces away from the leg during use. The first lining 80*a* has one or more layers of material, preferably including at least one layer of wicking material in immediate exposure to the shoe microclimate. Examples of this type of lining include a chemically treated brushed polyester, rayon, nylon, cotton or combination of companion fibers or a specialty woven or knit material used in combination to maximize breathability by absorbing moisture next to the skin and wicking away moisture from the surface of skin to allow for evaporation. Wicking materials sold under the brand names COOLMAX, DRITEX, and POWER DRY are commonly known in the industry. The second lining 80*b* has one or more layers of material, preferably including at least one layer of non-wicking material, such as a mesh. The mesh could comprise one or more layers of coated nylon, polyester, and/or cotton. The second lining 80*b* may also include a pocket 82, which may be disposed at or near the top of the lining. The pocket 82 is preferably sized to permit the wearer to store at least a segment of the laces therein. The pocket 82 may be formed of a stretch mesh or other suitable material. For example, the pocket 82 may comprise nylon, synthetic leather, or, preferably, a non woven material with an elongation value of at least 150%.

FIGS. 5(*a*)-(*e*) illustrate cross sections of alternative chimney structures suitable for use in alternative embodiments of the present invention. FIG. 5(*a*) presents a chimney structure 100 that may comprise one or more substantially square-shaped chimneys 102. The chimneys 102 may be formed by supports 104 having substantially parallel sidewalls 106 that are connected to a wall 108. The supports 104 and the wall 108 may be integrally formed, for example, by a molding process. In this configuration, width 110 and depth 112 are substantially the same.

FIG. 5(*b*) presents a chimney structure 120 that may comprise one or more substantially rectangular-shaped chimneys 122. The chimneys 122 may be formed by supports 124 having substantially parallel sidewalls 126 that are connected to a wall 128. The supports 124 and the wall 128 may be integrally formed in a molding process. In this configuration, width 130 and depth 132 are different.

In FIG. 5(*c*), chimney structure 140 may comprise one or more chimneys 142 formed by connecting substantially rounded or circular supports 144 to a wall 146. The wall 146 may include one or more holes 148. The supports 144 and the wall 146 may be integrally formed by a molding process. The holes 148 may be disposed partly or substantially along the length of the chimney structure 140. For example, if the chimney structure 140 comprises a body chimney structure 36, the holes 148 may run substantially the length of the pathways 42 from the first end 42*a* to the second end 42*b*. The holes 148 permit the chimney structure 140 to flex or bend without compromising the ability of the chimneys 142 to vent heat and/or moisture.

FIG. 5(*d*) illustrates additional support structures that may be used in accordance with aspects of the present invention to create different chimney configurations. Each of the chimneys in this figure is preferably connected to a wall 160, which functions as the back of the chimney. For instance, chimney 162*a* is formed by adjacent trapezoid-shaped supports 164. An equivalent shape is achieved with chimney 162*b* having one trapezoid-shaped support 164 on one side and a parallelogram-shaped support 166 on the other side. Placing two parallelogram-shaped supports 166 adjacent to one another forms a parallelogram-shaped chimney 168. Chimneys 170, 172, 174 and 176 are obtained by placing substantially oval-shaped supports 178,180 and rounded rectangular-shaped supports 182,184 in the positions shown in the figure. Of course, it should be understood that many other chimney shapes can easily be achieved by using supports and adjacent wall members of varying geometrical shapes. The key criterion is that the chimney pathways have sufficient cross-sectional area to permit adequate heat/moisture conduction. The pathways of such chimneys need not be entirely or substantially straight. Instead, they may be angled, curved, arched, s-shaped, etc., at one or more sections along their length.

In each of the chimney configurations shown in FIGS. 5(*a*)-(*d*), the chimneys are partly or fully open along one side. However, in alternative embodiments for the chimney structures disclosed herein, some or all of the chimneys may be substantially or completely closed on all sides. By way of example only, FIG. 5(*e*) illustrates a cross sectional view of a chimney structure 190 having a first wall 192*a*, a second wall 192*b* and supports 194 disposed therebetween to form chimneys 196.

While enclosed on all sides, the chimneys 196 preferably include one or more openings 198 in one or both of the walls 192*a,b*. In body chimney structures such as the body chimney structure 36, the openings 198 are preferably formed at the first and second ends 42*a*,42*b* of the pathways 42. Additional openings 198 may be positioned similar to the openings 46 shown in FIGS. 2(*d*), (*e*). Additional openings 198 are particularly suitable when two parallel rows of chimneys 196 are used, such as those described above with respect to FIGS. 2(*c*) and 3(*d*). If used, such additional openings 198 may act as passageways between the rows of chimneys 196.

While the chimney structures in the embodiments presented above illustrate multiple chimneys along the body 20 and collar 22 of the upper 14 or along the tongue 26, other embodiments of the present invention contemplate the use of a single chimney, which may be positioned anywhere within the upper 14. Alternatively, one chimney may be positioned adjacent to each side and/or the rear or front of the foot within the upper 14. Here, a first end of the chimney should be open at or near the foot bed region, for instance below ankle level or as close to the bottom of the foot as possible. A second end or portion of the chimney should be open to the external climate.

The chimneys of the present invention may be incorporated into footwear in different ways. For example, body chimneys and/or tongue chimneys may be integral with the upper 14, or may be removably coupled to the upper 14 as separate components. Chimneys can be molded or otherwise inserted into the interior walls of a shoe. While chimneys could be positioned in a number of layers of an article of footwear, it is most preferable to position at least some of the chimneys in one or more layers as close to the foot as possible in order to reduce the distance that heat and moisture generated from the foot have to travel before evacuation via the chimneys. Convective air movement facilitates evaporation and other forms of cooling.

In one example, the chimneys are formed by molding a foam layer and then covering the foam layer with a comfortable lining material. Additional examples of chimney materials are discussed below. Chimneys are desirably constructed of a geometry that provides a sufficient surface against the foot and ankle to prevent discomfort and pinching, for example, from sharp edges and high pressure areas through the reduction of surface area between the foot and shoe.

Because convection is the primary mechanism guiding air movement from inside the microclimate of the shoe to the outside environment, the evacuation of warm, moist air occurs without requiring user intervention or mechanical devices when employing chimneys in accordance with the present invention. Convective currents become more powerful as the relative temperature difference between two objects increases. During low activity, foot temperature and internal shoe temperature remain relatively low. As activity increases, foot temperature and in-shoe temperature can increase very rapidly. The increase in temperature creates a correspondingly increased thermal gradient between the in-shoe microclimate and the external environment, which creates stronger convection currents and greater heat and humidity evacuation from the shoe. Pumps or other mechanical apparatus are thus unnecessary.

Figure 6:
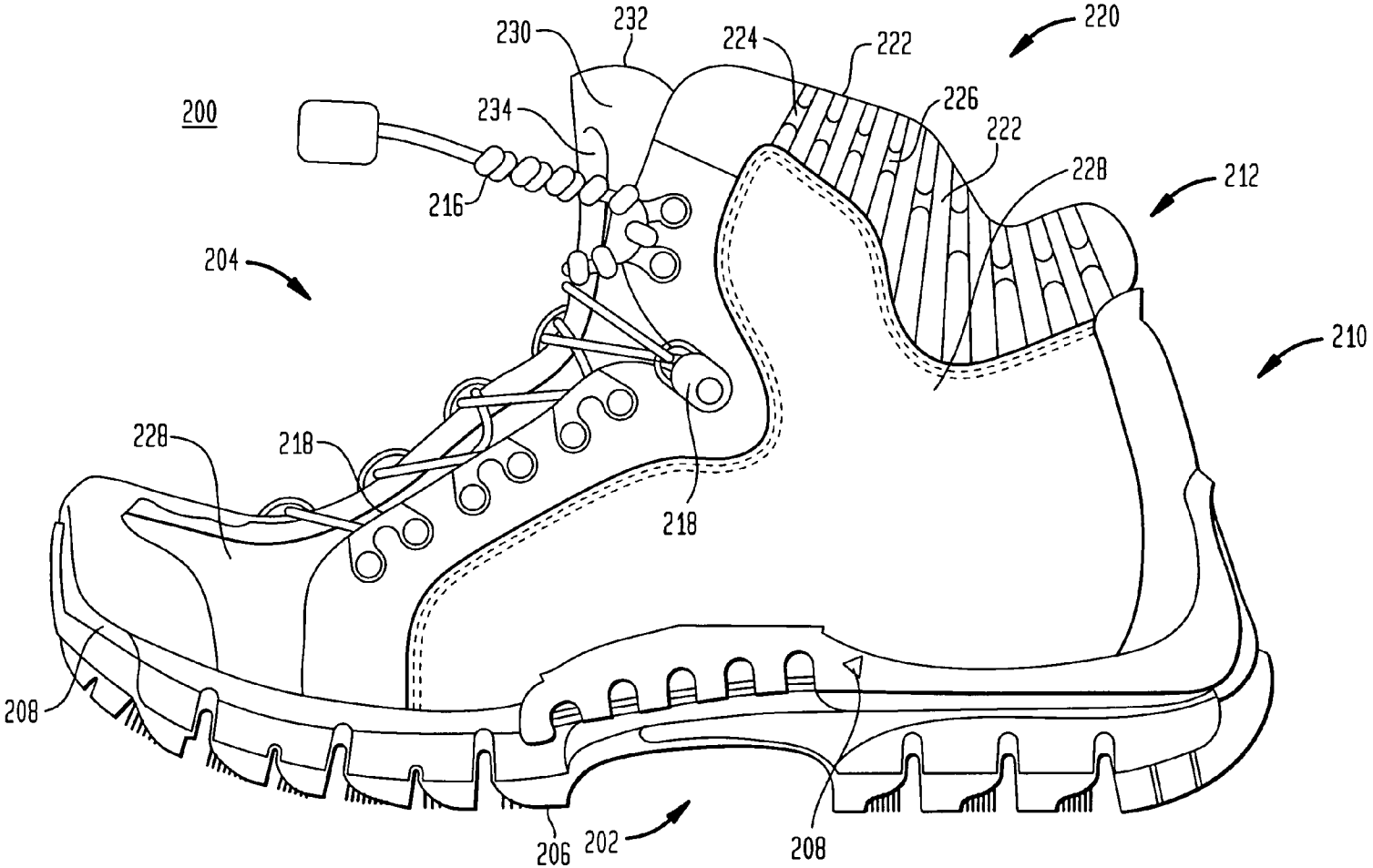
FIG. 6 illustrates a boot utilizing chimneys in accordance with aspects of the present invention.
Figures 7A, 7B:
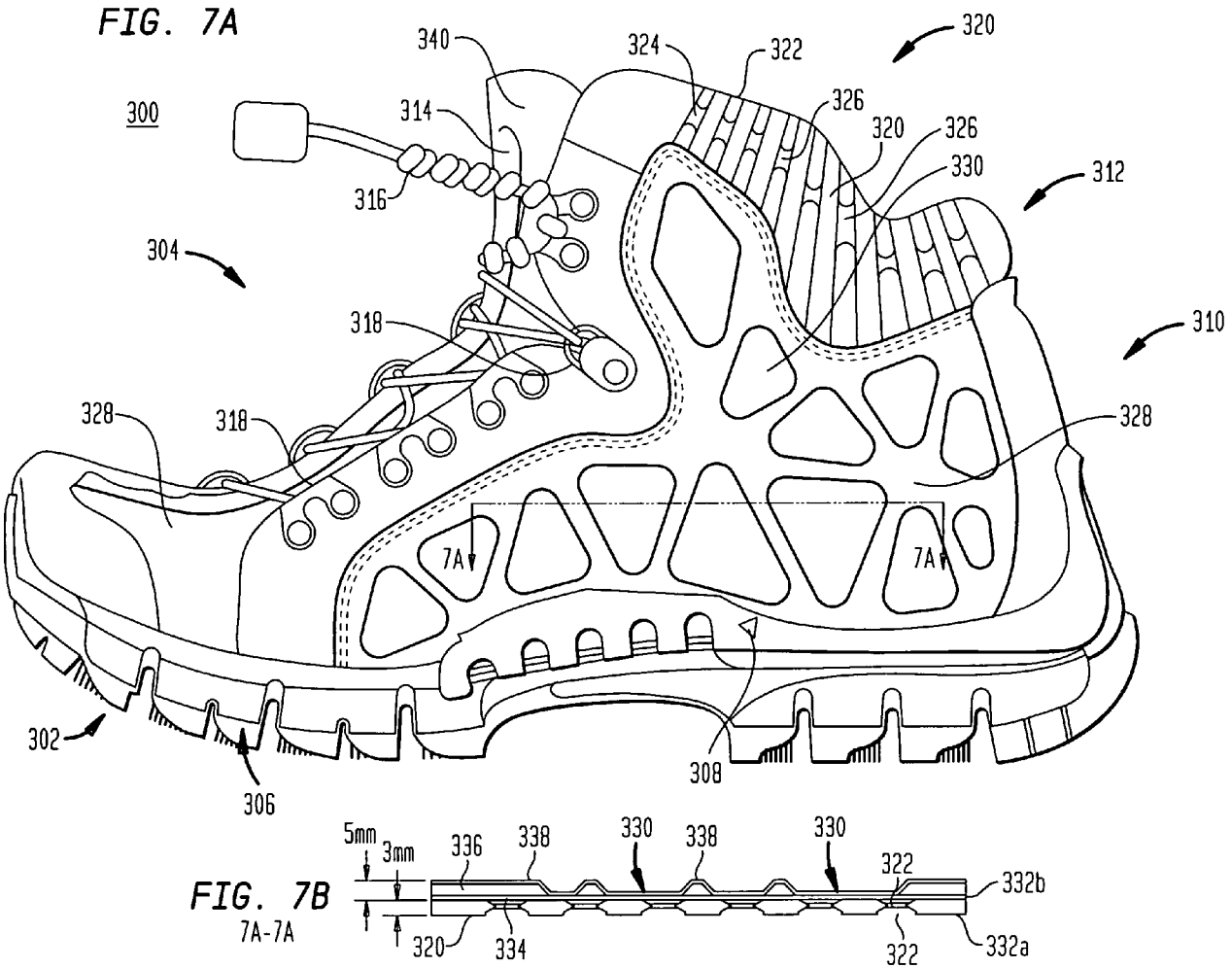
FIGS. 7(*a*)-(*g*) illustrate an alternative boot utilizing chimneys in accordance with aspects of the present invention.
Figure 7C:
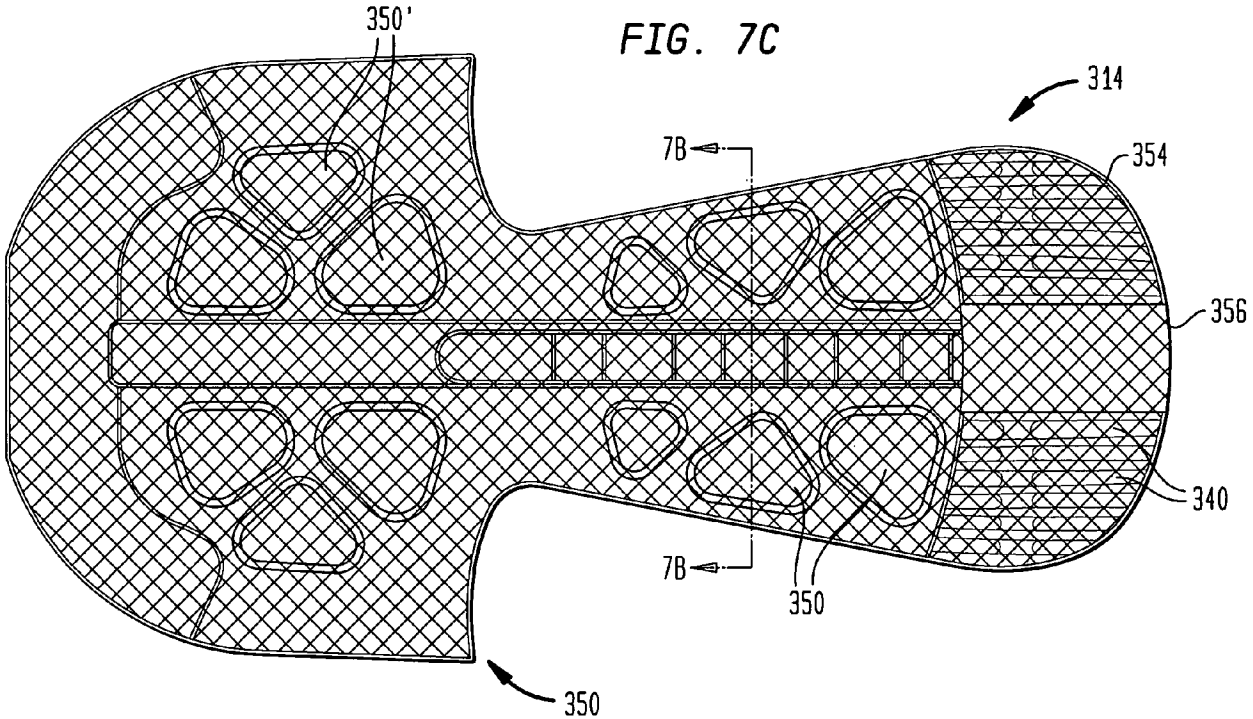
Figure 7D:
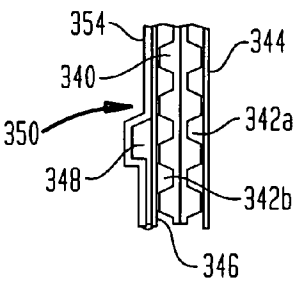
Figure 7E:
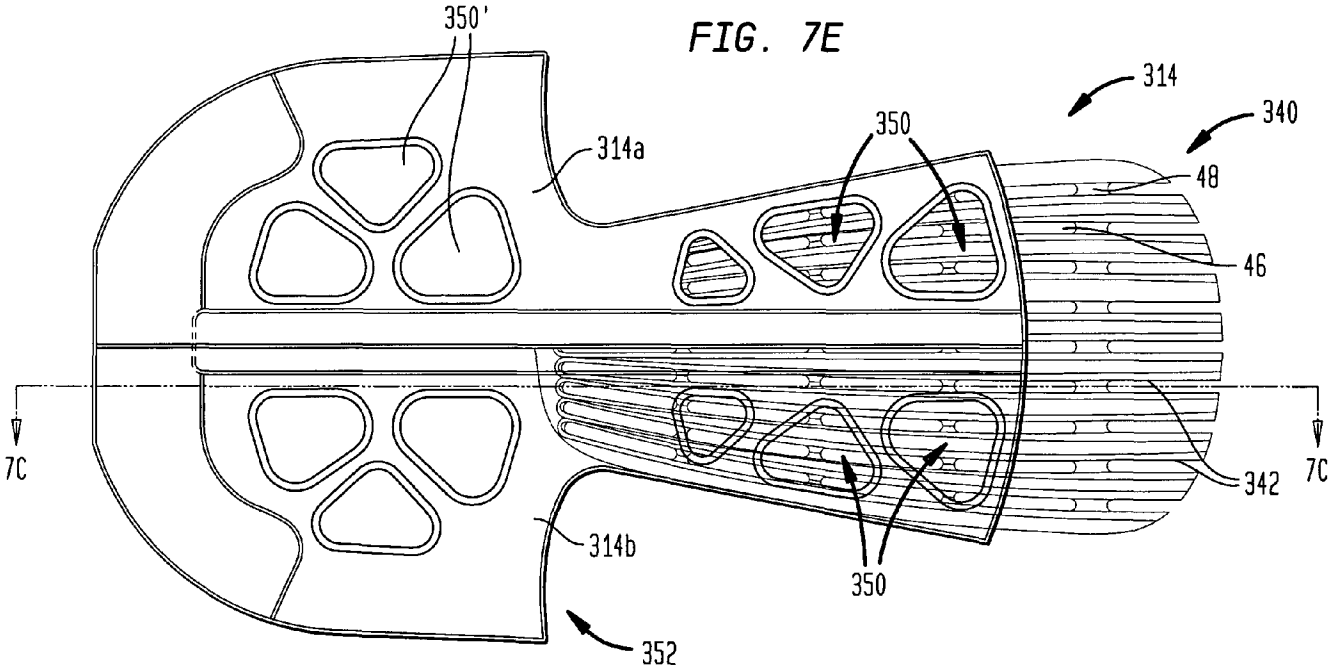
Figure 7F:
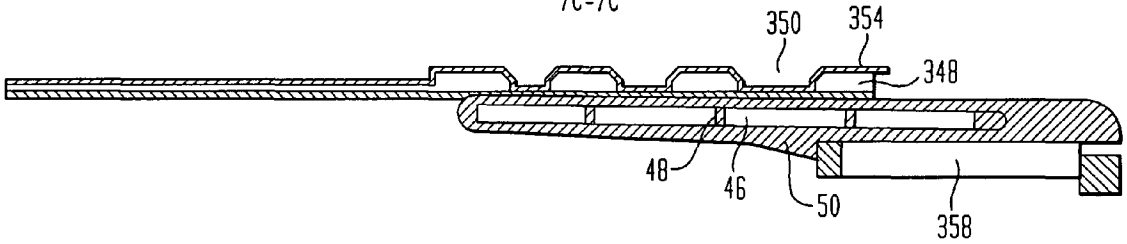
Figure 7G:
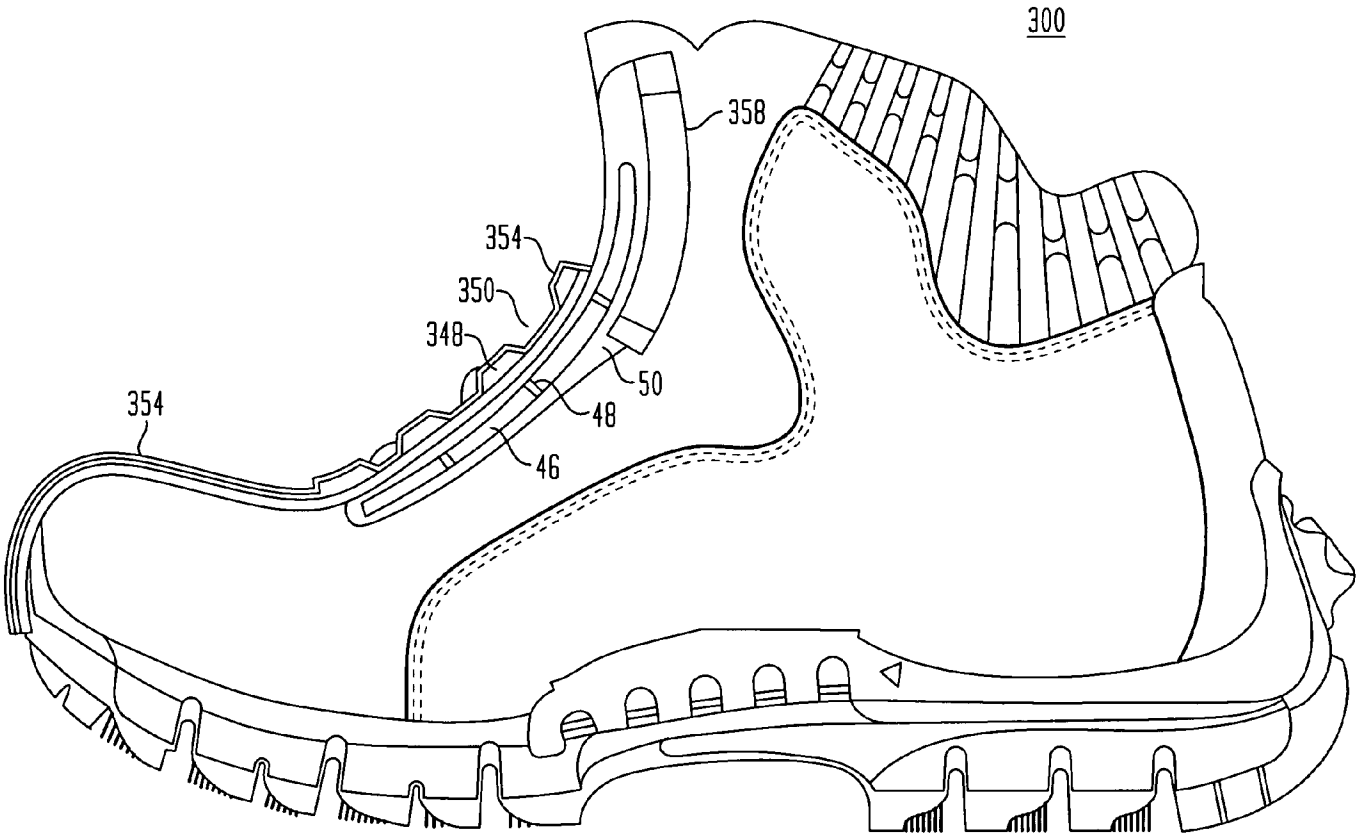
Figures 8A, 8B:
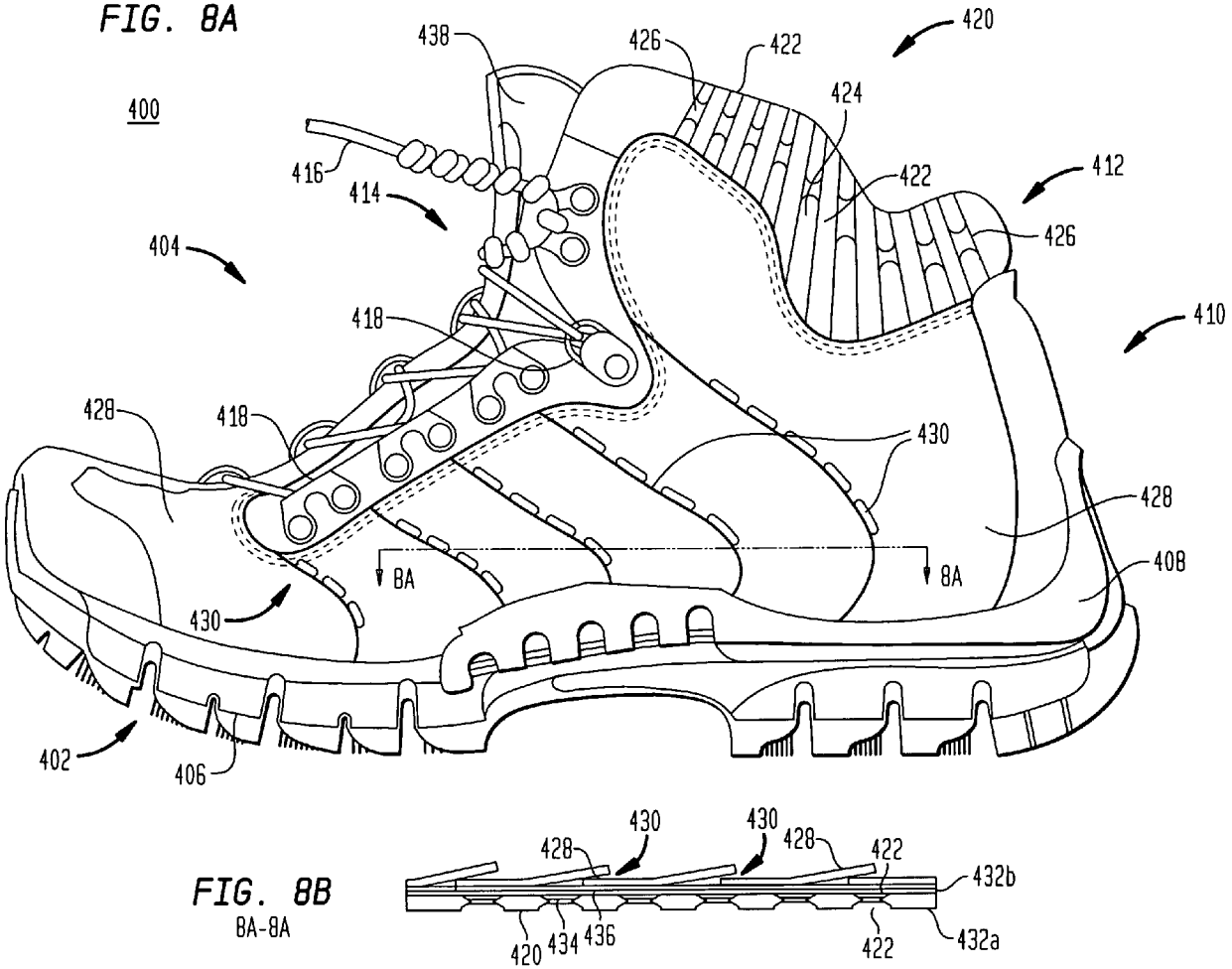
FIGS. 8(*a*)-(*e*) illustrate another boot utilizing chimneys in accordance with aspects of the present invention.
Figure 8C:
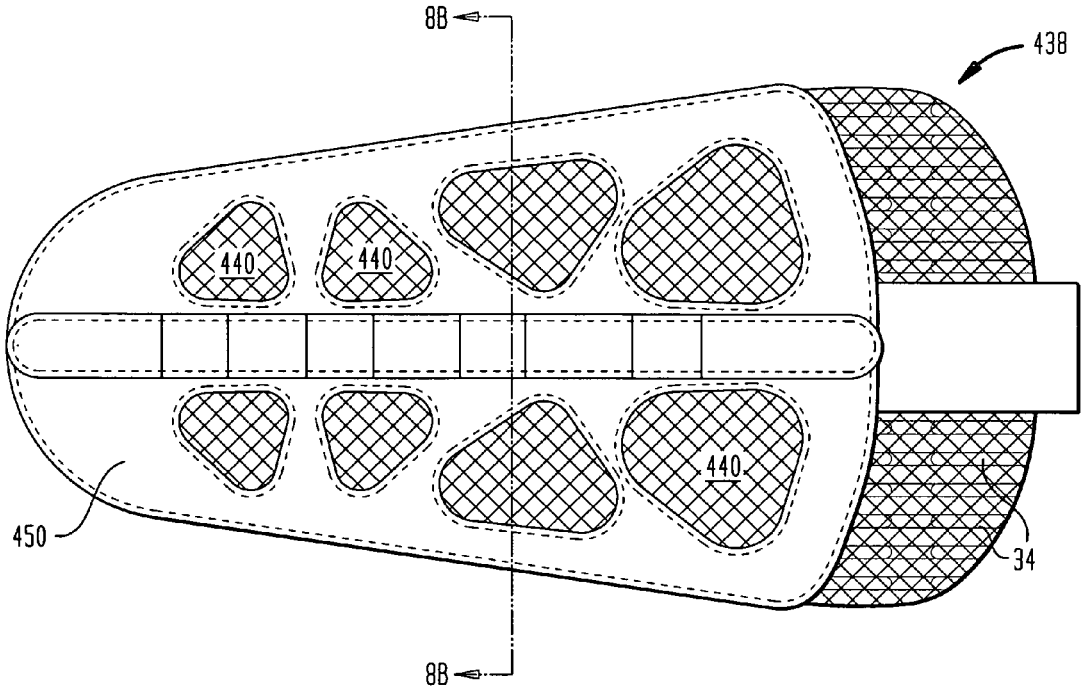
Figure 8D:
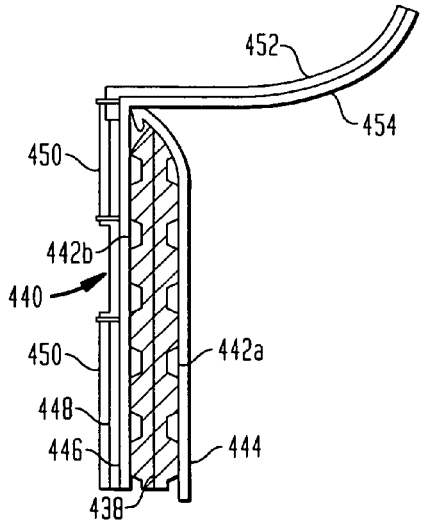
Figure 8E:
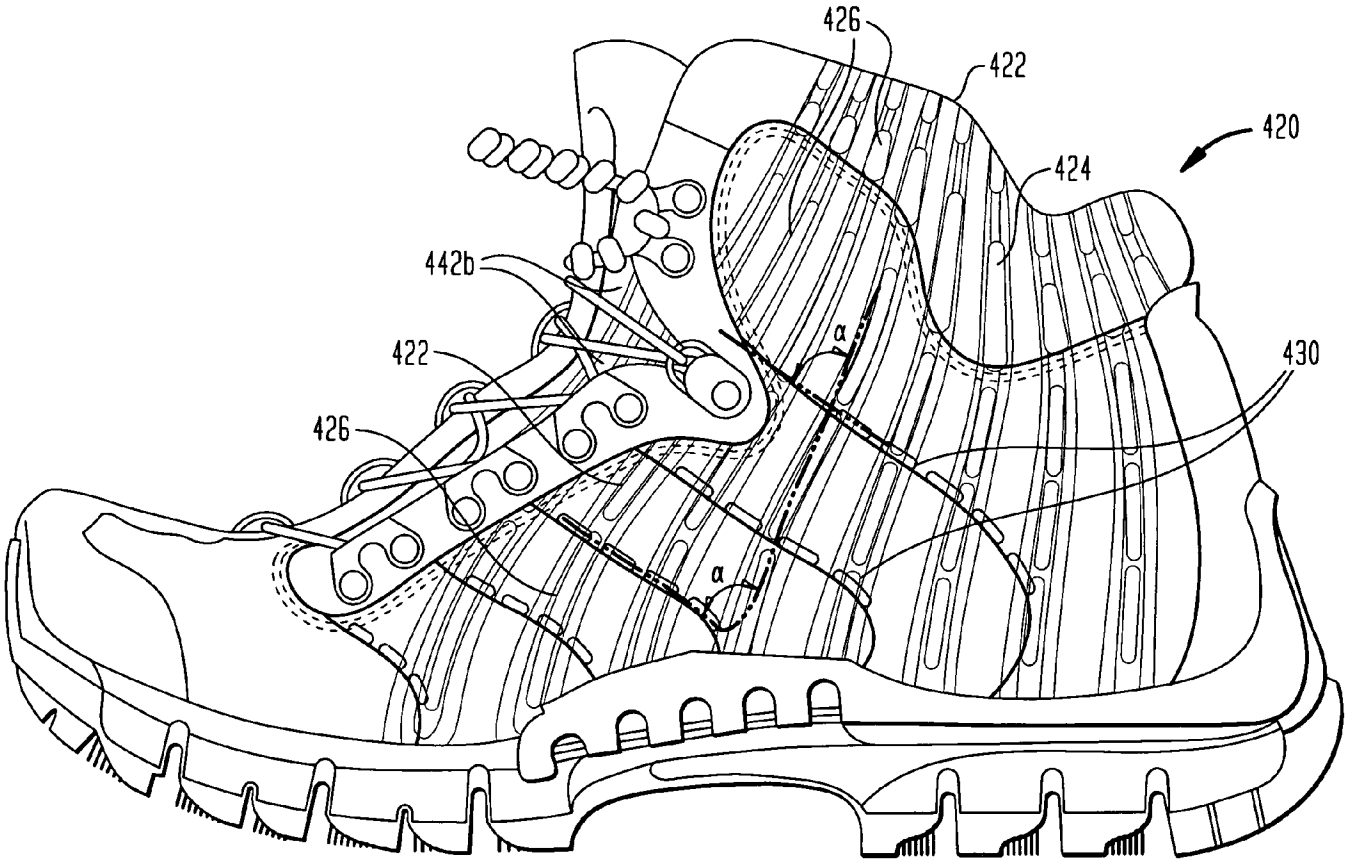
Figures 9A, 9B:
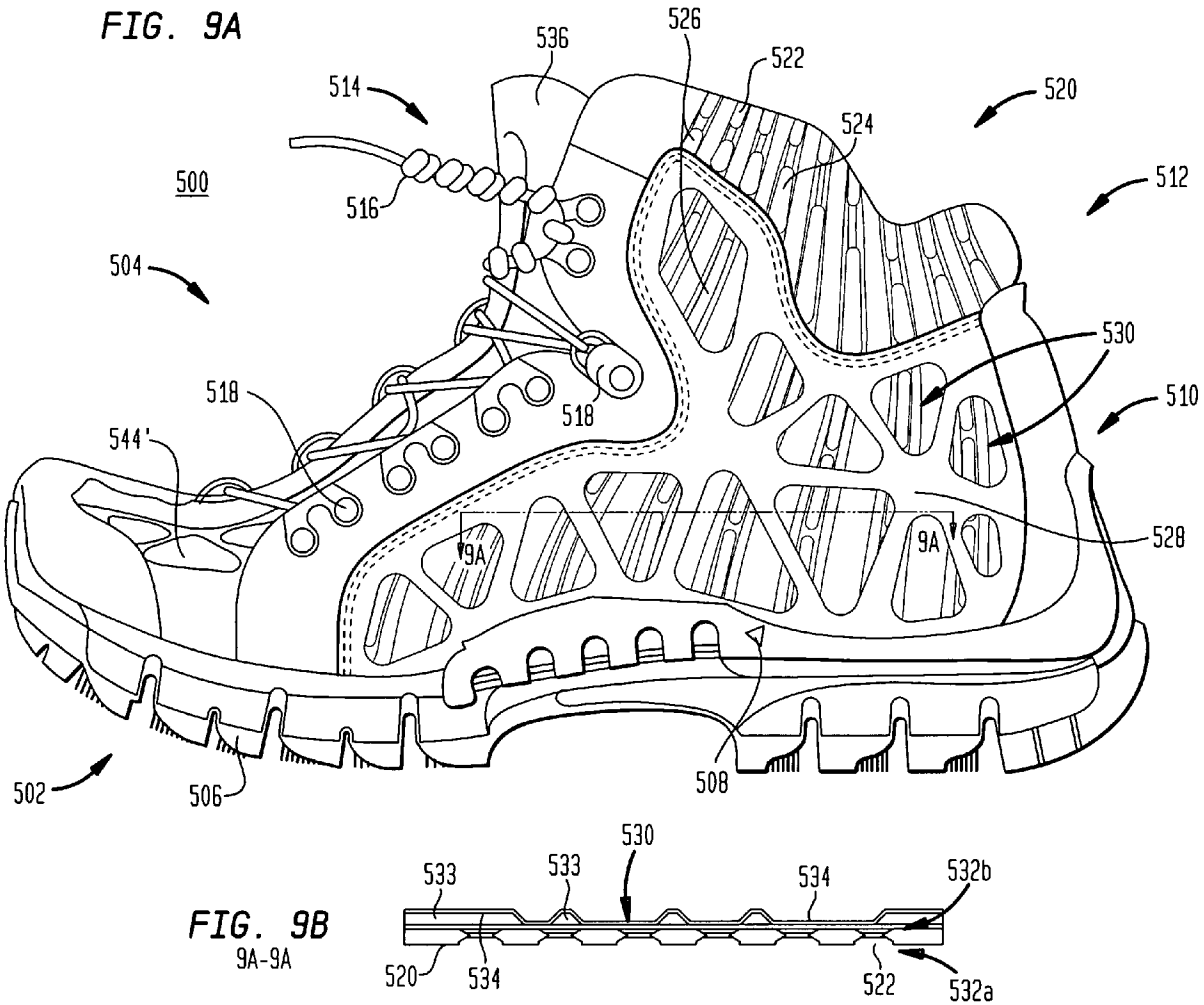
FIGS. 9(*a*)-(*h*) illustrate yet another boot utilizing chimneys in accordance with aspects of the present invention.
Figure 9C:
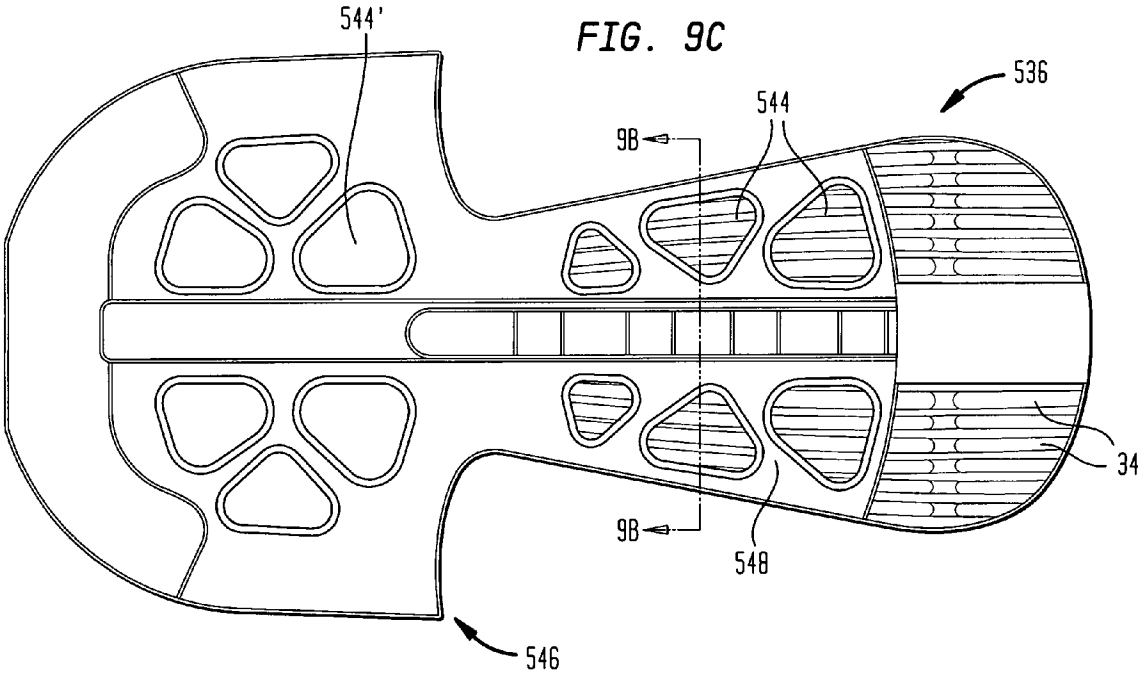
Figure 9D:
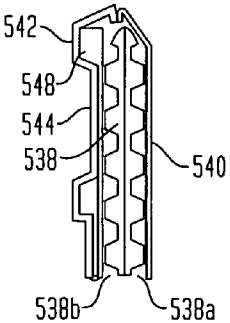
Figure 9E:
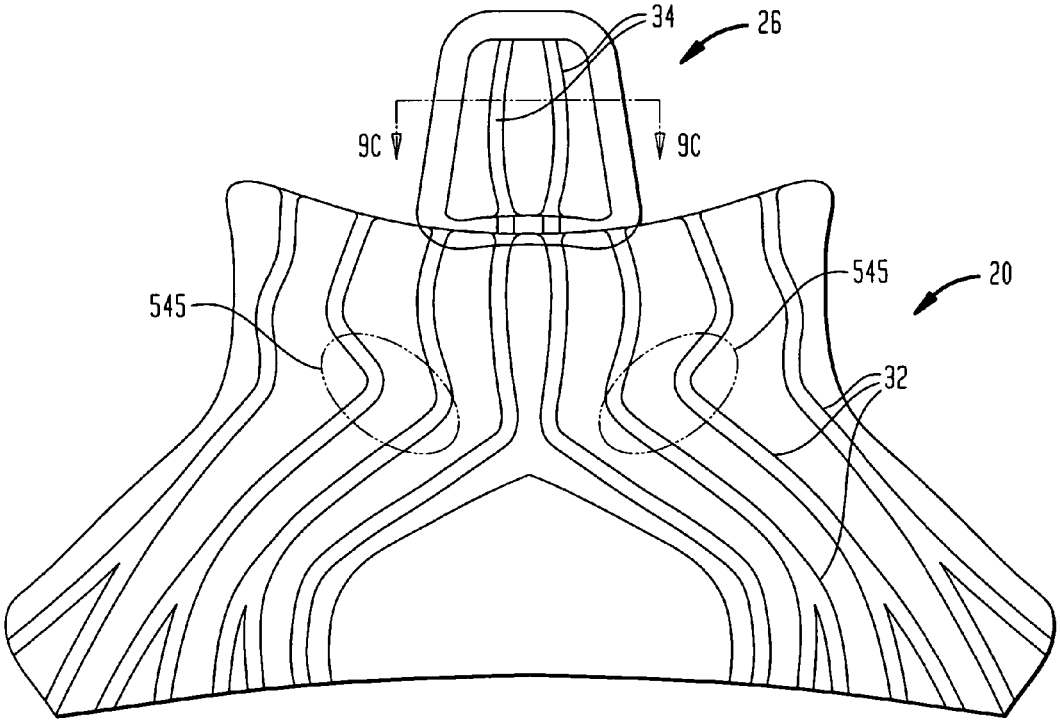
Figure 9F:
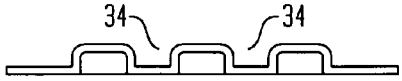
Figure 9H:
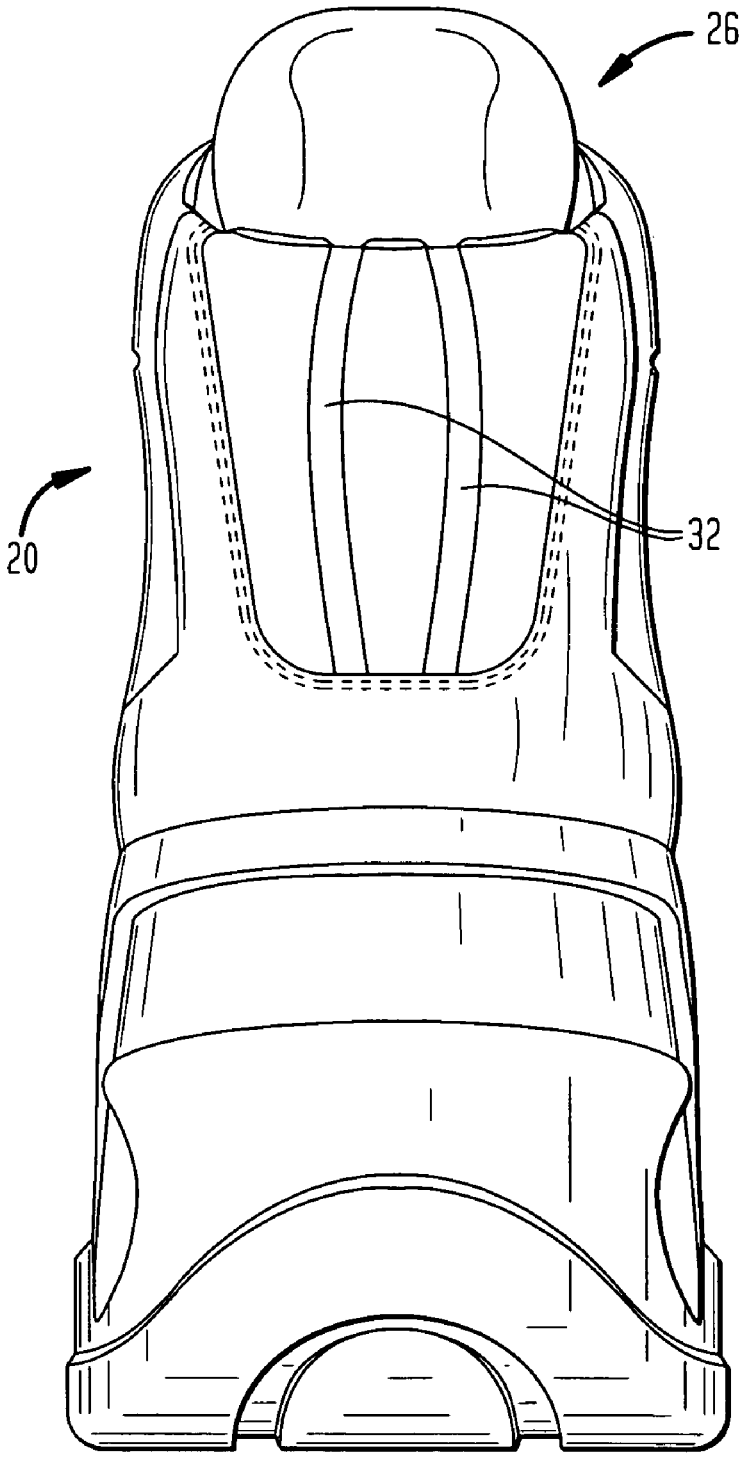

The channels discussed above may be implemented in a wide variety of footwear. Several exemplary articles of footwear implementing chimneys are shown and described below. For instance, FIG. 6 illustrates a boot 200 having an outsole 202 and an upper 204. The outsole 202 may include a tread 206 on the bottom thereof. As shown, a region 208 connects the outsole 202 to the upper 204. The upper 204 includes a body 210 as well as a collar 212, which defines an opening that enables a wearer to insert his or her foot into an interior cavity of the upper 204. The upper 204 includes a tongue 214. The body 210 includes laces 216 and eyelets 218.

The body 210 includes a body chimney structure 220 having multiple chimneys 222 having pathways 224 therein. The body chimney structure 220 is preferably same as the body chimney structure 36, although any chimneys and chimney structures in accordance with the present invention may be employed in the boot 200. The body chimney structure 220 is shown having openings 226 near the ends of the pathways 224 along the collar 212. The body chimney structure 220 may include opposing rows of body chimneys 222 (such as are body chimneys 32*a,b* of FIG. 3(*d*)), with one row facing inward towards the wearer's foot and the other row facing in the opposite direction. However, a single row can also be employed.

The portion of the body chimney structure 220 along the collar 212 provides venting to the external climate. Other portions of the body chimney structure 220 are shown being covered by a layer of material 228. The material layer 228 is preferably leather or a leather/fabric combination. This material layer may be substantially non-permeable to heat and/or moisture. In this case, it is particularly desirable for the body chimney structure 220 to include the openings 226 positioned at or near the collar 212 above the material layer 228 to enhance ventilation.

The tongue 214 preferably includes a tongue chimney structure 230. The tongue chimney structure 230 is preferably same as the tongue chimney structure 60 or 60', although any chimneys and chimney structures in accordance with the present invention may be employed in the boot 200. The exterior of the tongue chimney structure 230 is shown being covered by a material 232, which is preferably the same as the material 80 discussed above with regard to FIGS. 4(*e*)-(*g*). A pocket 234 may also be included is also shown as part of the material 232. The pocket 234 is designed to permit the wearer to store the laces 216 therein.

FIG. 7(*a*) illustrates a boot 300 similar to the boot 200 of FIG. 6. The boot 300 includes an outsole 302 and an upper 304. The outsole 302 may include a tread 306 on the bottom thereof. As shown, a region 308 connects the outsole 302 to the upper 304. The upper 304 includes a body 310 as well as a collar 312, which defines an opening that enables a wearer to insert his or her foot into an interior cavity of the upper 304. The upper 304 includes a tongue 314. The body 210 includes laces 316 and eyelets 318.

The body 310 includes a body chimney structure 320 having multiple chimneys 322 having pathways 324 therein. The body chimney structure 320 is preferably same as the body chimney structure 220, although any chimneys and chimney structures in accordance with the present invention may be employed with the boot 300. The body chimney structure 320 is shown having openings 326 near the ends of the pathways 324 along the collar 312. As will be described in more detail below, the body chimney structure desirably includes opposing rows of body chimneys 322 (such as the body chimneys 32*a,b* of FIG. 3(*d*), with one row facing inward towards the wearer's foot and the other row facing in the opposite direction. Alternatively, a single row may suffice.

The portion of the body chimney structure 320 along the collar 312 provides venting to the external climate. Other portions of the body chimney structure 320 are shown being covered by a material 328. The material 328 is preferably leather or a leather/fabric combination or any other commonly used material within footwear. This material may be substantially non-permeable to heat and/or moisture. The material 328 desirably includes one or more openings 330. The openings may come in any shape desired, including, but not limited to the substantially triangular, trapezoidal, and oval shapes presented.

FIG. 7(*b*) illustrates a cross-sectional view of the body 310 along the 7A-7A line of FIG. 7(*a*). As seen in FIG. 7(*b*), two rows of body chimneys 322 may be provided, with a first row 332*a* facing inward towards the wearer's foot and a second row 332*b* facing in the opposite direction. The material 328 is preferably positioned adjacent to the second row 332*b*.

The material layer 328 may comprise multiple layers, including a material 334 that is a substantially waterproof membrane. More preferably, the material 334 comprises a substantially waterproof membrane capable of venting moisture from the shoe microclimate to the outside environment. By way of example only, the material 334 may comprise an expanded PTFE material, such as the materials shown and described in U.S. Pat. Nos. 6,108,819, 6,228,477, 6,410,084, 6,676,993, and 6,854,603, the entire disclosures of which are hereby expressly incorporated by reference herein. As seen in FIG. 7(*b*), the material 334 preferably lies between the openings 330 and the body chimney structure 320. One or more of the openings 326 of the body chimney structure 320 are desirably positioned facing the openings 330 to help promote venting.

The material layer 328 may also include an exterior structure 336, with the openings 330 therein. The exterior structure 336 may be formed, for example, of PE or any of the commonly used materials in footwear such as leather, synthetic leather or a waterproof version of the same. Overlying the exterior structure 336 there may be a covering 338, such as a highly porous material, e.g., mesh. The covering 338 preferably covers the openings 330 as well as the exterior structure 336.

The tongue 314 preferably includes a tongue chimney structure 340, as shown in the exterior view of FIG. 7(*c*). The tongue chimney structure 340 may be the same as the tongue chimney structure 230, although any chimneys and chimney structures in accordance with the present invention may be employed. FIG. 7(*d*) illustrates a cross-sectional view of the tongue chimney structure 340 along the 7B-7B line of FIG. 7(*c*). In FIG. 7(*d*), it can be seen that the tongue chimney structure 340 includes two rows of tongue chimneys 342, with a first row 342*a* facing inward towards the wearer's leg and a second row 342*b* facing in the opposite direction. Alternatively, a single row 342 may be employed.

The first row 342*a* is desirably covered by a material 344, which may comprise a wicking material for removing or pulling moisture away from the wearer's skin and/or away from a sock. The second row 342*b* is desirably covered by a material 346, which may be a substantially waterproof membrane. More preferably, the material 346 comprises a substantially waterproof membrane capable of venting moisture from the shoe microclimate to the outside environment, such as the material 334 discussed above. The membrane of the material 346 may include a tricot material, such as a monofilament tricot.

Exterior structure 348 preferably overlies the material 346. As seen in FIG. 7(*c*), the exterior structure 348 may include one or more openings 350 therein. The openings 350 help promote the convective venting process. Additional openings 350' may be disposed on the vamp 352. The exterior structure 348 may comprise the same material as the exterior structure 336 of the material layer 328. Referring back to FIG. 7(*d*), a covering 354 may optionally overly the exterior structure 348. The covering 354 is preferably the same material as the covering 338. The covering 354 preferably covers the openings 350 as well as the exterior structure 348. The covering 354 may also include a pocket 356, which is designed to permit the wearer to store the laces 316 therein.

FIG. 7(*e*) is a partial cutaway view illustrating the tongue 314 and the tongue chimney structure 340. As shown, the tongue 314 may be formed of an outer layer 314*a* and an inner layer 314*b*. In this case, the tongue chimney structure 340 is preferably removably insertable between the layers 314*a,b*. As shown, layer 314*a* is an outer layer and layer 314*b* is an inner layer, and the tongue chimney structure 340 is not attached by a fastening mechanism to the inner or outer layer. Alternatively, the tongue chimney structure 340 may be permanently attached to one or both of the layers 314 *a,b*.

FIG. 7(*f*) is a cross-sectional view along the 7C-7C line of FIG. 7(*e*). The tongue chimney structure 340 may be substantially similar to the tongue chimney structure 60' of FIG. 4(*a*). A material 358, like the material 76, is preferably added to a top region of the tongue chimney structure 340. The material 358 desirably provides cushioning for the wearer's leg. The material 358 may include one or more layers of foam, such as PU, EVA, or latex, any of which may be of varying hardness. The material 358 is preferably adhered or otherwise affixed to the tongue chimney structure 340. FIG. 7(*g*) illustrates a cross-sectional view of the tongue chimney structure 340 as it would look within the boot 300 or other footwear.

FIG. 8(*a*) illustrates a boot 400, which includes an outsole 402 and an upper 404. The outsole 402 may include a tread 406 on the bottom thereof. As shown, a region 408 connects the outsole 402 to the upper 404. The upper 404 includes a body 410 as well as a collar 412, which defines an opening that enables a wearer to insert his or her foot into an interior cavity of the upper 404. The upper 404 includes a tongue 414. The body 410 includes laces 416 and eyelets 418 for securing the foot within the boot 400.

The body 410 includes a body chimney structure 420 having one or more chimneys 422 having pathways 424 therein. The body chimney structure 420 is preferably same as the body chimney structure 220, although any chimneys or chimney structures in accordance with the present invention may be employed with the body 400. The body chimney structure 420 is shown having openings 426 near the ends of the pathways 424 along the collar 412. As will be described in more detail below, the body chimney structure 420 desirably includes opposing rows of body chimneys 422, with one row facing inward towards the wearer's foot and the other row facing in the opposite direction. However, a single row can be used.

The portion of the body chimney structure 420 along the collar 412 provides venting to the external climate. Portions of the body chimney structure 420 are shown being covered by a material 428. The material 428 is preferably leather or a leather/fabric combination, although other materials may be used. The material 428 may be substantially waterproof. The material 428 desirably includes one or more vents 430, which each may include one or more vent holes 430' thereon.

FIG. 8(*b*) illustrates a cross-sectional view of the body 410 along the 8A-8A line of FIG. 8(*a*). As seen in FIG. 8(*b*), two rows of body chimneys 422 are provided, with a first row 432*a* facing inward towards the wearer's foot and a second row 432*b* facing in the opposite direction. The material 428 is preferably positioned adjacent to the second row 432*b*. The vents 430 in the material layer 428 may be formed by overlapping sections of adjacent material layers 428. This is akin to the overlapping scales on a shark.

The material layer 428 may comprise multiple layers, including a material 434 that is a substantially waterproof membrane. More preferably, the material 434 comprises a substantially waterproof membrane capable of venting moisture from the shoe microclimate to the outside environment, as described above with respect to the material 334. By way of example only, the material 434 may comprise expanded polytetrafluroethylene. As seen in FIG. 8(*b*), the material 434 preferably lies between the vents 430 and the body chimney structure 420. The material 434 helps prevent rain and other moisture from entering the microclimate of the boot 400, while permitting heat and sweat to vent out of the boot 400. At least some of the openings 426 and the pathways of the body chimney structure 420 are desirably positioned near the vents 430 to help promote venting. The material layer 428 may also include a covering 436 such as a mesh overlying the material 434. The vents 430 are desirably placed in an outermost layer of the material layer 428.

The tongue 414 preferably includes a tongue chimney structure 438, as shown in the exterior view of FIG. 8(*c*). The tongue chimney structure 438 may be the same as the tongue chimney structures 230 and 340, although any chimneys and chimney structures in accordance with the present invention may be employed. One or more tongue chimneys can be used. While the tongue 414 may incorporate vents similar to the vents 430, it is more preferable to instead include one or more openings 440 to promote heat and moisture expulsion from within the boot 400.

FIG. 8(*d*) illustrates a cross-sectional view of the tongue chimney structure 438 along the 8B-8B line of FIG. 8(*c*). In FIG. 8(*d*), it can be seen that the tongue chimney structure 438 includes two rows of tongue chimneys 442, with a first row 442*a* facing inward towards the wearer's foot and a second row 442*b* facing in the opposite direction. However, a single row can be used.

The first row 442*a* is desirably covered by a material 444, which may comprise a wicking material for removing or pulling moisture away from the wearer's skin and/or away from a sock. The second row 442*b* is desirably covered by a material 446, which may be a substantially waterproof membrane. More preferably, the material 446 comprises a substantially waterproof membrane capable of venting moisture from the shoe microclimate to the outside environment, such as the material 334 discussed above. The membrane of the material 446 may include a tricot material, such as a monofilament tricot.

A covering 448 may optionally overly the material 446. The covering 448 is preferably a non-wicking material that may be the same material as the covering 338 or the covering 354. The covering 448 preferably underlies the openings 440. An outermost material layer 450 overlies the covering 448, the material 446, and the tongue chimney structure 438. The openings 440 are formed in the outermost material layer 450. As can be seen in FIG. 8(*d*), one or more pathways of the tongue chimney structure 438 are positioned directly behind an opening 440 to promote venting.

A gusset 452 may be attached to the tongue 414 adjacent or near to the end of the tongue chimney structure 438. The gusset 452 may be sewn or otherwise connected at one end thereof to the outermost material layer 450. The other end of the gusset 452 connects the upper 404 to the tongue 414. The connection or attachment to the upper 404 may be at a height up to and including the collar. The gusset 452 may comprise any material, preferably a stretchable material. A lining 454 may be placed behind the gusset 452. The lining 454 preferably comprises a waterproof membrane, with or without a monofilament tricot. In a preferred embodiment, the lining 454 is a continuation of the material 446.

FIG. 8(*e*) is a partial see-through view of the boot 400 with an outermost portion of the material layer 428 omitted for clarity. As seen in this figure, the body chimneys 422 of the body chimney structure 420 can cover the most or all of the length of the body 410 and the collar 412 of the upper 404. Preferably, the body chimneys 422 span the length from the heel of the foot up to the ball of the foot, and from the footbed of the boot 400 to the collar 412. The vents 430 may be positioned at any location along the body chimney structure 420. While not necessary, rows of the vents 430 are preferably angled with an angle $\alpha$ relative to the pathways of the chimneys 422. The angle $\alpha$ is preferably between 15° and 75°. More preferably, the vents 430 are generally or substantially perpendicular to the pathways of the chimneys 422, for example, with a being at least 60°. The tongue chimney structure 438 is also shown in FIG. 8(*e*), wherein the tongue chimneys 442 have pathways running from the toe region of the upper 404 up to the top portion of the tongue 414.

FIG. 9(*a*) illustrates a boot 500 that is similar to the boot 300 of FIG. 7(*a*). The boot 500 includes an outsole 502 and an upper 504. The outsole 502 may include a tread 506 on the bottom thereof. As shown, a region 508 connects the outsole 502 to the upper 504. The upper 504 includes a body 510 as well as a collar 512, which defines an opening that enables a wearer to insert his or her foot into an interior cavity of the upper 504. The upper 504 includes a tongue 514. The body 510 includes laces 516 and eyelets 518.

The body 510 includes a body chimney structure 520 having one or more chimneys 522 having pathways 524 therein. The body chimney structure 520 is preferably same as the body chimney structure 220 described above, although any chimneys and chimney structures in accordance with the present invention may be employed. The body chimney structure 520 is shown having openings 526 near the ends of the pathways 524 along the collar 512. As will be described in more detail below, the body chimney structure desirably includes opposing rows of body chimneys 522, with one row facing inward towards the wearer's foot and the other row facing in the opposite direction. A single chimney or row of chimneys can also be used.

The portion of the body chimney structure 520 along the collar 512 provides venting to the external climate. Portions of the body chimney structure 520 are shown being covered by a material 528. The material 528 preferably comprises PE, although other materials may be used. The material 528 desirably includes one or more openings 530. The openings may come in any shape desired, including, but not limited to the substantially triangular, trapezoidal, and oval shapes presented.

FIG. 9(*b*) illustrates a cross-sectional view of the body 510 along the 9A-9A line of FIG. 9(*a*). As seen in FIG. 9(*b*), two rows of body chimneys 522 may be provided, with a first row 532*a* facing inward towards the wearer's foot and a second row 532*b* facing in the opposite direction. The material 528 is preferably positioned adjacent to the second row 532*b*.

The material 528 may comprise multiple layers; however, unlike the material 328 of FIG. 7(*b*), the material 528 does not include a substantially waterproof membrane. Overlying the exterior structure/PE layer 533 of the material 528 is a covering 534, such as bug netting. The covering 534 preferably covers material 528 well as the openings 530. One or more of the openings 526 of the body chimney structure 520 are desirably positioned facing the openings 530 to help promote venting through the covering 534.

The tongue 514 preferably includes a tongue chimney structure 536, as shown in the exterior view of FIG. 9(*c*). The tongue chimney structure 536 may be the same as the tongue chimney structures 230 or 340, although any chimneys and chimney structures in accordance with the present invention may be employed. FIG. 7(*d*) illustrates a cross-sectional view of the tongue chimney structure 536 along the 9B-9B line of FIG. 9(*c*). In FIG. 9(*d*), it can be seen that the tongue chimney structure 536 includes two rows of tongue chimneys 538, with a first row 538*a* facing inward towards the wearer's foot and a second row 538*b* facing in the opposite direction, although a single tongue chimney or row of chimneys can be used.

The first row 538*a* is desirably covered by a material 540, which may comprise a wicking material for removing or pulling moisture away from the wearer's skin and/or away from a sock. As with the body 510 of the upper 504, the tongue 514 need not covered by a waterproof membrane. Instead, an exterior structure 542 preferably overlies the tongue chimney structure 536. As seen in FIG. 9(*c*), the exterior structure 542 may include one or more openings 544 therein. Additional openings 544' may be disposed on the tongue vamp 546 below where the tongue chimney structure 536 is positioned. The exterior structure 542 preferably comprises PE, although other materials may be used. Referring back to FIG. 9(*d*), a covering 548 may optionally overly the exterior structure 542. The covering 548 is preferably the same material as the covering 338 or the covering 354. The covering 548 preferably covers the openings 544 and 544' as well as the exterior structure 542.

FIGS. 9(*e*)-(*h*) illustrate alternative placement of the body chimneys 32 and tongue chimneys 34 in a shoe. The view of FIG. 9(*e*) shows the interior of the body 20, which may be a removable insert. As seen in FIG. 9(*e*), the interior of the body 20 may include one or more regions 545, which may be padded or otherwise cushioned to minimize irritation of the wearer's foot or leg. For instance, the regions 545 may be oval shaped and placed about the ankle. In this case, the ankle regions 545 may be recesses in the chimney structure, padding such as a soft foam material, or a combination of both. Thus, chafing or irritation of the ankle is avoided.

FIG. 9(*f*) illustrates a cutaway of the tongue 26 along line 9C-9C of FIG. 9(*e*). FIGS. 9(*g*) (1) and 9(*g*) (2) illustrate the exterior and interior of the tongue 26 of FIG. 9(*e*), respectively. FIG. 9(*h*) illustrates the back/heel portion of the upper 14 with a pair of body chimneys 32 therein. Here, the tongue chimneys 34 are omitted for the sake of clarity.

Figure 10A:
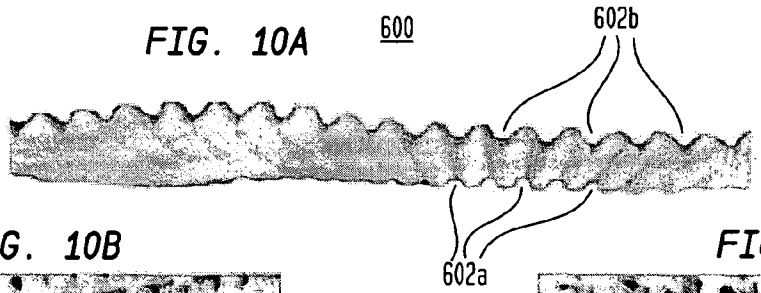
FIGS. 10(*a*)-(*c*) illustrate an alternative chimney structure in accordance with aspects of the present invention.
Figure 10B:
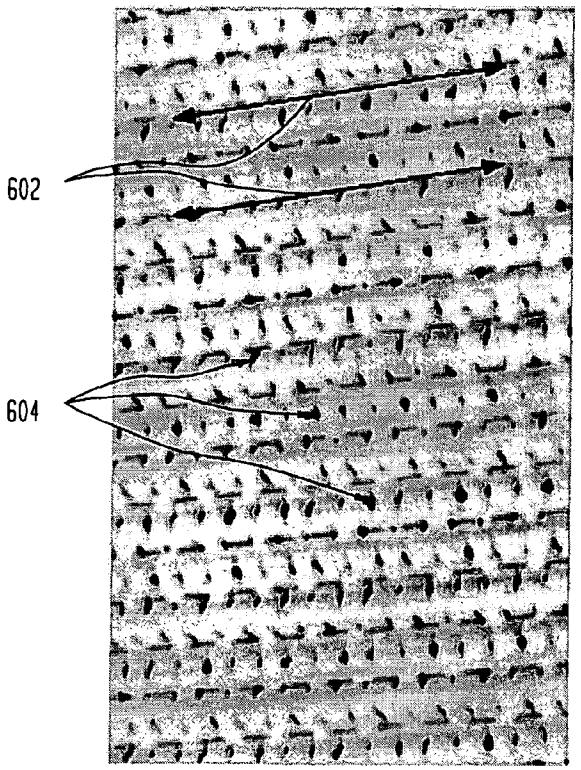
Figure 10C:
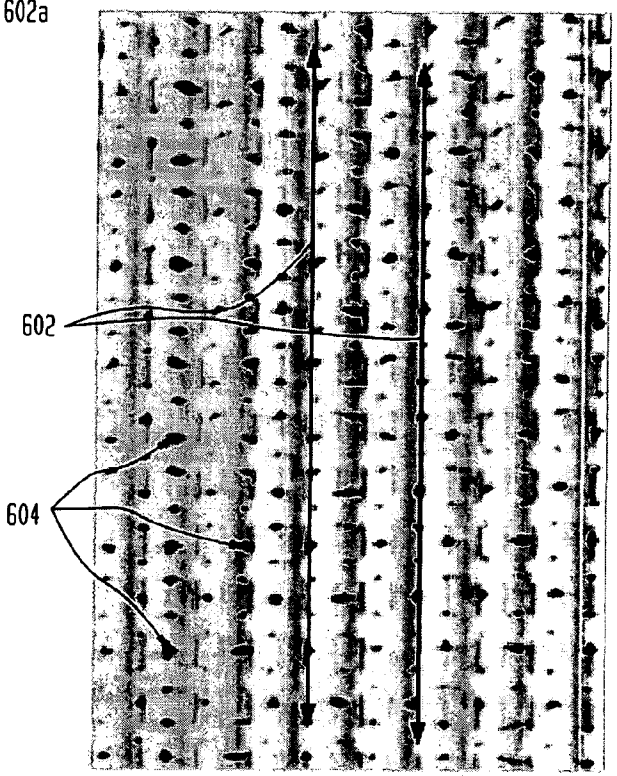
Figure 11:
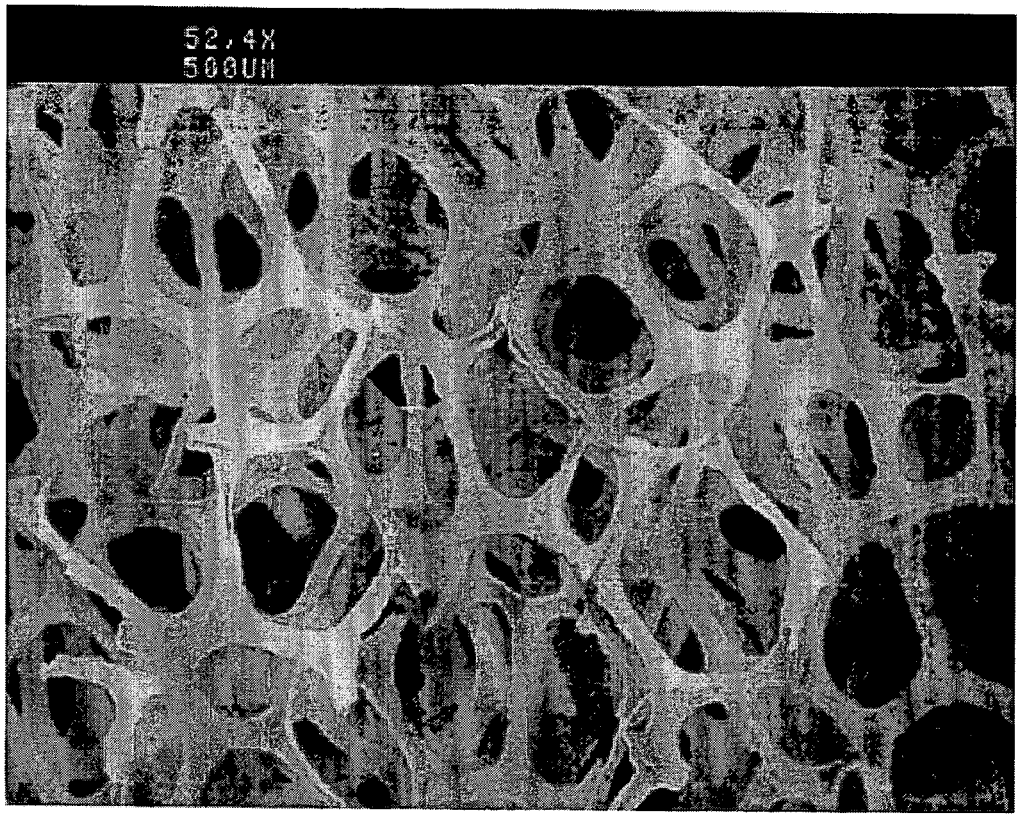
FIG. 11 illustrates a chimney material in accordance with aspects of the present invention.
Figure 12A:
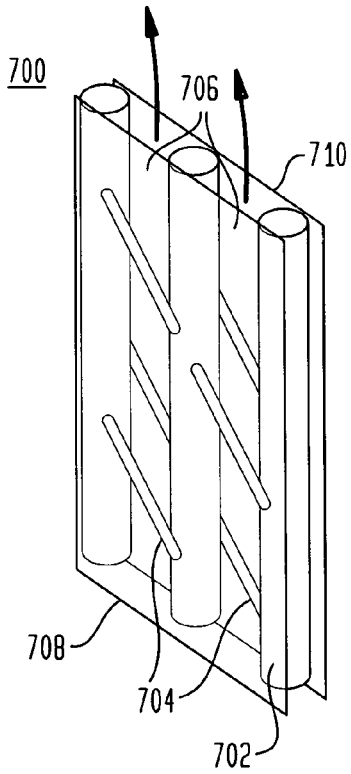
FIGS. 12(*a*)-(*j*) illustrate further chimney structures in accordance with aspects of the present invention.
Figure 12B:
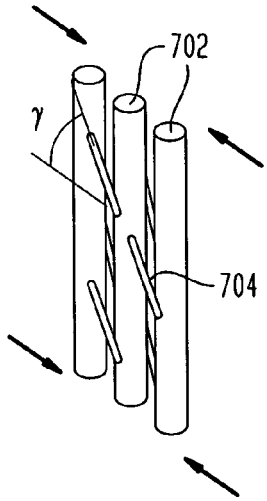
Figure 12C:
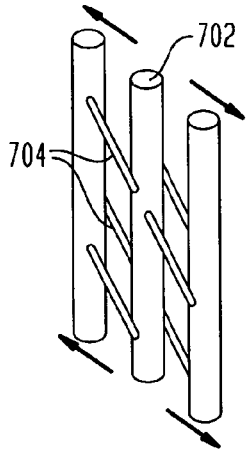
Figure 12D:
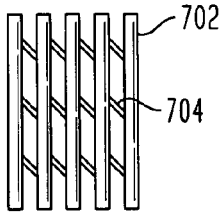
Figure 12E:
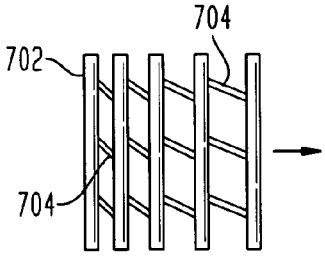
Figure 12F:
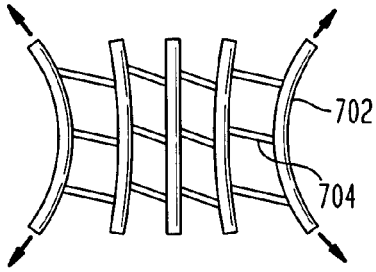
Figure 12G:
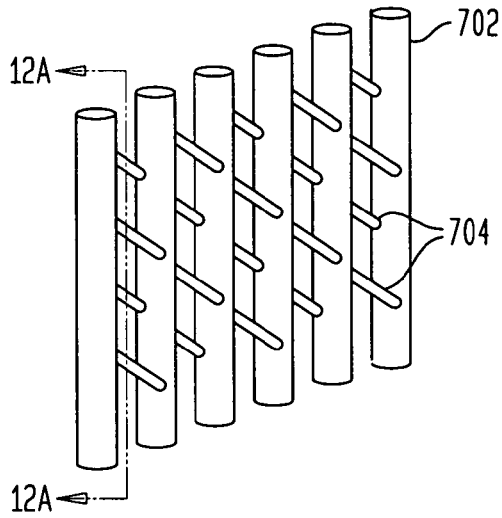
Figure 12H:
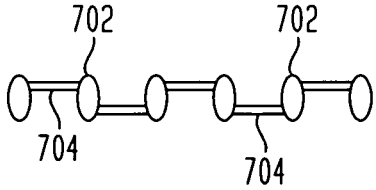
Figure 12I:
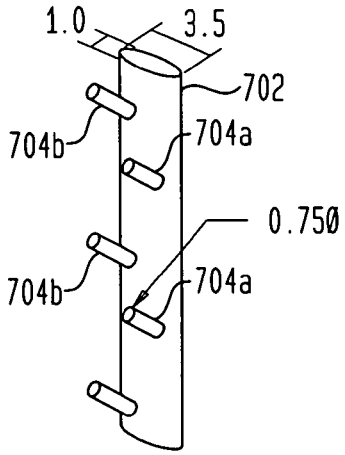
Figure 12J:
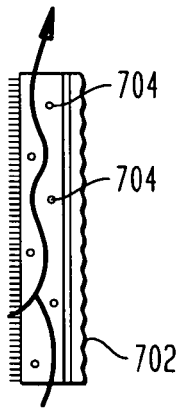
Figure 13D:
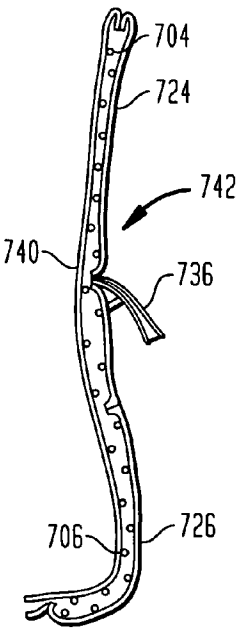
FIGS. 13(*a*)-(*e*) illustrate a sock utilizing chimneys in accordance with aspects of the present invention.
Figure 13A:
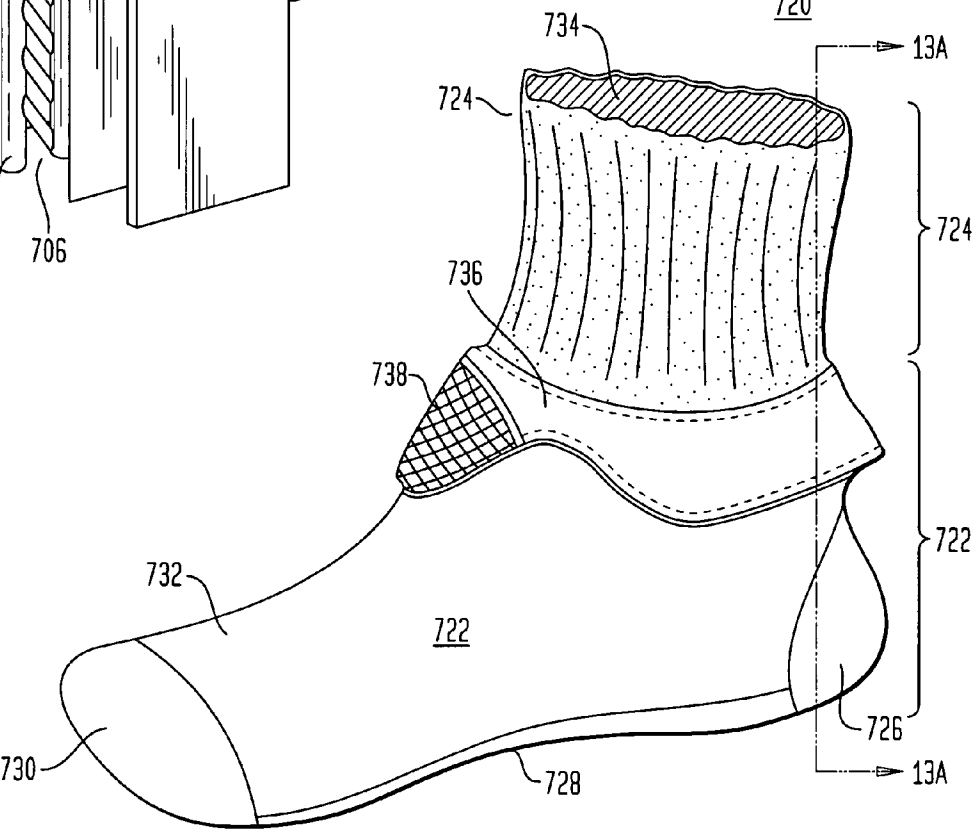
Figure 13C:
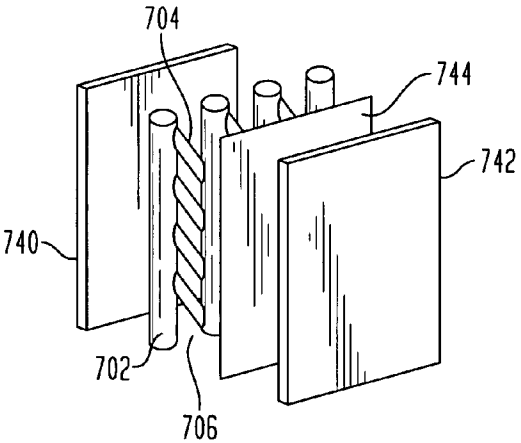
Figure 13B:
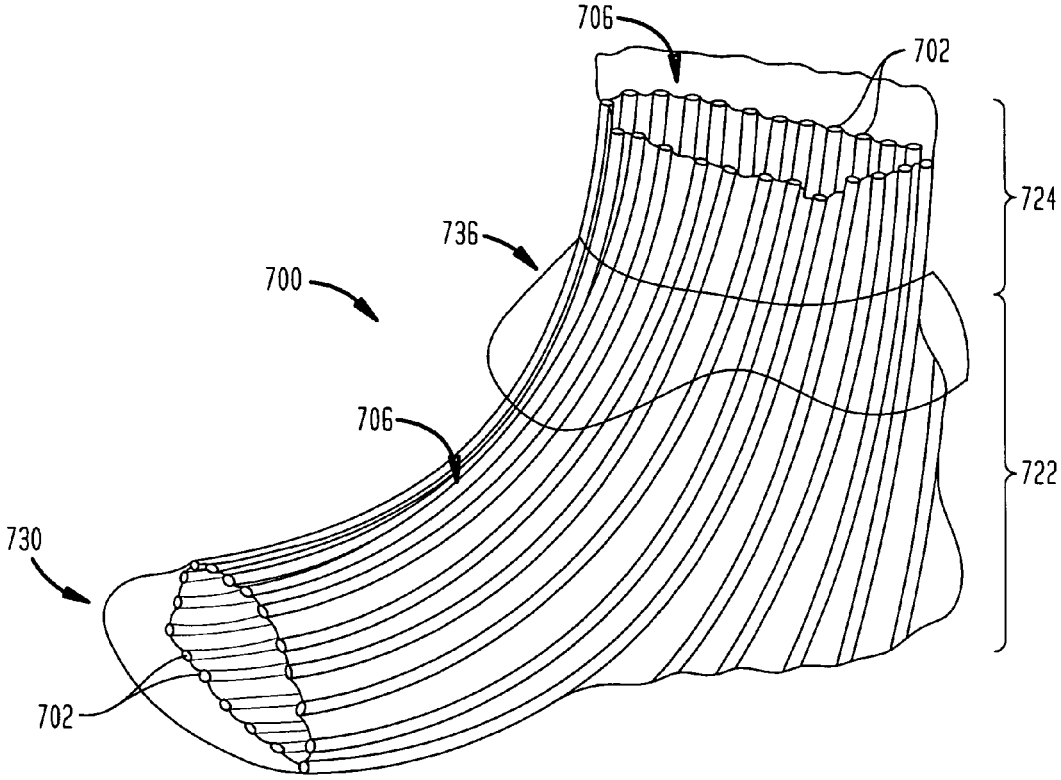
Figure 13E:
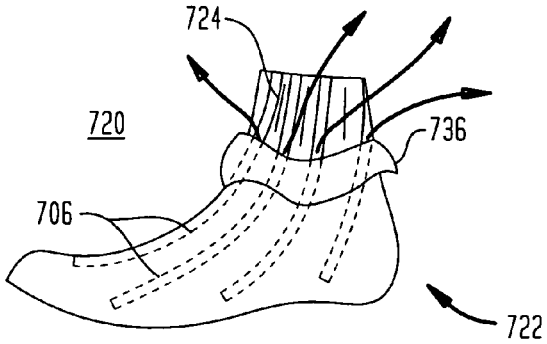
Figure 14A:
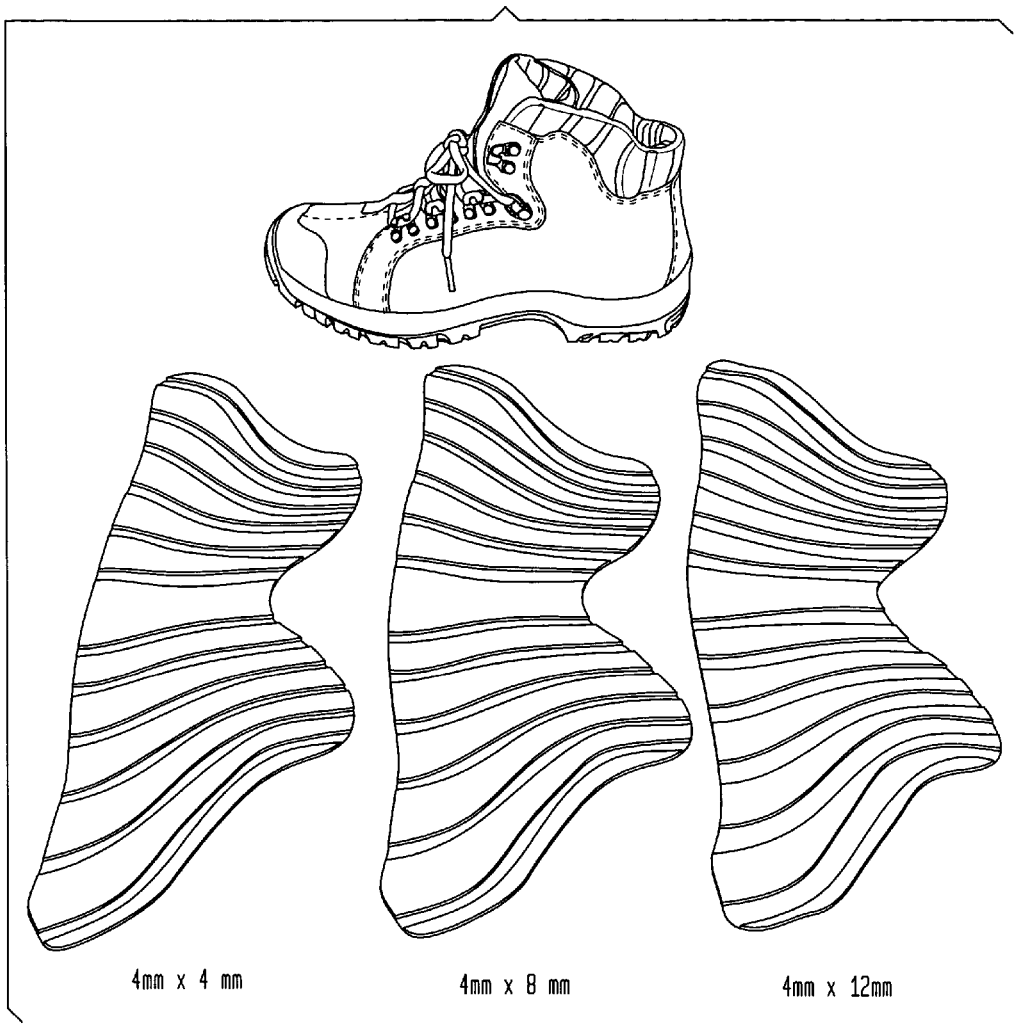
FIGS. 14(*a*)-(*e*) illustrate exemplary chimney structures in accordance with an aspect of the present invention.
Figure 14B:
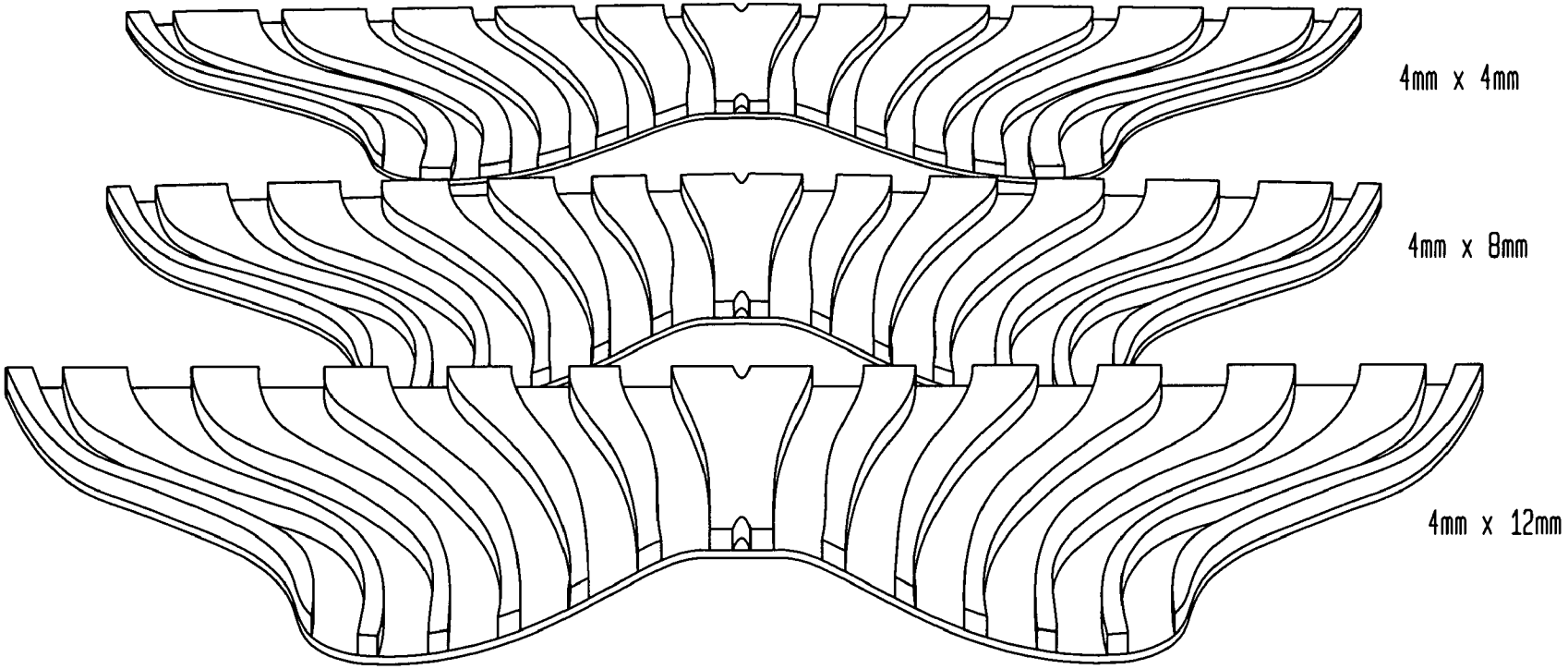
Figure 14C:
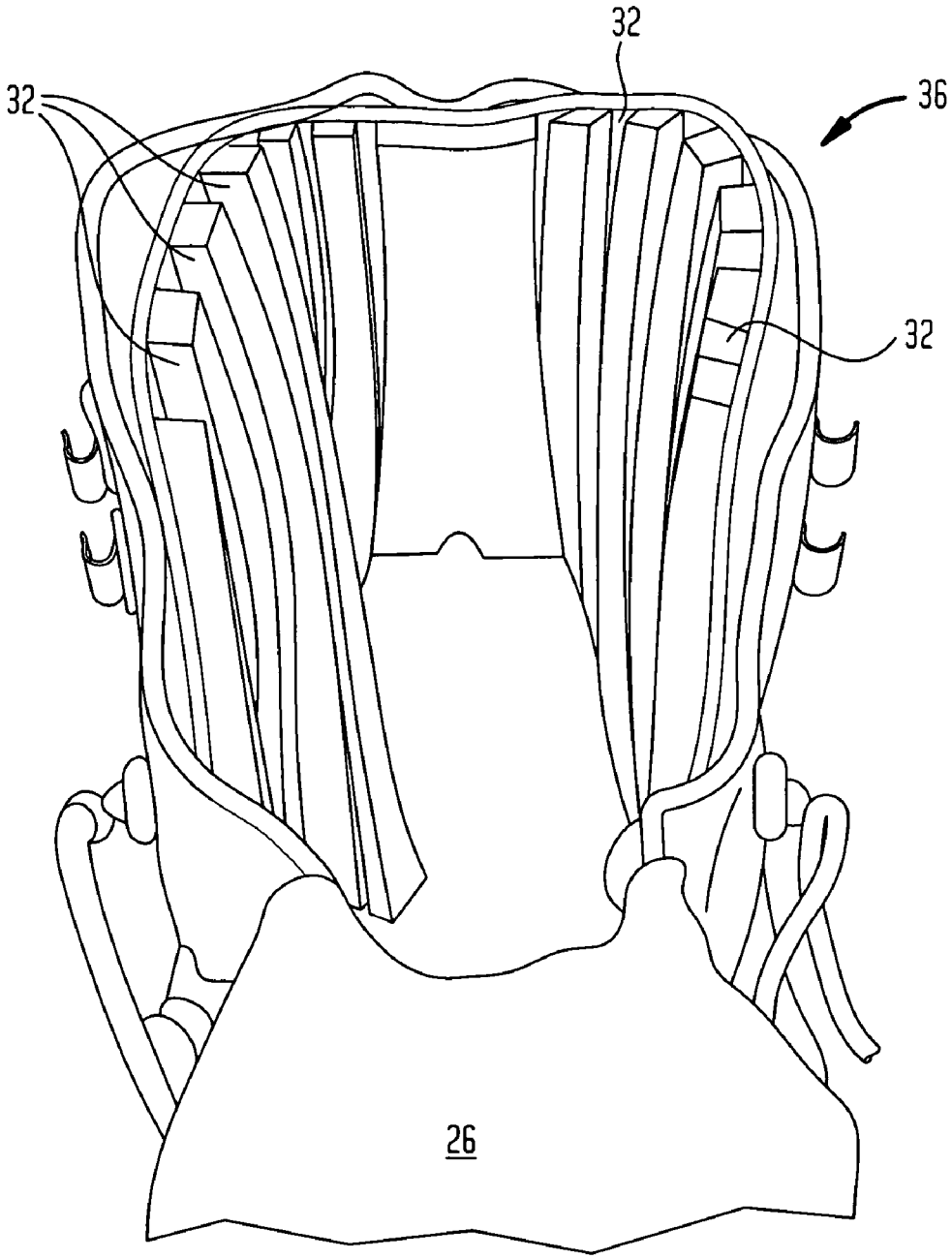
Figure 14D:
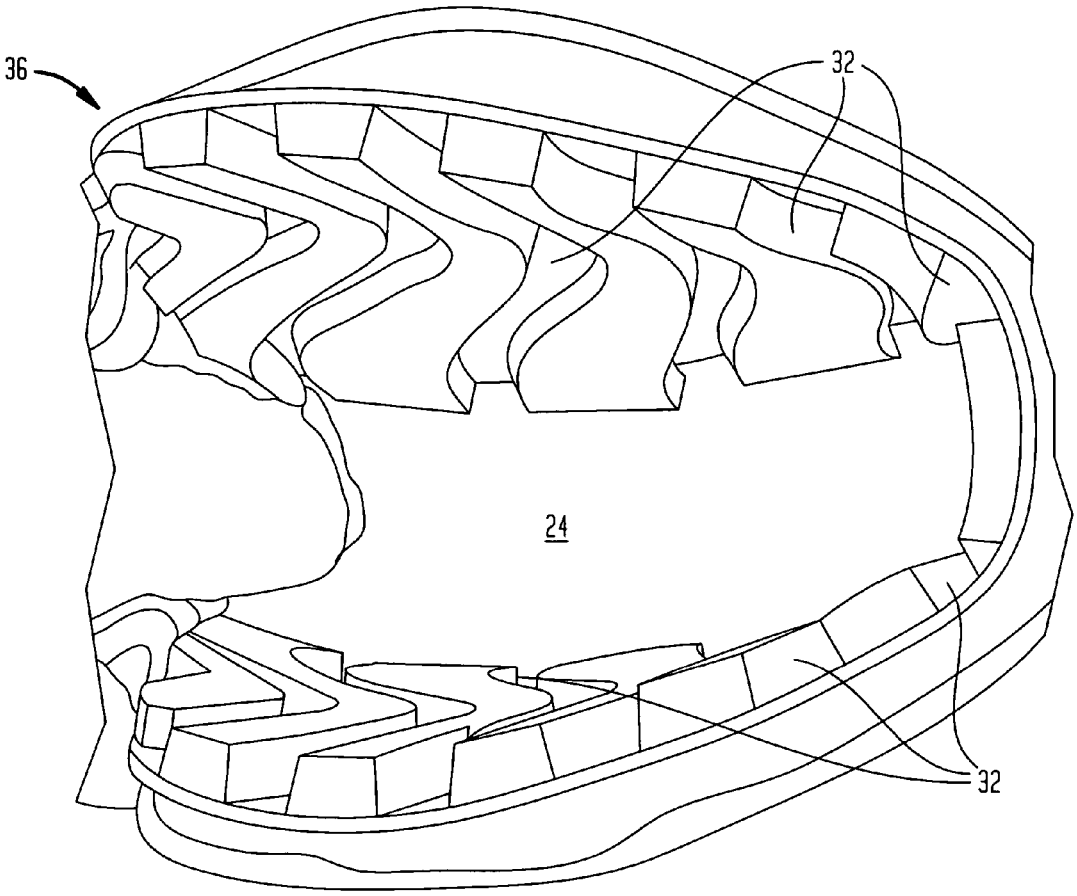
Figure 14E:
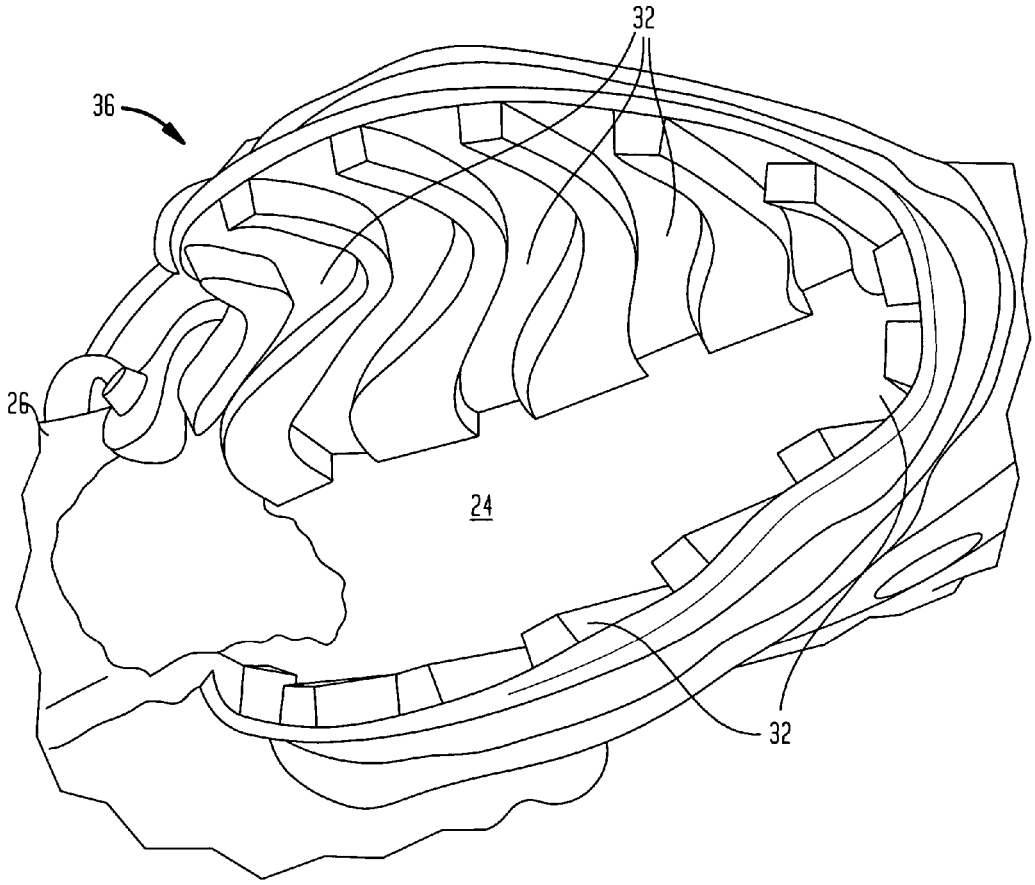
Figure 15A:
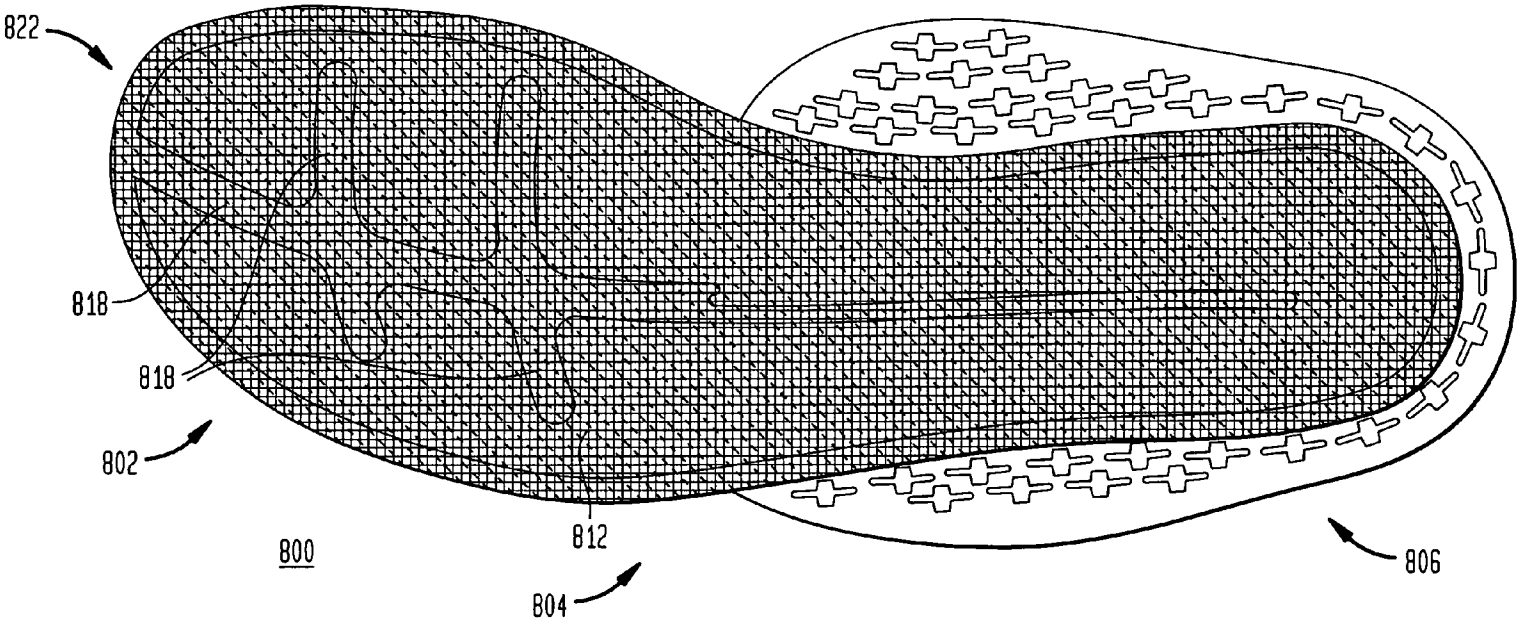
FIGS. 15(*a*)-(*e*) illustrate a footbed in accordance with aspects of the present invention.
Figure 15B:
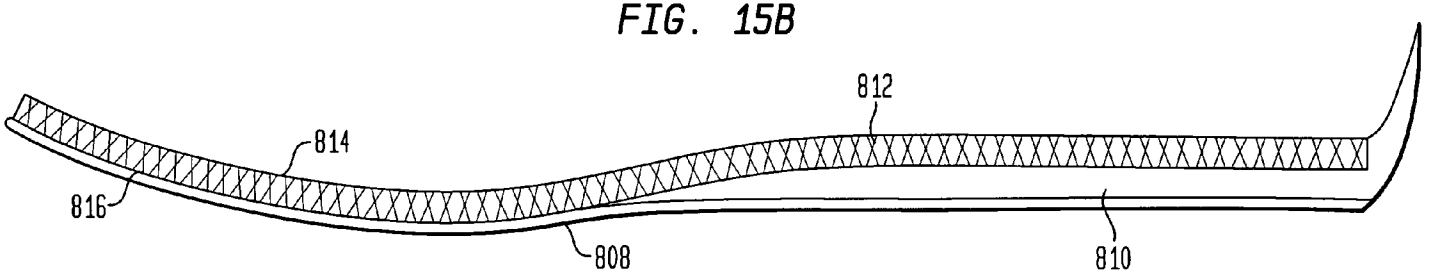
Figure 15C:
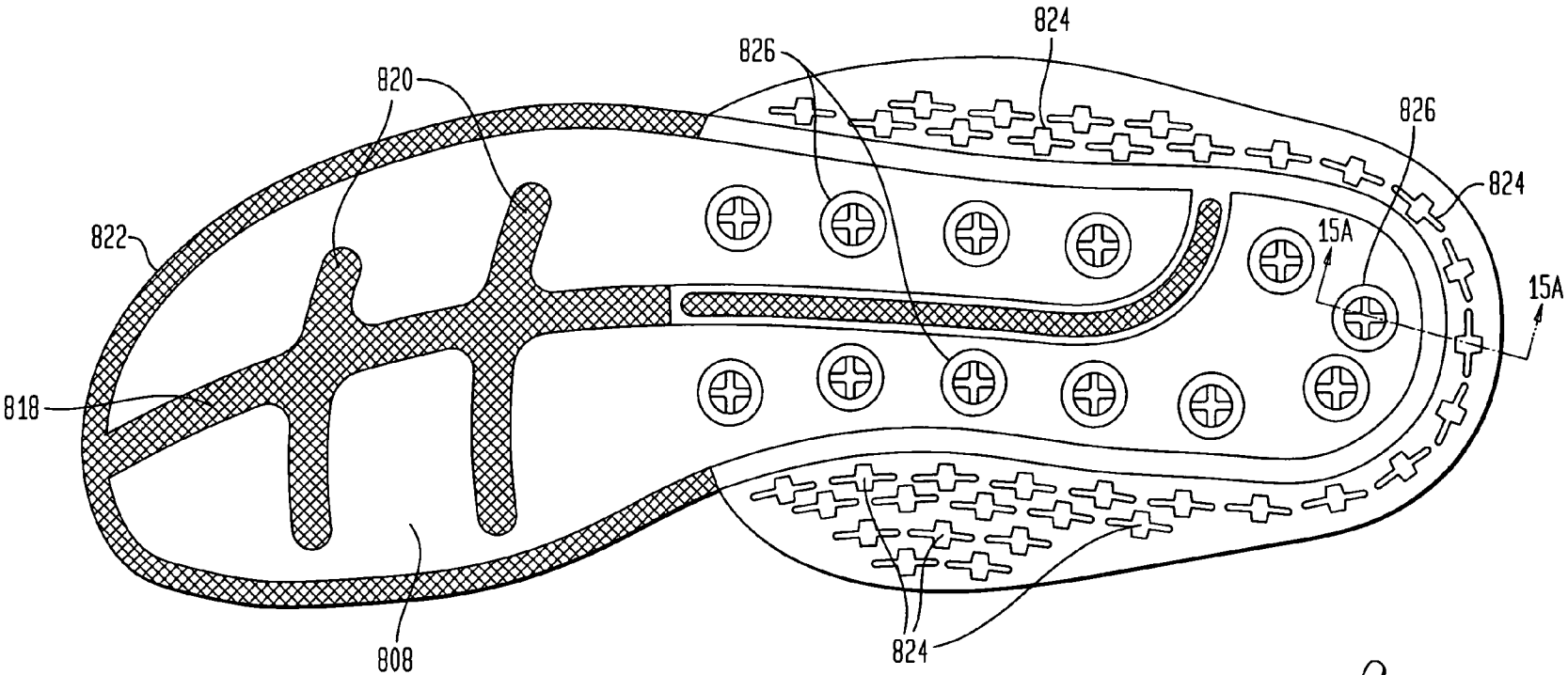
Figure 15E:
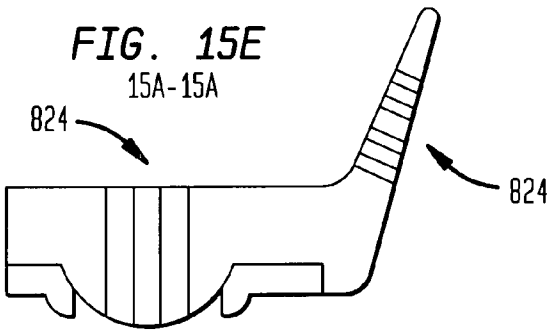
Figure 15D:
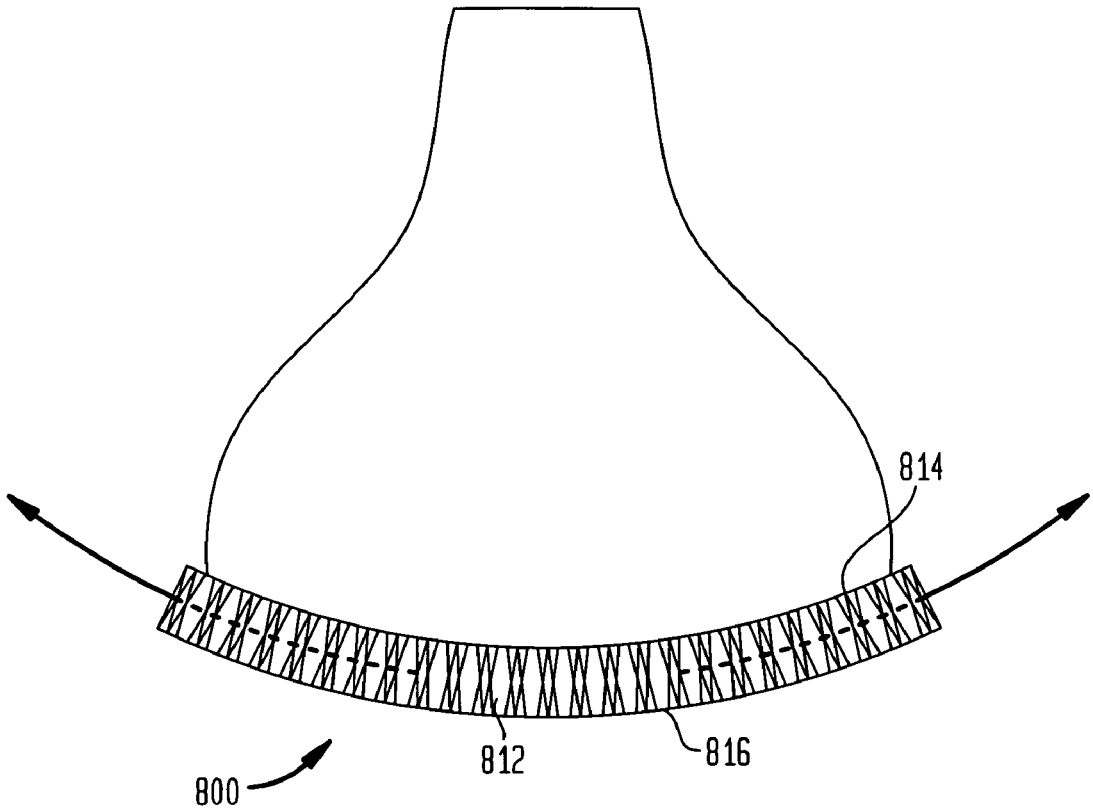

While FIGS. 1-5 illustrated many types of chimneys and chimney structures, and FIGS. 6-9 illustrate boots incorporating some selected chimney structures therein, there are many other types of chimneys and structures that can be used in accordance with aspects of the present invention. FIGS. 10 and 11 illustrate two such alternative chimney types. Specifically, FIGS. 10(*a*)-(*c*) illustrate a ridged or waffle-like chimney structure 600 having numerous individual chimneys 602 providing pathways to vent heat and moisture. As best seen in FIG. 10(*a*), the waffle-like chimney structure 600 includes alternating sets of opposing chimneys 602*a* and 602*b*. The side and perspective views of FIGS. 10(*b*)-(*c*) show the chimneys 602 having numerous openings 604 disposed there along. The openings 604 permit supplemental venting out of the interior micrbclimate as heat and moisture are convectively channeled up the chimneys 602. The chimney structure 600 may comprise PE, but any low density foam can be used. Preferably, the PE or other foam may be compression molded, milled, or fabricated by any other method that exists now or in future.

FIG. 11 is an electron micrograph of a reticulated foam structure 620. The reticulated foam structure 620 may be, for example, PE, PU, EVA, or any foam having an amorphous structure. The reticulated foam structure can be molded to form chimneys in accordance with many of the embodiments described above, including, but not limited to the chimneys illustrated in FIGS. 2-5. Furthermore, the porous structure of the reticulated foam promotes enhanced venting of moisture out from the shoe.

The chimneys described in the embodiments above are generally applicable to all manner of footwear. However, foot coverings designed to snugly fit about the wearer's foot, such as socks, create special needs that should be addressed in order to effectively vent heat and moisture. One obvious issue with conformal or form-fitting foot coverings is the need for comfort. While the chimneys are structures described above may be used, if the chimney structure is too rigid or firm, it will likely be uncomfortable to the wearer. However, if the chimney structure is too soft or pliable, the pathways of the chimneys will collapse and prevent heat and moisture evacuation. Therefore, the chimney structure should be capable of retaining its venting abilities even after repeated cleanings.

FIG. 12(*a*) illustrates an elasticized chimney structure 700 for use with form-fitting footwear such as socks or leggings. The elasticized chimney structure 700 has supports 702 connected to one another by braces 704. The supports 702 are preferably substantially parallel to one another. While shown as elongated cylinders or tubes, the supports 702 may have any other cross-sectional shape. Individual chimneys 706 are formed by an adjacent pair of the supports 702 and attendant braces 704. One or more chimneys 706 may be provided.

Heat and/or moisture are vented along the chimneys 706 as seen by the arrows in FIG. 12(*a*). Covers 708 and/or 710 may be placed on either side of the chimneys 706. The covers 708 and 710 are preferably formed of an elastic material, for instance, lycra, mesh, or a fabric with elastic properties. This allows movement, airflow and comfort. If used, the covers 708 and 710 are preferably connected to the supports 702 on the outsides of the braces 704.

FIGS. 12(*b*) and 12(*c*) illustrate the elasticized chimney structure 700 in compressed and stretched positions, respectively. As seen in FIG. 12(*b*), the braces 704 are preferably positioned at an angle γ relative to the supports 702. In one alternative, when the elasticized chimney structure 700 is at rest and not compressed or stretched, the angle γ is preferably between 22° and 67°. More preferably, at rest, the angle γ is approximately 45°, such as between 40° and 50°. When compressed, the angle γ may become close to 90°, for example at least 67°. When stretched, the angle γ may become close to 0°, for example less than 22°.

In another alternative shown in FIG. 12(*d*), the elasticized chimney structure 700 may be at rest in a substantially compressed state, wherein the angle γ is preferably less than 37°. In the partially stretched state of FIG. 12(*e*), the angle γ may be between 30° and 75°. In the fully stretched state shown in FIG. 12(*f*), the braces 704 may be mostly or completely perpendicular to the supports 702, and the angle γ may be between 75° and 90°.

FIGS. 12(*g*) and 12(*h*) illustrate perspective and top views of the elasticized chimney structure 700 with the covers 708 and 710 omitted. FIG. 12(*i*) illustrates a single support 702 with alternating columns of braces 704*a,b* thereon. FIG. 12(*j*) illustrates the elasticized chimney structure 700 along the 12A-12A line of FIG. 12(*g*). Heat and/or moisture are vented along the chimney 706 around the braces 704 as seen by the arrow in the figure.

FIG. 13(*a*) illustrates a sock 720 incorporating a chimney structure such as the chimney structure 700, therein. As seen in the figure, the sock 720 includes a sock body 722 and a collar 724 attached thereto. The sock body 722 includes a heel region 726, a sole region 728, and a toe region 730, and may include an outer covering 732 over the chimney structure. The outer covering 732 may comprise the cover 708 or 710 discussed above. The outer covering 732 may comprise a waterproof material. Optionally, an inner lining (not shown) may overlie the interior surface of the chimney structure 700 and may directly contact the foot. In this case, the inner lining preferably permits heat and moisture to escape away from the foot and into the chimneys 706.

The collar 724 includes an opening 734 at a first end thereof for receiving the foot. The collar 724 is preferably formed of a breathable material which can be flexible and/or elastic. The height of the collar 724 and/or the height of the body 722 may vary depending on the type of sock or legging, e.g., crew sock, running sock, skiing sock, tube sock. By way of example only, the height of the collar 724 may be on the order of 40 mm and the height of the body may be on the order of 90 mm. The collar 724 typically is positioned at or above the ankle. The chimneys 706 of the chimney structure 700 desirably extend at least partly into the collar 724, and may extend all the way to the top of the collar 724.

Optionally, the sock 720 may include a scree skirt 736. The scree skirt 736 may be disposed at or near the wearer's ankle, and may delineate the transition between the sock body 722 and the collar 724. When worn in conjunction with a shoe, such as a climbing shoe, the scree skirt 736 helps prevent rocks, dust, and other debris from entering the shoe and causing discomfort to the wearer. The scree skirt 736 may include a pocket 738 to hold the laces of the shoe. The pocket is preferably a rubberized stretch pocket that can be formed using mesh or other suitable materials.

FIG. 13(*b*) illustrates the sock 720 with the outer covering 732, scree skirt 736 and collar 724 in outline form. Here, the elasticized chimney structure 700 is shown as being generally arced, angled, or "L" shaped, although the elasticized chimney structure 700 may conform to any shape of the wearer's foot and/or leg. The elasticized chimney structure 700 may be open at the toe region 730 of the sock 720. Alternatively, the chimney structure 700 may extend fully into the toe region 730, and may partially or completely surround the wearer's toes.

FIG. 13(*c*) illustrates an exploded view of the chimney structure 700 and adjacent components. An inner lining 740 may be disposed between the chimney structure 700 and the wearer's foot. If used, the inner lining 740 preferably includes one or more layers of wicking material for removing sweat from the foot. An outer lining 742 may be disposed opposite the inner lining on the other side of the chimney structure remote from the foot. The outer lining may be the same or a different layer than the outer covering. The outer lining may include one or more layers of material. For example, a first layer 744 immediately adjacent to the chimney structure may comprise a PU film. A second layer 746 covering the first layer may comprise a non-wicking jersey material such as LYCRA® brand synthetic fiber material.

The chimney structure 700, inner lining 740 and/or outer lining 742 may be integral with or removable from the sock or legging 720. For example, in one embodiment, the chimney structure 700, the inner lining 740 and the outer lining 742 are all integrally formed as part of the sock 720. In another embodiment, the outer covering 732 comprises the outer lining 742, and the chimney structure 700 and the inner lining 740 are removably insertable into the outer covering 732. In this case, the chimney structure 700 and the inner lining 740 may be integrally formed or may comprise separate components.

FIG. 13(*d*) illustrates an exemplary cutaway view from the collar to the heel region along the 13A-13A line of FIG. 13(*a*). As seen in this view, the inner lining 740 is positioned on one side of the chimney structure 700 and the collar material and heel region material are positioned on the other side of the chimney structure 700. Thus, in this example, the outer lining 742 may include multiple sections of material, which may include different materials in the collar 724, the heel region 726, the sole region 728, and/or the toe region 730. Finally, the arrows in FIG. 13(*e*) illustrate how heat and/or moisture are directionally vented out of the sock 720 by the chimneys 706.

Many different chimneys and chimney structures have been illustrated and described above. These structures should be designed so that the pathways therein provide efficient evacuation from the shoe microclimate. The effectiveness of the pathways is tied to their cross-sectional area. While it might be assumed that the larger the cross-sectional area the better, in reality one cannot design footwear having arbitrarily large chimneys, as this may impinge on the structural characteristics of the footwear.

In order to determine suitable chimney sizes, various laboratory tests were performed. Testing was conducted using SATRA standard tests. Specifically, the AMM testing discussed above was performed using SATRA Test Method 376 dV. The tests were conducted on footwear implementing chimneys in accordance with aspects of the invention. Testing compared the effects of the chimneys in various footwear structures against a control structure without chimneys. Testing simulated the generation of heat and sweat by the foot in a shoe, quantifying the distribution of sweat output by absorption (e.g., absorption by the skin, sock, footbed, shoe upper, etc.), evaporation, and energy usage.

Experiments were carried out to examine effect of chimneys on moisture management. These experiments were also used to characterize chimney geometry in an effort to optimize performance. Lastly, testing was designed to look at the performance of different fabrication techniques and the effect of chimney hardness on moisture management performance.

Moisture management testing was conducted under the same laboratory conditions discussed above with regard to Tables 5 and 6. The external environment was maintained at 20° C. and 65% relative humidity. A simulated foot was used to conduct the test. The simulated foot was covered in a simulated skin membrane. A sock having the composition 42% cotton, 14.5% spandex, 21.5% nylon, and 22% polyester was placed on simulated foot and inserted in shoe under test. The foot was maintained at a temperature of 34° C. with a nominal sweat rate of 5 mL/hr. A constant airspeed of 2 m/s was maintained across the shoe during the test.

The chimney moisture management test compared five different hiking shoes. One of the shoes was a commercial off the shelf hiking shoe. Another shoe was fabricated by taking the commercial hiking shoe and removing the lining package in the upper. An EVA foam insert without chimneys replaced the lining package. The other three shoes employed EVA foam inserts with the open-ended rectangular chimney structures discussed above with regard to FIG. 5(*b*). The chimney inserts were used in place of the non-chimney foam insert. Each of the three chimney structures had a depth of 4 mm. The widths in the respective chimney structures were 4 mm, 8 mm, and 12 mm. FIG. 14(*a*) illustrates the three chimney structure inserts and the shoe they were used with. FIG. 14(*b*) illustrates another view of the chimney inserts. FIGS. 14(*c*)-(*e*) show chimney structure inserts within the shoe. Table 7 illustrates the test results.

TABLE 7

| Shoe Description | Skin Gain (g) | Sock Gain (g) | Shoe Gain w/ Footbed (g) | Footbed Uptake (g) | Evaporated Loss (g) | Energy Used (kJ) |
|---|---|---|---|---|---|---|
| Commercial Shoe | 0.69 | 4.17 | 6.81 | 1.58 | 3.34 | 48.6 |
| EVA Insert w/o chimneys | 1.33 | 6.93 | 3.66 | 0.93 | 3.08 | 43.7 |
| EVA Insert w/16 $mm^2$ chimneys | 1.18 | 5.69 | 4.06 | 1.44 | 4.07 | 47.2 |
| EVA Insert w/32 $mm^2$ chimneys | 0.59 | 4.19 | 4.06 | 1.43 | 6.16 | 54.5 |
| EVA Insert w/48 $mm^2$ chimneys | 0.60 | 3.50 | 3.65 | 1.28 | 6.95 | 58.7 |

Data showed an increase in ventilation performance as chimney pathway cross section increased from 0 $mm^2$ to 48 $mm^2$. For example, as compared to the commercial shoe, the shoe having pathways 8 mm wide and 4 mm deep (32 $mm^2$) was found to create approximately an 84.4% increase in the evaporative moisture loss. Similarly, compared to the commercial shoe, the shoe having pathways 12 mm wide and 4 mm deep (48 $mm^2$) was found to create more a 108% increase in the evaporative moisture loss. Notably, in the commercial shoe the moisture was not absorbed by the synthetic skin or the sock to the degree found in the insert without chimneys or the insert having the 4 mm×4 mm structure. However, in the commercial shoe test a substantial amount of moisture was absorbed by the shoe and by the footbed itself. Furthermore, the control shoe having the EVA insert without chimneys performed slightly worse than the commercial shoe, with an evaporation loss on the order of 8% worse than the commercial shoe.

Overall, it is clearly seen that the larger area chimneys provided significant and substantial improvement in the microclimate of shoes when compared against the commercially available shoe. However, even the smallest chimney structure produced at least a 21% increase in evaporation loss as compared to the commercial shoe. Thus, the testing shows that small, medium and large size chimneys can greatly improve moisture evaporation While the use of chimneys in footwear and foot coverings is important to regulate the microclimate, how the chimneys are made and what they are made from can impact their performance. It has been determined that common manufacturing techniques may be used for chimney construction.

Multiple potential fabrication techniques were analyzed to determine if there was a difference in performance. These fabrication techniques included molded fabric with poured PU, compression molded EVA with a sprayed flocking, and compression molded EVA with a fabric laminate. Boots fabricated using the aforementioned techniques were tested in accordance with the SATRA AMM test. Table 8 illustrates these test results.

TABLE 8

| Boot Description | Skin Gain (g) | Sock Gain (g) | Shoe Gain w/ Footbed (g) | Footbed Uptake (g) | Evaporated Loss (g) | Energy Used (kJ) |
|---|---|---|---|---|---|---|
| Molded fabric with poured PU | 0.41 | 3.97 | 4.97 | 1.38 | 5.65 | 56.6 |
| Compression molded EVA with a sprayed flocking | 0.57 | 4.57 | 5.42 | 1.34 | 4.45 | 54.4 |
| Compression molded EVA with a fabric laminate | 0.71 | 4.78 | 4.35 | 1.40 | 5.17 | 56.6 |

All of the fabrication techniques demonstrated substantial improvement over a conventional production shoe without chimneys, as shown above with regard to Table 7. In particular, the molded fabric with poured PU demonstrated the greatest performance increase in evaporated moisture loss, approximately 69% increase over production footwear. The compression molded EVA with sprayed flocking had approximately a 33% increase in moisture loss, and the compression molded EVA with fabric laminate had nearly a 55% increase.

In addition to chimney materials, the effect of chimney hardness on moisture management performance was also examined in view of durability and comfort. Different footwear were created and tested with finished chimney hardness chosen as 10, 20, and 30 on the Asker C scale. Table 9 illustrates the chimney hardness moisture accumulation and evaporation test results.

TABLE 9

| Chimney Hardness | Skin Gain (g) | Sock Gain (g) | Shoe Gain w/ Footbed (g) | Footbed Uptake (g) | Evaporated Loss (g) | Energy Used (kJ) |
|---|---|---|---|---|---|---|
| 10 | 0.85 | 4.79 | 4.67 | 1.72 | 4.69 | 52.1 |
| 20 | 0.72 | 4.44 | 4.15 | 1.69 | 5.70 | 51.0 |
| 30 | 0.75 | 4.63 | 4.43 | 1.78 | 5.20 | 51.3 |

In each test, the evaporative loss was substantially greater than in the commercial shoe of Table 7. Although not statistically significant in terms of evaporative moisture loss, chimneys with an Asker C hardness on the order of 20 offered an improvement over similar chimneys with different hardness. In one preferred example includes chimneys having a hardness of at least 15-20 Asker C. In another example, the chimneys desirably have a harness of between 25 and 35 Asker C.

As discussed earlier, chimneys in accordance with the present invention have proven to provide superior ventilation, allowing warm air to rise out of the boot and carry moisture away. In general, a variety of chimney widths can be used. Construction type, materials, footwear design and end use play a role in the optimal placement and dimensions of channels. Testing has proven that evaporation and the removal of moisture increases as chimney width increases. This results in dryer socks and skin and, in general terms, increased comfort. Chimneys may be incorporated into all types of footwear, including but not limited to protective footwear, in varying geometries and placements.

Channels incorporated into the tongue area of a boot or other shoe may be wider than channels incorporated into the heel area. One reason is that there are more sweat glands located on the top of the foot than in the heel. Another reason is that air circulation from the medial and lateral surface areas of the foot benefit greatly from placement of wider channels on the tongue to allow for enhanced overall evaporation of moisture.

A variety of materials can be used for construction of the chimneys such as PU and EVA foams as well as polymer gels. Additionally, a variety of liner materials can be used to enhance the moisture management, the heat transfer process and/or provide additional insulation, comfort or protection. Synthetic materials such as spandex, nylon, polyester, polypropylene or natural fibers such as wool can be used as lining material. In most cases, the traditional materials used for footwear manufacturing do not need to be altered in order to incorporate the current invention. The only requirement is that one of the layers includes a material that can be molded into a shape that forms a chimney. Moldable materials, such as moldable foams and plastics commonly used in contemporary footwear, may be utilized.

As discussed above, any type of footbed may be used in accordance with the chimneys of the present invention. However, it can be desirable in many situations to utilize specialty footbeds to enhance the convection and vent heat and moisture away from the foot. FIGS. 15(*a*)-(*f*) illustrate an exemplary footbed 800 that may be used in conjunction with the chimneys of the present invention. As seen in the top view of FIG. 15(*a*), the footbed 800 includes a toe region 802, a sole region 804 and a heel region 806.

As seen in the side view of FIG. 15(*b*), the regions of the footbed 800 are preferably formed with multiple layers. Bottom plate 808 preferably contacts the bottom of the inside of a shoe, and may rest on a midsole, an insole or the outsole depending upon the construction of the shoe. The bottom plate 808 is desirably formed of TPU, although other materials or combinations of materials can be used.

A heel cup 810 is preferably disposed over the bottom plate 808 at least along the heel region 806. The heel cup 810 may extend forward into the sole region 804. The heel cup 810 may comprise EVA foam or other material. The bottom plate 808 and the heel cup 810 may be cemented and compression molded together during fabrication.

Overlying the bottom plate 808 and the optional heel cup 810 is an airflow chassis 812. The airflow chassis 812 preferably comprises a mesh-like material such as nylon, plastic, polyester, etc. The porous structure of the airflow chassis 812 enables heat and moisture to vent away from the foot. The airflow chassis 812 may include a top liner 814, a bottom liner 816, or both. Preferably, the hardness of the material of the airflow chassis 812 is between 40-70 on the Asker C scale. More preferably, the hardness is between 50-55 on the Asker C scale. The airflow chassis 812 may be cemented or otherwise affixed to the bottom plate 808 and the heel cup 810.

As best seen in the bottom view of FIG. 15(*c*), the bottom plate 808 may include one or more longitudinal openings 818, which may be in the toe region 802, the sole region 804, and/or the heel region 806. The bottom plate 808 may also include one or more transverse openings 820, which may intersect the longitudinal opening 818. Also, it can be seen in this figure that the airflow chassis 812 preferably includes a lip 822 which overhangs the bottom plate 808.

The longitudinal opening 818, the transverse openings 820 and the lip 822 all help to promote movement of air away from the bottom of the foot. For example, FIG. 15(*d*) illustrates a cross-sectional view of the footbed 800 with a foot placed thereon. The arrows in the cross-sectional view illustrate how air is expelled outwards towards the sides of the footbed 800. When used in combination with chimney structures, the footbed 800 is capable of directing hot, moist air near the bottom of the foot towards the chimney pathways.

Returning to FIG. 15(*c*), the heel cup 810 desirably includes exterior perforations 824. The exterior perforations 824 preferably extend around the perimeter of the heel cup 810. Interior perforations 826 may also be provided in the heel cup 810. As seen in the cutaway view of FIG. 15(*e*) along the 15A-15A line of FIG. 15(*c*), the interior perforations 826 preferably extend completely through the heel cup 810 and the bottom plate 808 as well. The exterior and interior perforations 824, 826 further enable the footbed 800 to transfer hot, moist air away from the foot.

It should be understood that while the footbed 800 is preferably used in combination with chimneys and chimney structures as disclosed herein, it is possible to utilize the footbed 800 without chimneys. In this case, the footbed 800 will provide the benefit of air circulation under and around the foot. The footbed 800 could be used with footwear that may not lend itself to the use of chimneys. By way of example only, open-toed sandals or similar structures may not derive substantial benefit from large chimney structures; however, the footbed 800 would still be quite suitable in this situation. It should also be understood that the footbed may be removable or permanently secured to an article of footwear.

The present invention was developed, in part, to enhance the natural processes of sweating and evaporation that the body uses to regulate temperature, thus breaking the traditional, unsuccessful compromise that exists today in conventional footwear. By incorporating chimneys in accordance with various embodiments of the invention in the sidewalls and tongue portions of the footwear, or in the foot covering worn with or without such footwear, these natural processes are effectively promoted to ensure a more consistent range of temperature, moisture and comfort. Testing of various embodiments of the invention has proven that chimneys are an effective means of temperature regulation without interfering with the integrity of the particular protective characteristics of the shoe, such as waterproofing, insulation, durability, support, etc. An air permeable footbed, for example a mesh footbed, can also be used in conjunction with the chimneys and structures discussed herein to further promote airflow around the foot.

It can be seen that chimneys of various geometries can effectively vent heat and moisture from footwear. The different geometries can be mixed and matched within a given shoe to optimize ventilation and to enhance comfort. By way of example only, the chimneys may be squared, rounded, rectangular or mixed. The chimneys may be open on one or both sides. They may be substantially vertical, or angled, arched, s-shaped, curved, etc. A covering, if used, can be a breathable, wicking material, such as mesh. Depending on construction type, footwear design, materials, and comfort requirements, an open channel may be suitable, or a covered channel may be preferred. Alternatively, there may be a combination of open and covered chimneys in the same article of footwear.

It is possible to replace a chimney or a chimney structure with another chimney or chimney structure. For instance, the chimney or chimney structure may be a removable insert, providing interchangeability depending on the type of activity, the external environment, etc. For example, the wearer may replace a chimney or chimney structure for cleaning. Alternatively, the in shoe chimney or chimney structure may be exchanged for another chimney or chimney structure having different characteristics or parameters. In this case, the wearer could select the chimney or chimney structure to have a particular cross-sectional area, shape, material, etc. based upon environmental conditions, a sport or activity, or a personal preference.

Footwear can be constructed in such a way as to provide an upper and bottom that can receive a variety of inserts depending on activity and climate requirements. By way of example only, a hiking boot with a leather or synthetic upper that has been combined with a breathable, waterproof membrane such as a hydrophobic PTFE may be purchased with two channel inserts. One insert can be used for warm weather and is made of low density foam with perforations for ventilation (e.g., holes or slits). The foam may be laminated with a lightweight breathable material (e.g., polyester, spandex, nylon, polypropylene or blend) that is appropriate given the climate requirements and promotes heat and moisture transfer/evaporation that is needed to assist in regulating the microclimate within the shoe. The second insert may be preferable in cold, wet weather conditions and can be made of foam having a higher density than the first insert. This foam insert can be laminated to an insulating material such as wool, fleece, and/or a non-woven batting material to provide insulation from the external climate while the chimneys regulate heat and moisture transfer/evaporation to provide a more constant and comfortable internal microclimate.

The chimneys and chimney structures disclosed herein may be incorporated into all manner of footwear, such as shoes, and foot coverings such as socks and leggings, and can also be incorporated into apparel such as gloves, pants, shirts, jackets, hats, helmets, etc. PU chimneys may be incorporated into the sock material, for example placed between two layers of a wicking breathable material such as polyester, which allows for the evaporative moisture loss enhanced by convection. In this case, the sock could be worn with conventional shoes, or could also be worn with shoes incorporating chimney structures themselves.

A wide variety of materials can be used to achieve the chimneys of the present invention. Materials such as reticulated foam may be used to form chimneys, and the porous structure can enhance ventilation. The materials can be molded and formed appropriately to the design of the footwear. For example, foam materials can be exposed in surface areas on the upper and/or the top opening of the shoe remains open or exposed to allow for ventilation of heat.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims. By way of example only, while different embodiments described above illustrate specific features, it is within the scope of the present invention to combine or interchange different features among the various embodiments to create other variants. Any of the features in any of the embodiments can be combined or interchanged with any other features in any of the other embodiments. The invention can be used in combination with new or uncommon materials in addition to the materials specified above, as well as with new or uncommon manufacturing techniques.

The invention claimed is:

1. An article of footwear, comprising:

an outsole;

an upper attached to the outsole, the upper defining a cavity for receiving a wearer's foot and including a tongue; and a chimney structure disposed along the tongue of the upper, the chimney structure comprising a series of chimneys, each of the chimneys including a pair of sidewalls, a continuous endwall connecting the sidewalls and an open side opposite the endwall, wherein the sidewalls, the endwall and the open side define an elongated pathway between first and second ends of the respective chimney, the open side of the pathway facing into the cavity and disposed generally adjacent the wearer's foot during wear, wherein the first end of the chimney pathway is disposed at a lower end of the tongue and the second end of the chimney pathway is disposed at an upper end of the tongue, wherein the chimneys ventilate heat or moisture from within the cavity upward along the lengths of the respective chimneys and out of the respective second ends thereof to outside the article of footwear, and wherein the series of chimneys is a first series of chimneys and the chimney structure further comprises a second series of chimneys, each of the second series of chimneys including a pair of sidewalls, an endwall connecting the sidewalls and an open side opposite the endwall, wherein the sidewalls, the endwall and the open side define a pathway between first and second ends of the respective chimney, and wherein the second series of chimneys faces away from the cavity.

2. The article of footwear of claim 1, wherein at least some of the second series of chimneys share a common endwall wall with corresponding ones of the first series of chimneys.

3. The article of footwear of claim 2, wherein the common endwall includes at least one opening therein to enable the heat or moisture to pass from a respective one of the first series of chimneys to a respective one of the second series of chimneys conjoined with the respective first chimney.

4. An article of footwear, comprising:

an outsole;

an upper attached to the outsole, the upper defining a cavity for receiving a wearer's foot and including a tongue; and a chimney structure disposed along the tongue of the upper, the chimney structure comprising a series of chimneys, each of the chimneys including a pair of sidewalls, a continuous endwall connecting the sidewalls and an open side opposite the endwall, wherein the sidewalls, the endwall and the open side define an elongated pathway between first and second ends of the respective chimney, the open side of the pathway facing into the cavity and disposed generally adjacent the wearer's foot during wear, wherein the first end of the chimney pathway is disposed at a lower end of the tongue and the second end of the chimney pathway is disposed at an upper end of the tongue, wherein the chimneys ventilate heat or moisture from within the cavity upward along the lengths of the respective chimneys and out of the respective second ends thereof to outside the article of footwear, and wherein the chimney structure is removably insertable in the tongue between an inner layer and an outer layer thereof, and not being attached by a fastening mechanism to the inner or outer layer.

5. The article of footwear of claim 1, wherein at least some of the chimneys have a substantially semicircular cross-sectional shape.

6. The article of footwear of claim 1, wherein at least some of the chimneys have a substantially rectangular cross-sectional shape.

7. The article of footwear of claim 1, wherein the chimneys comprise a flexible material, whereby the chimneys flex in response to movement by the wearer.

8. An article of footwear, comprising:

a sole;

an upper attached to the sole, the upper defining a cavity for receiving a wearer's foot and having a base adjacent to the sole and a top edge remote from the base, the upper further including a collar region adjacent the top edge of the upper and a tongue;

a first chimney structure to ventilate heat and moisture from within the cavity to outside the article of footwear, the first chimney structure comprising a plurality of chimneys disposed along a first side of the upper, each of the first side chimneys including sidewalls bounded on a first side thereof by a continuous wall disposed between and along the sidewalls and a second side opposite the continuous endwall to define a ventilating pathway, the second side facing the cavity and disposed generally adjacent the wearer's foot during wear; and a second chimney structure to ventilate heat and moisture from within the cavity to outside the article of footwear, the second chimney structure comprising a plurality of chimneys disposed along the tongue of the upper, each of the tongue chimneys including sidewalls bounded on a first side thereof by a continuous endwall disposed between and along the sidewalls and a second side opposite the endwall to define a tongue ventilating pathway, the second side facing the cavity and disposed generally adjacent the wearer's foot during wear, the endwall including a series of longitudinal openings aligned along at least some of the tongue ventilating pathways.

9. The article of footwear of claim 8, further comprising:

a ventilation structure disposed in a heel section of the upper; and a ventilation material disposed only along the collar region of the upper and coupled to the first chimney structure and the heel ventilation structure, the ventilation material including a plurality of openings that cooperate with at least some of the ventilating pathways of the first chimney structure to promote ventilation.

10. The article of footwear of claim 8, further comprising an external vent disposed on the first side of the upper, the vent being disposed adjacent to selected ones of the ventilating pathways of the first chimney structure to vent heat or moisture from the selected ventilating pathways to the external environment.

11. The article of footwear of claim 10, wherein the external vent comprises a row of vents is disposed adjacent to the selected ventilating pathways.

12. The article of footwear of claim 8, further comprising a tongue liner disposed over the second chimney structure remote from the cavity, the tongue liner covering the endwall and the sidewalls of each of the tongue chimneys, the tongue liner comprising a material having one or more openings adjacent to at least some of the tongue ventilating pathways having the series of longitudinal openings thereon.

13. The article of footwear of claim 8, further comprising a third chimney structure to ventilate heat and moisture from within the cavity to outside the article of footwear, the third chimney structure comprising a plurality of chimneys disposed along a second side of the upper, each of the second side chimneys including sidewalls bounded on a first side thereof by a continuous endwall disposed between and along the sidewalls and a second side opposite the continuous wall to define a ventilating pathway, the second side facing the cavity and disposed generally adjacent the wearer's foot during wear.

14. The article of footwear of claim 12, further comprising:

a ventilation structure disposed in a heel section of the upper between the first and third chimney structures; and a ventilation material disposed along the collar region of the upper and coupled to the first and third chimney structures and the heel ventilation structure, the ventilation material including a plurality of openings that cooperate with at least some of the ventilating pathways of the first and second chimney structures to promote ventilation.

15. The article of footwear of claim 1, wherein the ventilation is done by convection.

* * * * *

UNITED STATES PATENT AND TRADEMARK OFFICE

CERTIFICATE OF CORRECTION

PATENT NO. : 8,359,769 B2
APPLICATION NO. : 11/143538
DATED : January 29, 2013
INVENTOR(S) : David L. Vattes et al.

It is certified that error appears in the above-identified patent and that said Letters Patent is hereby corrected as shown below:

In the Specification

Col. 22, Line 44, "overly" should read -- overlie --.

Signed and Sealed this
Seventh Day of October, 2014

Michelle K. Lee

Michelle K. Lee
*Deputy Director of the United States Patent and Trademark Office*